US006984161B2

(12) United States Patent
Suzuki et al.

(10) Patent No.: US 6,984,161 B2
(45) Date of Patent: Jan. 10, 2006

(54) LENS GRINDING PROCESSING APPARATUS

(75) Inventors: Yasuo Suzuki, Tokyo (JP); Yoshimasa Ogawa, Tokyo (JP); Yasuhito Eto, Tokyo (JP)

(73) Assignee: Kabushiki Kaisha TOPCON, Tokyo (JP)

( * ) Notice: Subject to any disclaimer, the term of this patent is extended or adjusted under 35 U.S.C. 154(b) by 0 days.

(21) Appl. No.: 10/664,621

(22) Filed: Sep. 19, 2003

(65) Prior Publication Data

US 2004/0058624 A1 Mar. 25, 2004

(30) Foreign Application Priority Data

Sep. 20, 2002 (JP) ..... 2002-275279

(51) Int. Cl.
*B24B 49/00* (2006.01)

(52) U.S. Cl. ..... 451/5; 451/8; 451/43; 451/71; 451/255

(58) Field of Classification Search ..... 451/41, 451/43, 44, 5, 6, 8, 11, 65, 71, 255, 256, 251
See application file for complete search history.

(56) References Cited

U.S. PATENT DOCUMENTS

| | | | | |
|---|---|---|---|---|
| 1,370,035 | A * | 3/1921 | Moffitt | 408/89 |
| 1,497,147 | A * | 6/1924 | Kendis | 451/255 |
| 2,166,037 | A * | 7/1939 | Campos | 451/240 |
| 2,352,616 | A * | 7/1944 | Canning | 451/390 |
| 2,620,687 | A * | 12/1952 | Jones et al. | 408/40 |
| 3,631,637 | A * | 1/1972 | Tagnon | 451/390 |
| 3,738,065 | A * | 6/1973 | Tagnon | 451/239 |
| 5,291,692 | A * | 3/1994 | Takahashi et al. | 451/388 |
| 5,357,716 | A * | 10/1994 | Kishida et al. | 451/390 |
| 5,674,113 | A * | 10/1997 | Underwood | 451/237 |
| 6,238,278 | B1 * | 5/2001 | Haftmann | 451/279 |
| 6,419,570 | B1 * | 7/2002 | Werner | 451/390 |
| 6,641,466 | B2 * | 11/2003 | Wallendorf et al. | 451/285 |
| 6,749,377 | B2 * | 6/2004 | Gottschald et al. | 409/132 |
| 2003/0087583 | A1 * | 5/2003 | Shibata | 451/5 |

FOREIGN PATENT DOCUMENTS

| | | |
|---|---|---|
| EP | 0 995 546 A1 | 4/2000 |
| JP | 54-11032 | 5/1979 |
| JP | 57-201160 | 12/1982 |
| JP | 08-155806 | 6/1996 |
| JP | 08-155945 | 6/1996 |
| JP | 09-225798 | 9/1997 |
| JP | 09-290399 | 11/1997 |
| JP | 11-010427 | 1/1999 |
| JP | 2000-218487 | 8/2000 |
| JP | 2002-233938 | 8/2002 |
| JP | 2002-370146 | 12/2002 |

* cited by examiner

*Primary Examiner*—M. Rachuba
(74) *Attorney, Agent, or Firm*—Chapman and Cutler LLP

(57) ABSTRACT

A lens grinding processing apparatus of the present invention has lens rotating shafts 23 and 24 for holding an eyeglass lens ML, a lens retaining members (300, 320) fixed respectively to opposed end sections of the lens rotating shafts 23 and 24 capable of slanting adjustably, a drilling device (drilling processing device 200) for drilling a hole for a point frame into the slanted eyeglass lens ML, and a grinding stone (grinding stone 35, chamfering stones 224, 225) for grinding and processing a circumferential part of the eyeglass lens ML.

17 Claims, 27 Drawing Sheets

Front attachment fixed type

Rear attachment fixed type

Combined attachment fixed type

FIG.35A
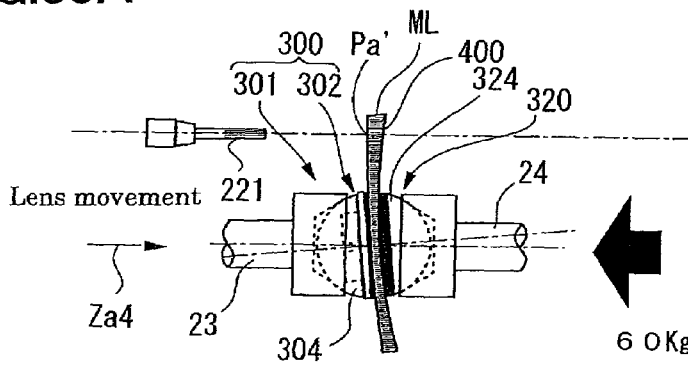
FIG.35B
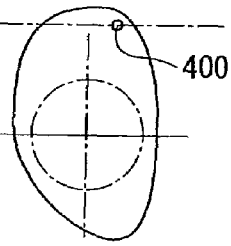
FIG.36A
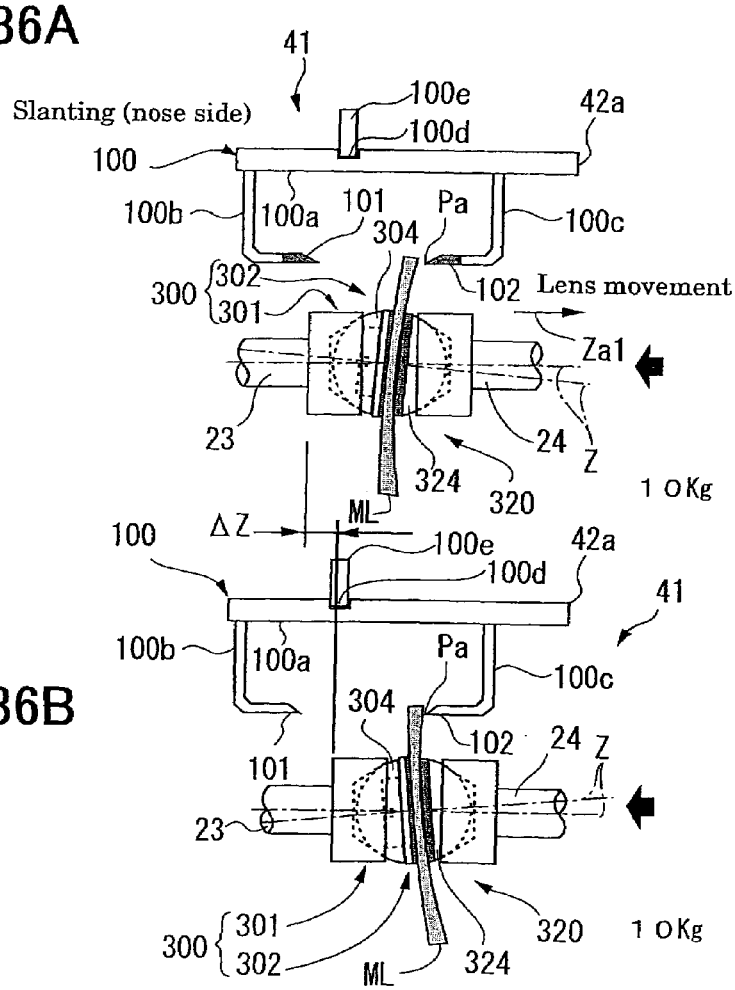
FIG.36C
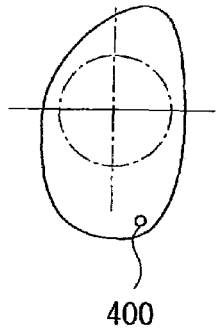
FIG.36B FIG.37
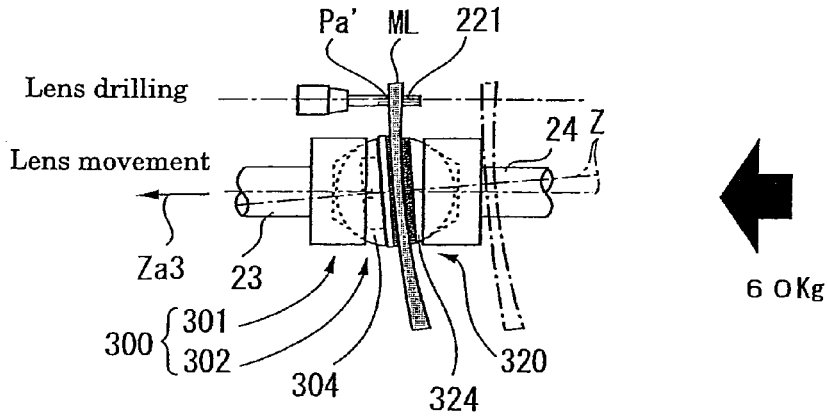
FIG.38A
FIG.38B
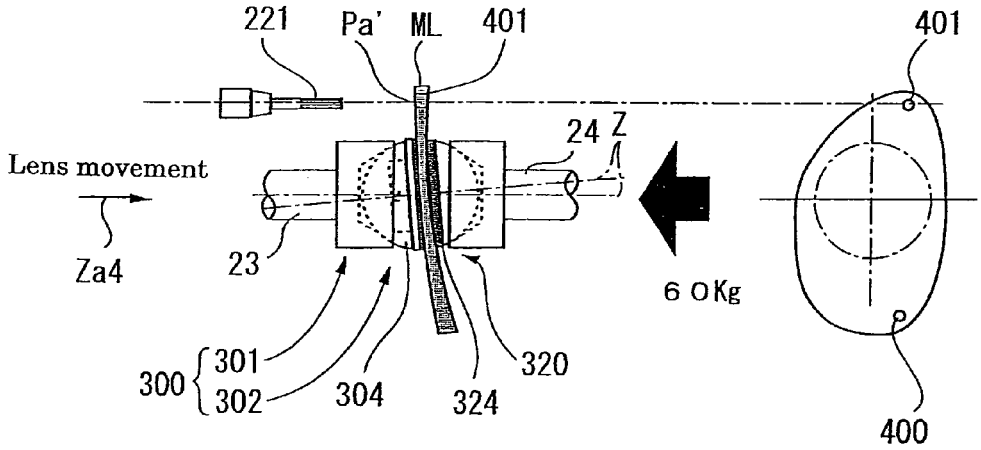

LENS GRINDING PROCESSING APPARATUS

BACKGROUND OF THE INVENTION

1. Field of the Invention

The present invention relates to a drilling processing apparatus for a rimless lens and a lens grinding processing apparatus to grind and process an edge of a lens for a point frame (hereinafter, abbreviated as rimless lens) and to drill a hole for fixing the point frame.

2. Description of the Prior Art

Conventionally, for example, there has been well known a lens grinding processing apparatus (see Japanese Patent Laid Open Nos. H8-155945 and 2000-218487 or the like) which automatically drills a hole to fix a frame for a point frame and grinds and processes an edge of a lens for the point frame (rimless lens), or a drilling processing apparatus for the rimless lens for drilling a hole for fixing the point frame (see Japanese Patent Laid Open Nos. H8-155806, H9-290399 and H11-10427).

In these cases, since a size of an attachment for fixing the point frame to the rimless lens is not constant, a size of a diameter of a hole drilled into the rimless lens has to be changed as well.

Also, relating to a lens holding member which contacts with a refractive surface of an eyeglass lens by pressure, there have been well known a lens grinding processing apparatus utilizing an universal joint (see Japanese Patent Publication No. S54-11032, Japanese Patent Laid Open Nos. S57-201160, H9-225798 and 2002-370146, U.S. Pat. No. 6,231,433, EP Laid Open No. 995546A1 or the like).

However, in the conventional arts as above mentioned, they are difficult to retain a main shaft of a tool such as a drill for a drilling in substantially perpendicular to the refractive surface of the rimless lens by only a movement of the tool, and they are likely to occur a grow in size of a device if attempting to provide the main shaft of the tool so as to be in substantially perpendicular to the refractive surface of the rimless lens.

In addition, when the refractive surface of the rimless lens is provided so as to be in substantially perpendicular to the main shaft of the tool by merely inclining a lens rotating shaft itself which holds the rimless lens, the device cannot help being complicated and large scaled in size.

Furthermore, according to the conventional arts, because the hole for fixing the frame cannot be drilled in substantially perpendicular to the refractive surface of the rimless lens, the attachment for fixing cannot be attached in fine appearance, as a result, the point frame which an eyeglasses wearer desires cannot be attained.

Also, in the conventional lens grinding processing apparatus utilizing the universal joint as stated above, because it is structured that a lens absorption member is fixed at one part of an opposed end section of a pair of lens rotating shafts and a lens retainer utilizing the universal joint is fixed at the other part of the opposed end section of the pair of lens rotating shafts so that the lens retainer is attached along the refractive surface of the eyeglass lens fixed to the lens absorption member, a slanting and adjusting of the eyeglass lens cannot be carried out when the eyeglass lens is held by the lens absorption member and the lens retainer.

As stated, since the slanting and adjusting of the eyeglass lens cannot be carried out, it was extremely difficult to fine adjust the curved refractive surface of the eyeglass lens in perpendicular to the main shaft of the tool.

SUMMERY OF THE INVENTION

Therefore, to solve the above mentioned problems, an object of the present invention is to provide a lens grinding processing apparatus which has a structure to have a drilling part of a refractive surface of an eyeglass lens so as to be in substantially perpendicular to a main shaft of a drilling device such as a drill for a drilling or the like by a simple structure.

To accomplish the above mentioned object, a lens grinding processing apparatus of the present invention has an apparatus main body, a pair of lens rotating shafts rotatably provided in the apparatus main body capable of relatively approaching and separating adjustably on a same axis for holding an eyeglass lens, a shaft rotating driving device for rotating and driving the pair of lens rotating shafts, lens retaining members fixed to opposed end sections of the pair of lens rotating shafts respectively capable of slanting adjustably for slant-ably holding the eyeglass lens between the pair of lens rotating shafts, a drilling device for drilling a hole for a point frame into the eyeglass lens held between the lens retaining members, a grinding stone rotatably provided capable of relatively approaching and separating to the lens rotating shafts, a shaft-to-shaft distance variable device for changing a shaft-to-shaft distance between the lens rotating shafts and the grinding stone by relatively approaching and separating the lens rotating shafts and the grinding stone, and an arithmetic control circuit for adjusting the shaft-to-shaft distance between the lens rotating shafts and the grinding stone by controlling the shaft rotating driving device and the shaft-to-shaft distance variable device in motion based on lens shape information ($\theta i$, $\rho i$).

According to this structure, the hole for fixing a frame can be drilled into the refractive surface of the eyeglass lens in substantially perpendicular to the main shaft of the drilling device such as the drill for the drilling or the like, as a result, an attachment for fixing can be attached in fine appearance.

Also, each of the lens retaining members can be provided with a spheroid joint or a spheroid connection for slant-ably retaining the eyeglass lens. Furthermore, the spheroid joint or the spheroid connection can be provided with a movable portion which enables the eyeglass lens to be slanted and adjusted in a condition when the lens retaining members hold the eyeglass lens with a clamping force in a setting range smaller than a predetermined value, and maintains the eyeglass lens in a slanted state by being fixed by a friction in a condition when the lens retaining members hold the eyeglass lens with the clamping force of over the predetermined value.

Also, one of the pair of lens rotating shafts can be provided rotatably and incapable of moving in an axis direction, and the other of the pair of lens rotating shafts can be provided rotatably and capable of moving in the axis direction, and aforementioned the other of the lens rotating shafts can be provided capable of moving and controlled in the axis direction by a shaft advancing and retracting drive device. Furthermore, the arithmetic control circuit is provided to control aforementioned the other of the lens rotating shafts so as to be advanced and retracted in the axis direction by controlling the shaft advancing and retracting drive device in motion, so that the apparatus can be provided capable of adjusting the clamping force by the lens retaining members to the eyeglass lens.

Moreover, the apparatus main body can be provided with a lens shape measuring device for measuring a lens thickness which is along a lens shape of the eyeglass lens based on the lens shape information ($\theta i$, $\rho i$), and the arithmetic control circuit can slant the eyeglass lens held between the lens retaining members by controlling the lens shape measuring device in motion.

Also, the arithmetic control circuit can carry out a control so that the hole for fixing the point frame is drilled into the slanted eyeglass lens by the drilling device by calculating an angle of gradient of a refractive surface of the eyeglass lens from a result of measurement by the lens shape measuring device, and slanting the eyeglass lens to the lens rotating shafts by using the lens shape measuring device so as to set a drilling part of the refractive surface of the eyeglass lens to be in a certain angel to the drilling device based on the angle of gradient.

Also, after slanting the eyeglass lens to the lens rotating shafts by using the lens shape measuring device with the condition of holding the eyeglass lens between the lens retaining members with the clamping force in the setting range smaller than the predetermined value by controlling the shaft advancing and retracting drive device in motion, the arithmetic control circuit can carry out the control so that the hole for fixing the point frame is drilled into the slanted eyeglass lens by the drilling device by holding the eyeglass lens between the lens retaining members with the clamping force of over the predetermined value by controlling the shaft advancing and retracting drive device in motion.

Also, the drilling device can be provided with an arm retained by the apparatus main body capable of approaching and separating to the lens rotating shafts, an arm driving device for driving the arm to be approached and separated to the lens rotating shafts, a drilling tool which extends in a same direction or in substantially a same direction to extending directions of the lens rotating shafts and is retained by the arm capable of rotating and driving, a tool rotating driving device for rotating and driving the drilling tool, and a relative moving device for relatively approaching and separating the drilling tool and the eyeglass lens retained between the lens retaining members.

Also, the relative moving device can be as a tool retaining device which retains the drilling tool to the arm capable of advancing and retracting in an axis direction.

Also, the relative moving device can be provided with a carriage which the pair of lens rotating shafts are fixed and is capable of moving and driving in the extending directions of the lens rotating shafts, and an axis direction driving device which moves and drives the carriage in the extending directions of the lens rotating shafts.

Also, the carriage may be provided capable of elevating and lowering by the shaft-to-shaft distance variable device.

Furthermore, such structure can be employed that a chamfering stone or a grooving cutter is retained rotatably by the arm, and the chamfering stone or the grooving cutter is provided capable of rotating and driving by the tool rotating driving device.

BRIEF DESCRIPTION OF THE ATTACHED DRAWINGS

Figure 18A:
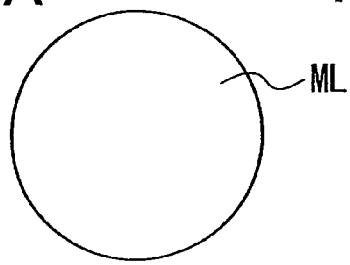
Figure 18A:
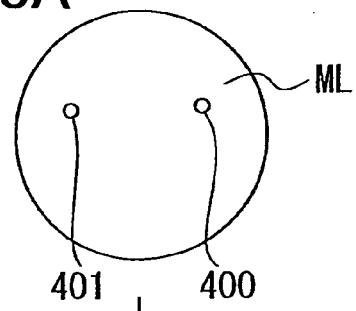
Figure 18B:
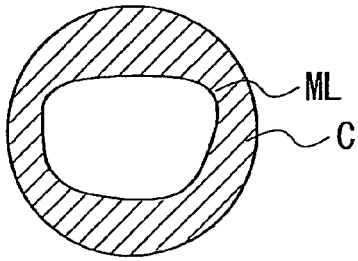
Figure 18B:
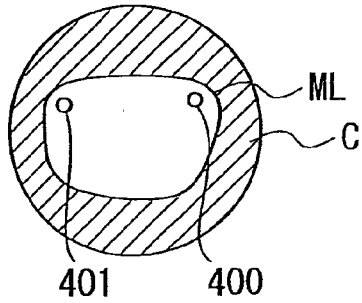
Figure 18C:
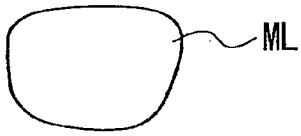
Figure 18C:
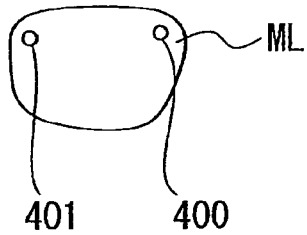
Figure 18D:
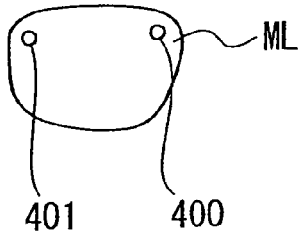

FIG. 18A is a view showing a circular eyeglass lens which is before processing; FIG. 18B is an explanatory view for grinding the eyeglass lens in FIG. 18A; FIG. 18C is an explanatory view of the eyeglass lens which a grinding part in FIG. 18B is grinded; FIG. 18D is an explanatory view of positions which fixing holes for fixing a point frame are to be drilled into the eyeglass lens in FIG. 18C; FIG. 18A' is an explanatory view showing that the fixing hole for fixing the point frame is drilled into a circular eyeglass lens which is before processing; FIG. 18B' is an explanatory view for grinding the eyeglass lens in FIG. 18A' and FIG. 18C' is an explanatory view of the eyeglass lens which a grinding part in FIG. 18B' is grinded.

Figure 19:
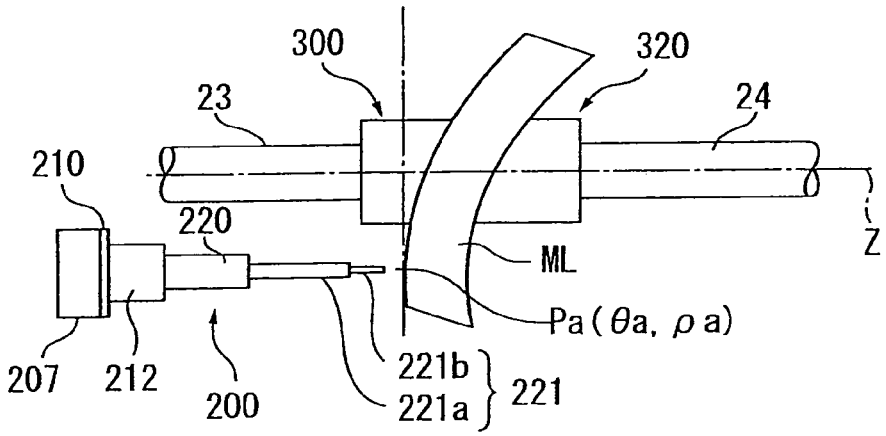

FIG. 19 is an explanatory view of a drilling process by the lens grinding processing apparatus in FIGS. 1–17.

Figure 20:
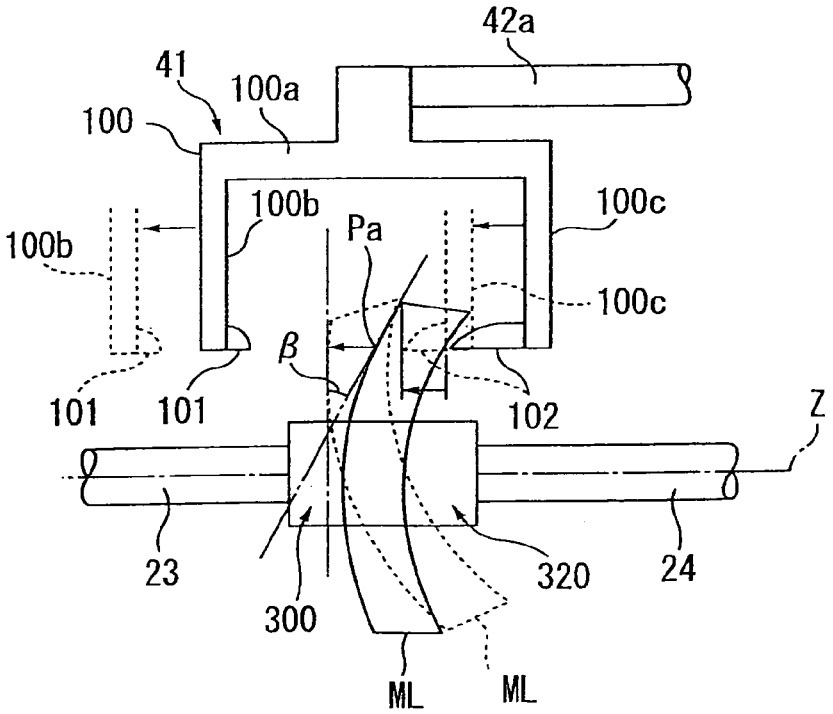

FIG. 20 is an explanatory view for slanting and adjusting the eyeglass lens before carrying out the drilling process by the lens grinding processing apparatus in FIGS. 1–17.

Figure 21:
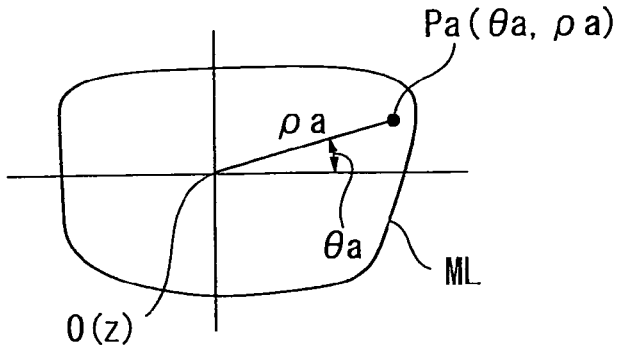

FIG. 21 is an explanatory view showing a position of the drilling process of the eyeglass lens for carrying out the slanting and adjusting in FIG. 20.

Figure 22:
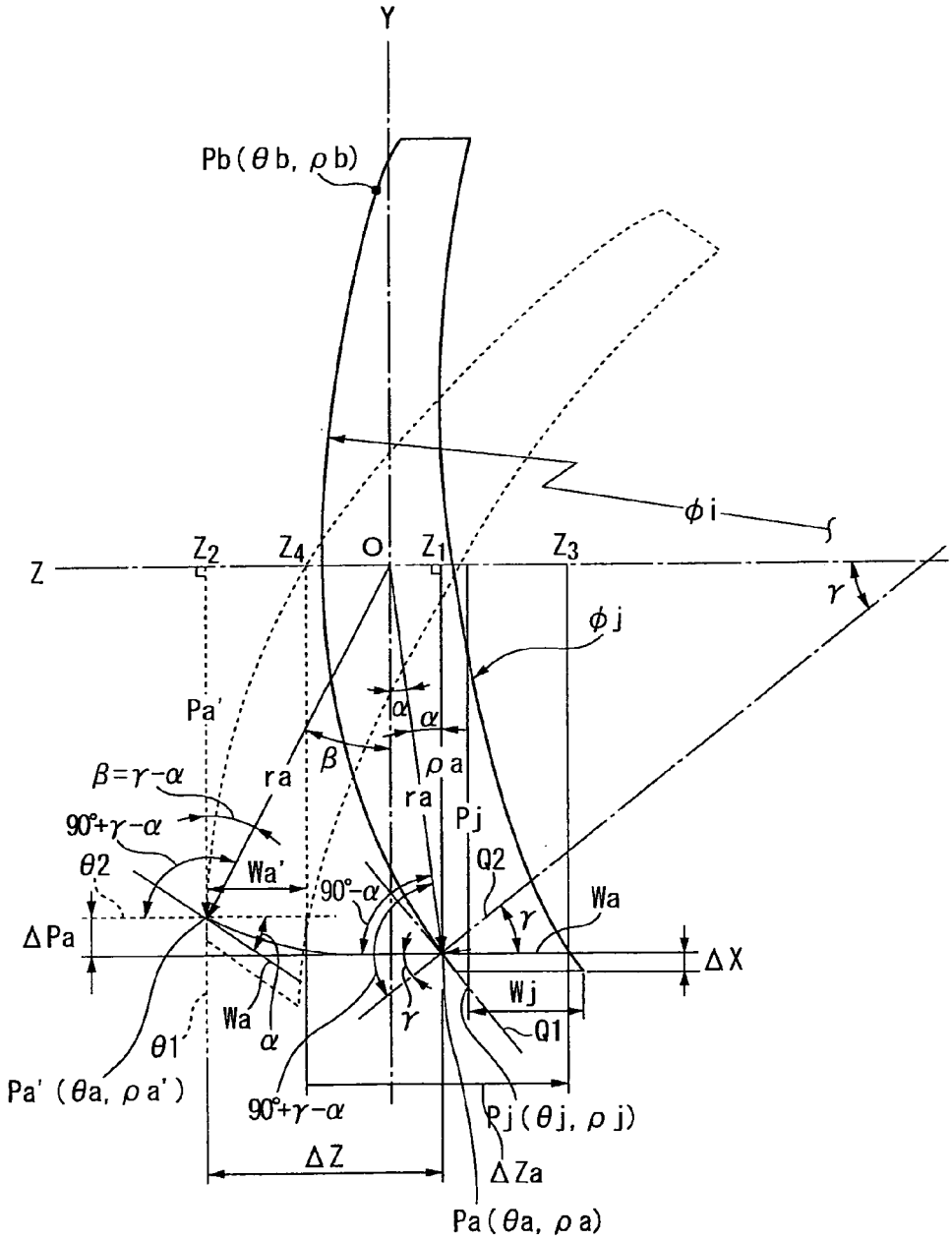

FIG. 22 is an explanatory view for obtaining a data for carrying out the slanting and adjusting of the eyeglass lens in FIG. 20.

Figure 23A:
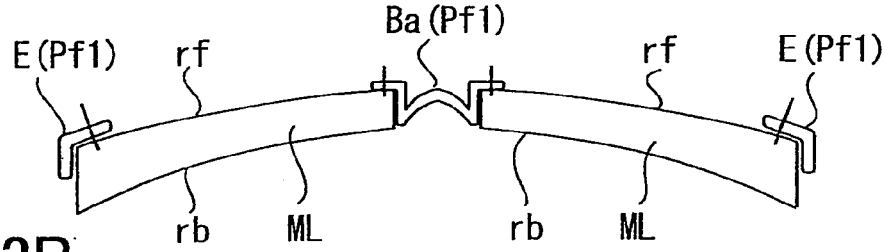
Figure 23B:
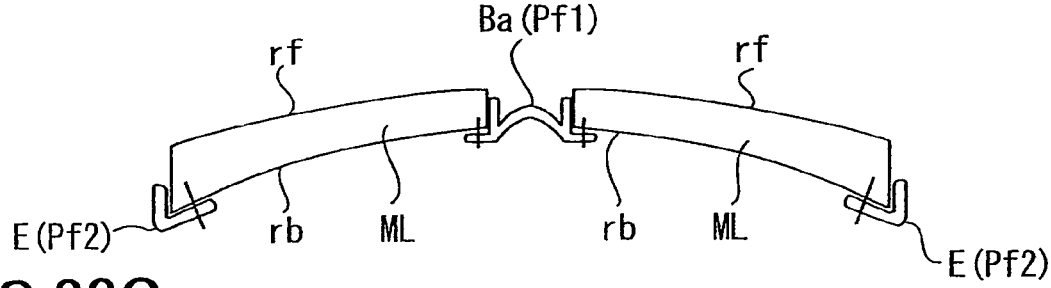
Figure 23C:
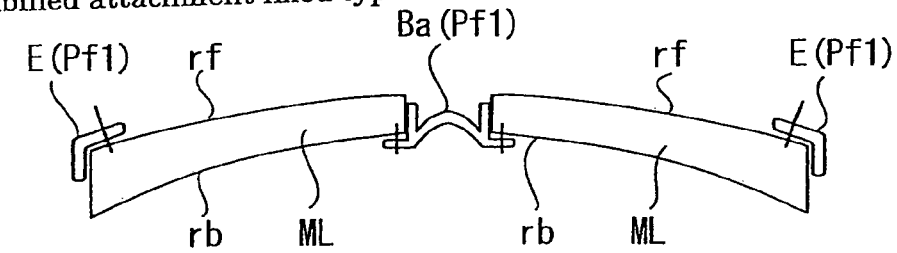

FIGS. 23A, 23B and 23C are views of the point frames fixed to the eyeglasses lenses; FIG. 23A being an explanatory view of the point frame fixed to the eyeglass lens that is in a front attachment fixed type fixed to a front side-refractive surface of the eyeglass lens; FIG. 23B being an explanatory view of the point frame fixed to the eyeglass lens that is in a rear attachment fixed type fixed to a rear side-refractive surface of the eyeglass lens; and FIG. 24C being an explanatory view of the point frame fixed to the eyeglass lens that is in a combined attachment fixed type fixed to the front side and the rear side of the refractive surface of the eyeglass lens.

Figure 24:
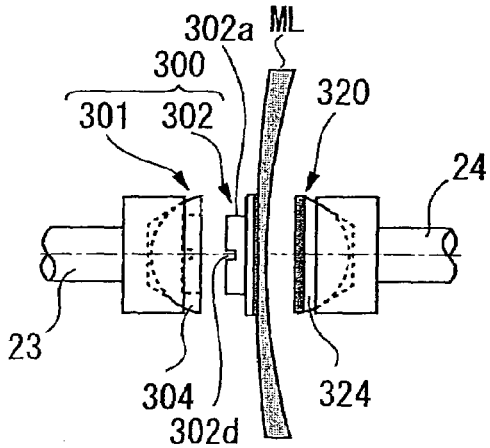

FIG. 24 is an operational explanatory view for fixing the eyeglass lens to the lens rotating shaft.

Figure 25:
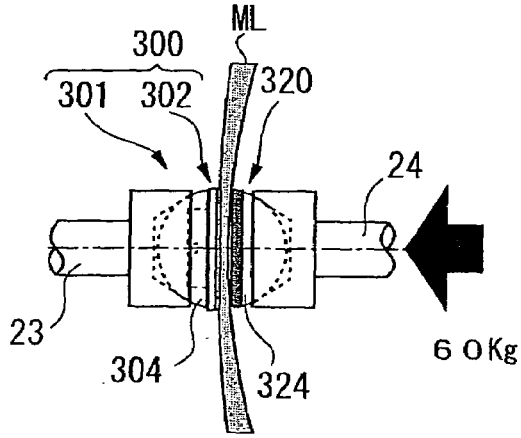

FIG. 25 is an operational explanatory view showing at the time when the eyeglass lens is clamped to the lens rotating shaft.

Figure 26:
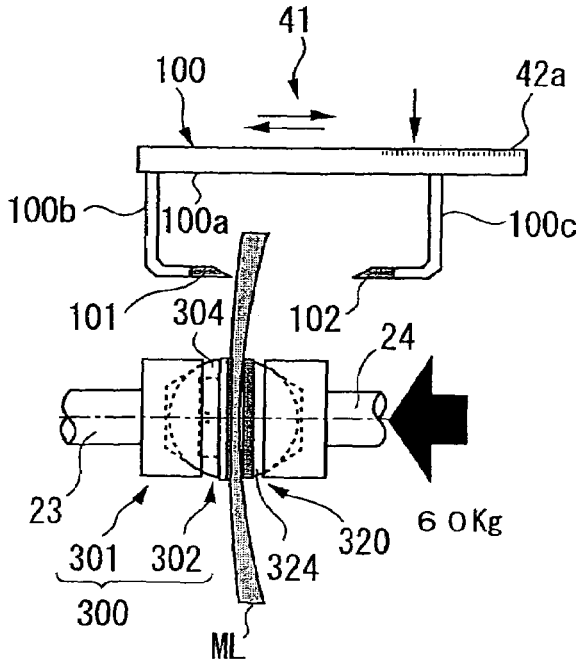

FIG. 26 is an operational explanatory view for measuring the eyeglass lens.

Figure 27:
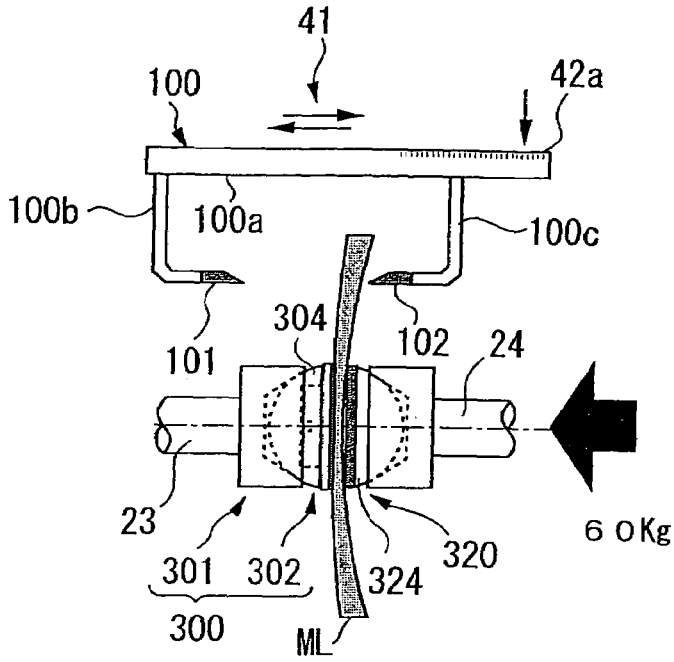

FIG. 27 is an operational explanatory view for measuring the eyeglass lens.

Figure 28:
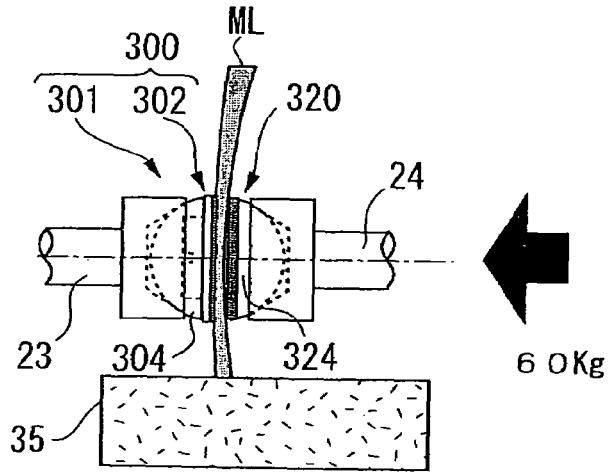

FIG. 28 is an operational explanatory view for grinding the eyeglass lens.

Figure 29:
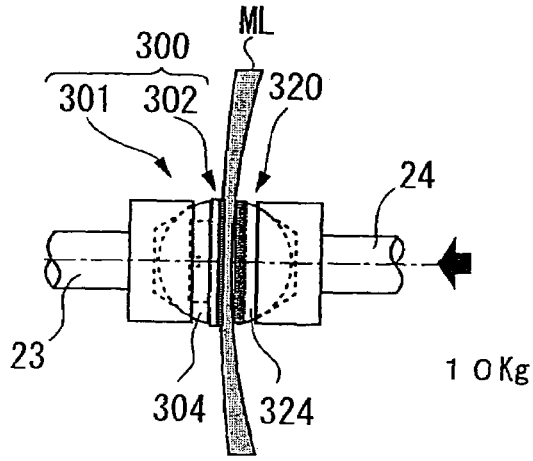

FIG. 29 is an operational explanatory view for a provisional clamping of the eyeglass lens.

Figure 30A:
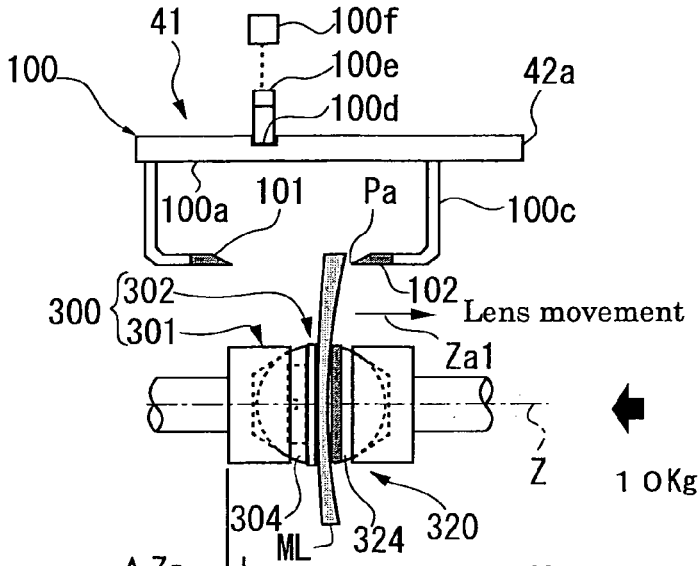

FIG. 30 is an operational explanatory view for slanting and adjusting the eyeglass lens.

Figure 31:
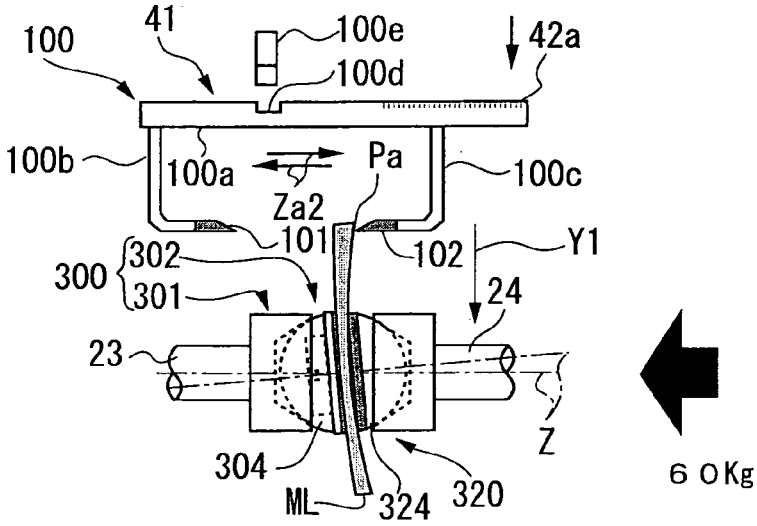

FIG. 31 is an operational explanatory view for measuring the eyeglass lens after the slanting and adjusting of the eyeglass lens are carried out.

Figure 32A:
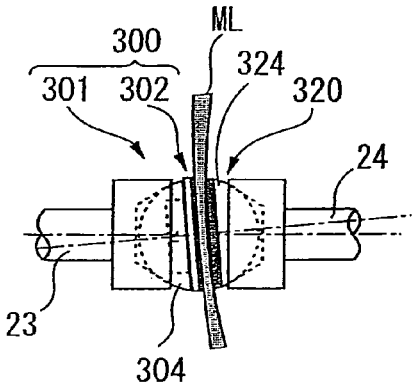
Figure 32B:
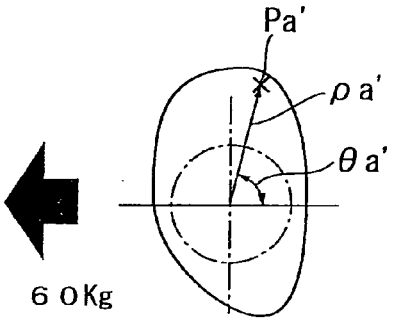

FIG. 32A is an explanatory view showing a condition of the eyeglass lens after the slanting and adjusting are carried out, and FIG. 32B is a right side surface view of FIG. 32A.

Figure 33:
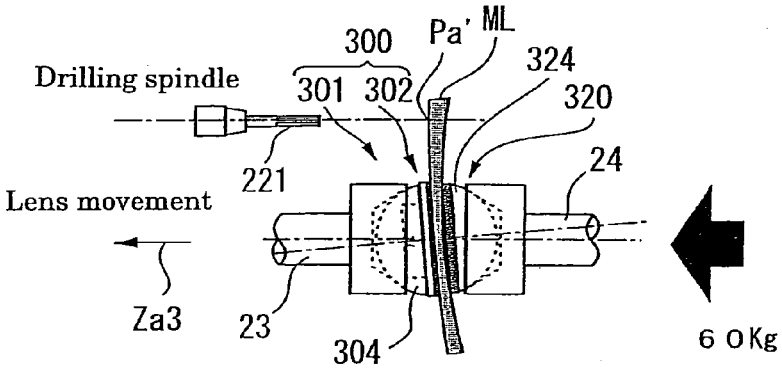

FIG. 33 is an operational explanatory view for the drilling process of the eyeglass lens.

Figure 34:
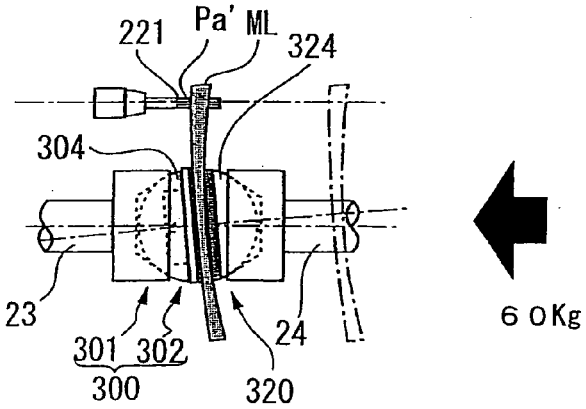

FIG. 34 is an operational explanatory view for the drilling process of the eyeglass lens.

FIG. 35A is an explanatory view showing a condition after the drilling process of the eyeglass lens is carried out, and FIG. 35B is a right side surface view of FIG. 35A.

FIGS. 36A and 36B are operational explanatory views showing other examples for carrying out the slanting and adjusting of the eyeglass lens, and FIG. 36C is a right side surface view of FIG. 36A.

FIG. 37 is an operational explanatory view showing other example for the drilling process of the eyeglass lens.

FIG. 38A is an explanatory view showing other example of a condition of the eyeglass lens after the drilling process is carried out, and FIG. 38B is a right side surface view of FIG. 38A.

DETAILED DESCRIPTION OF THE PREFERRED EMBODIMENT

Hereinafter, an embodiment of the present invention will be described with reference to the accompanying drawings.

[Constitution]

Figure 1:
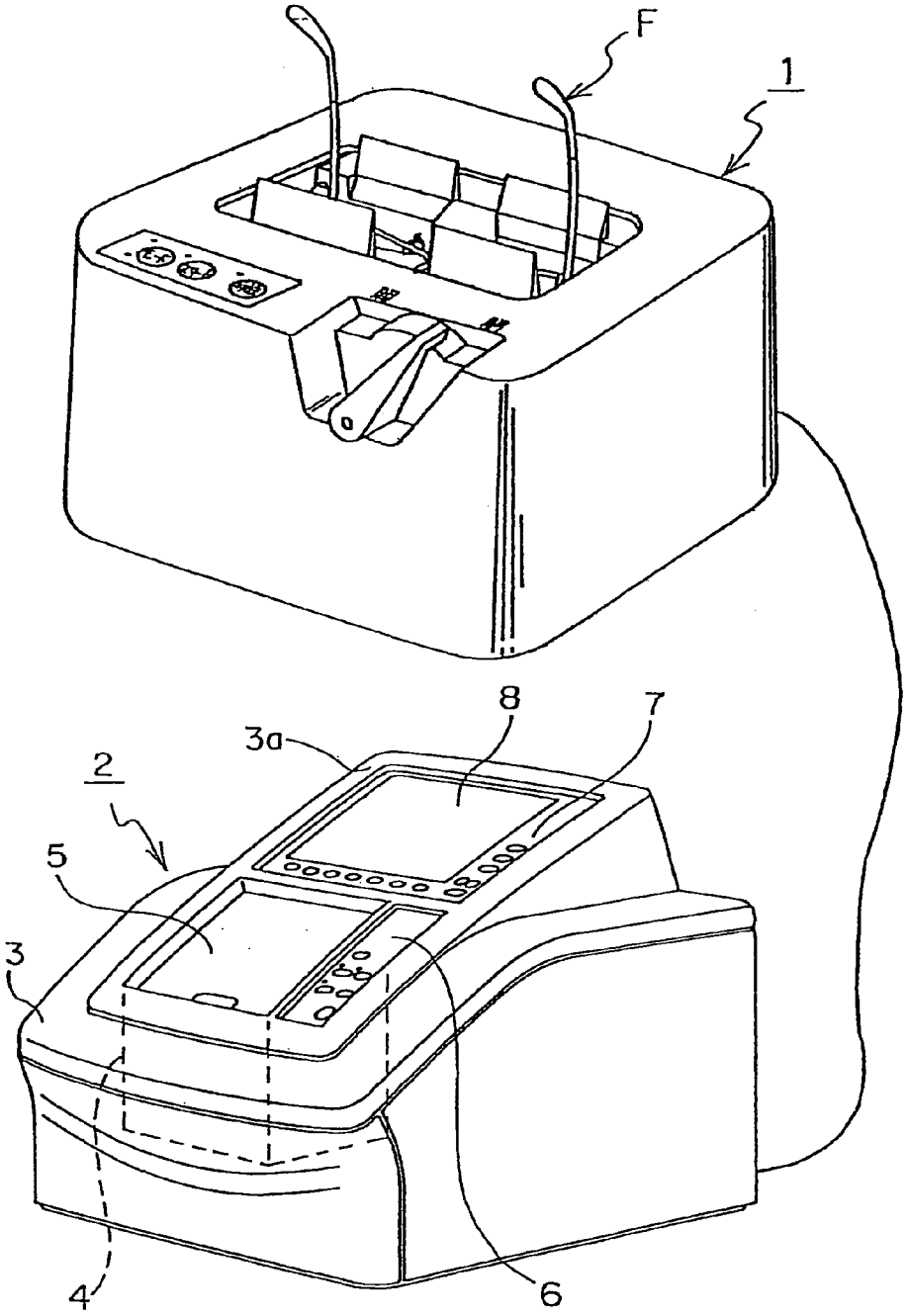
FIG. 1 is an explanatory view showing a relation between a lens grinding processing apparatus according to the present invention and a frame shape measuring device.

In FIG. 1, reference numeral 1 denotes a frame shape measuring device (lens shape data measuring device) which reads out lens shape information (θi, ρi) as a lens shape data and a data on position of a hole for fixing a point frame from a lens frame shape of an eyeglass frame F, a template thereof, or a lens model or the like. Reference numeral 2 denotes a lens grinding processing apparatus (lens grinder) which grinds and processes a natural lens or the like to make an eyeglass lens ML (including a rimless lens) based on the lens shape data of the eyeglass frame inputted by a transmission or the like from the frame shape measuring device. By the way, since a publicly known frame shape measuring device can be used as the frame shape measuring device 1, explanation of its detailed structure or a method for measuring data or the like will be omitted.

Also, the data on position of the hole for fixing the point frame can be obtained with a measuring method of either a non-contact type or a contact type by an area sensor or a member for measuring the position of the fixing hole (aperture) or the like described in Japanese Patent Laid Open No. H8-15594 or No. 2001-166269.

The measured data on position of the hole for fixing the point frame is, as described later, stored in a data memory 82 with the lens shape information (θi, ρi) of the lens shape data of the lens model (lens for a demonstration which the hole for fixing the point frame is provided).

<Lens Grinding Processing Apparatus 2>

The lens grinding processing apparatus 2 has an apparatus main body (main body case) 3. At an upper part of the apparatus main body 3, as shown in FIG. 1, an upper surface (inclining surface) 3*a* is provided which inclines to an upper side as going from a near side to a back side, and a processing chamber 4 is formed which opens at a front part side (lower part side) of the upper surface 3*a*.

The processing chamber 4 is provided to be opened and closed by a cover 5 fixed to the apparatus main body 3 capable of sliding and controlling upwardly and downwardly on a slant. The cover 5 is composed of one colorless transparent or colored transparent (for example, gray colored transparent or the like) panel made of a glass or a resin and is slid forward and backward in the apparatus main body 3.

In addition, at the upper surface 3*a* of the apparatus main body 3, an operation panel 6 which is located at a side part of the processing chamber 4 and an operation panel 7 which is in U-shape located at a back part side from an upper part opening of the processing chamber 4 are provided. Also, at the upper surface 3*a*, a liquid crystal display device (display device) 8 is provided as displaying means for displaying operational conditions of the operation panel 6 and the operation panel 7 located at a back part from a lower part side of the operation panel 7 which is in L-shape.

(Operation Panel 6)

Figure 2A:
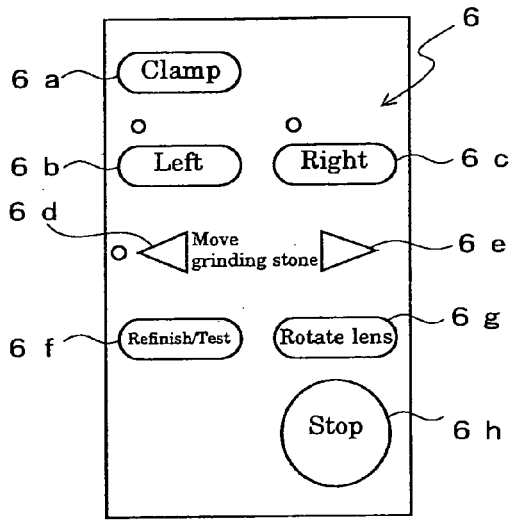
FIG. 2A is an explanatory view of an operation panel located at a lower side of the lens grinding processing apparatus and FIG. 2B is an explanatory view showing an operation panel located at an upper side of the lens grinding processing apparatus and is also showing an example of a representation of a liquid crystal display device.

As shown in FIG. 2A, the operation panel 6 is provided with a "clamp" switch 6*a* for clamping the eyeglass lens with a pair of lens rotating shafts (lens retaining shaft) 23 and 24 which are described later; a "left" switch 6*b* and a "right" switch 6*c* for specifying the processing of the eyeglass lens for a right eye or a left eye or for carrying out a switching over of a displaying thereof; "move grinding stone" switches 6*d* and 6*e* for moving the grinding stone in right and left directions; a "refinish/test" switch 6*f* for refinishing in a case that a finishing process of the eyeglass lens is insufficient or a tentative grinding in a case that the grinding is tentatively carried out; a "rotate lens" switch 6*g* for a lens rotating mode; and a "stop" switch 6*h* for a stop mode. This is for reducing a burden of work of an operator by arranging such switches necessary for the actual lens processing near the processing chamber 4.

(Operation Panel 7)

Figure 2B:
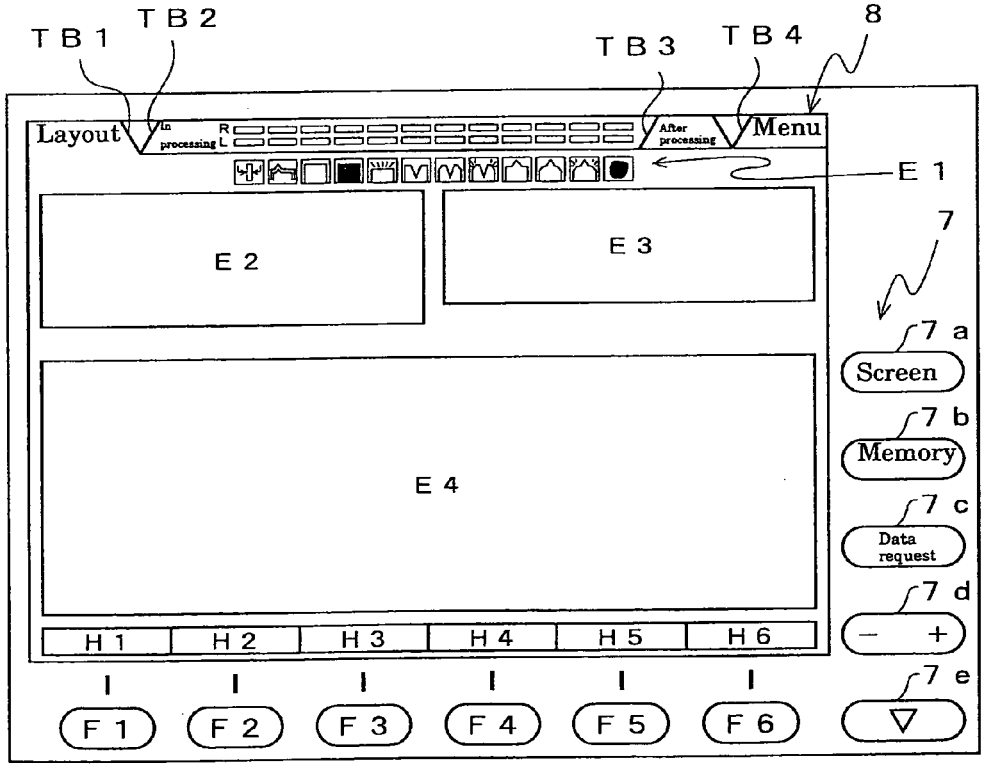

The operation panel 7 has, as shown in FIG. 2B, a "screen" switch 7*a* for switching over a displaying condition of the liquid crystal display device 8; a "memory" switch 7*b* for memorizing settings or the like relating to the processing displayed on the liquid crystal display device 8; a "data request" switch 7*c* for loading the lens shape information (θi, ρi); a seesaw type "−+" switch 7*d* which is used in a numerical correction or the like ("−" and "+" switches may be provided separately); and a "∇" switch 7*e* which is used for a cursor pointer, which are arranged at a side part of the liquid crystal display device 8. In addition, function keys F1 to F6 are arranged at a lower part of the liquid crystal display device 8.

The function keys F1 to F6 are used when carrying out the setting regarding the process of the eyeglass lens ML, as well as are used in a response or a selection for a message displayed on the liquid crystal display device 8 during the grinding process.

As for the function keys F1 to F6, in the setting with regard to the processing (layout screen), the function key F1 is used for inputting a kind of lens; the function key F2 for inputting a processing course; the function key F3 for inputting a lens material; the function key F4 for inputting a kind of frame; the function key F5 for inputting a kind of chamfering process; and the function key F6 for inputting a mirror finishing process.

For the kinds of lens inputted by the function key F1, there are "mono-focal", "ophthalmic prescription", "progressive", "bi-focal", "cataract" and "tsubokuri" or the like. By the way, the "cataract" generally means a plus lens having a high diopter, and the "taubokuri" means a minus lens having a high diopter in the eyeglass world.

As the processing course inputted by the function key F2, there are "auto", "test", "monitor", and "frame change" or the like.

As the materials of the lens to be processed which are inputted by the function key F3, there are "plastic", "high index", "glass", "polycarbonate" and "acrylic" or the like.

As the kinds of eyeglass frame F inputted by the function key F4, there are "metal", "cell", "optyl", "flat", "grooving (thin)", "grooving (middle)", "grooving (thick)", "point: front attachment", "point: rear attachment" and "point: combined attachment" or the like.

By the way, each "grooving" indicates a V-groove that is a kind of the V-groove processing. Also, when the "point: front attachment" is inputted, a drilling process is applied to the eyeglass lens from a front side of a refractive surface side, and when the "point: rear attachment" is inputted, the drilling process is applied to the eyeglass lens from a rear side of the refractive surface side. In addition, when it is the "point: combined attachment", the drilling process is applied to the eyeglass lens from the front side of the refractive surface side to one part of a nose pad side and an end piece side, and the drilling process is also applied to the eyeglass lens from the rear side of the refractive surface side to the other part of the nose pad side and the end piece side so as to fix the point frame at the nose pad side and the end piece side of the eyeglass lens. As just described, direction that the drilling process is applied to the eyeglass lens varies depending on the kinds of point frame.

The "front attachment" stands for a point frame Pf1 which is in a front attachment fixed type fixed to a front side refractive surface rf of the eyeglass lens ML as shown in FIG. 23A, and the "rear attachment" stands for a point frame Pf2 which is in a rear attachment fixed type fixed to a rear side refractive surface rb of the eyeglass lens as shown in FIG. 23B. The point frames Pf1 and Pf2 have a bridge attachment Ba fixed to the nose pad side of the eyeglass lens ML and an attachment of the end piece side E for rotatably fixing a temple (not shown) of the end piece side.

In addition, for the "combined attachment", there are "a case that the point frame Pf1 which is in the rear attachment fixed type is fixed to the nose pad side and the point frame Pf2 which is in the front attachment fixed type is fixed to the end piece side" as shown in FIG. 23C, and "a case that the point frame which is in the front attachment fixed type is fixed to the nose pad side and the point frame which is in the rear attachment fixed type is fixed to the end piece side" as contrary to FIG. 23C.

As the kinds of chamfering process inputted by the function key F5, there are "none", "small", "middle", "large" and "special" or the like.

As the kinds of mirror finishing process inputted by the function key F6, there are "non-perform", "perform" and "mirror finishing of chamfer part" or the like.

Note that modes, types and an order of the above-described function keys F1 to F6 are not particularly limited. Moreover, for selection of tabs TB1 to TB4 which are described later, function keys for selecting "layout", "in processing", "after processing", "menu" and the like may be further provided, and the number of keys is not limited.

(Liquid Crystal Display Device 8)

In the liquid crystal display device 8, the display device is changed over by a "layout" tab TB1, an "in processing" tab TB2, an "after processing" tab TB3 and a "menu" tab TB4. The liquid crystal display device 8 has function display sections H1 to H6 which correspond to the function keys F1 to F6 at a lower part thereof. By the way, colors of the tabs TB1 to TB2 are independent from each other. In changing over the selection of the tabs TB1 to TB2, the color of the background of the display screen other than areas E1 to E4, which will be described later, is simultaneously changed to the same color as that of the selected tab.

For example, the "layout" tab TB1 and the entire display screen (background) attached with the tab TB1 are displayed in blue; the "in processing" tab TB2 and the entire display screen (background) attached with the tab TB2 in green; the "after processing" tab TB3 and the entire display screen (background) attached with the tab TB3 in red; and the "menu" tab TB4 and the entire display screen (background) attached with the tab TB4 in yellow.

In such a manner, since each of the tabs TB1 to TB4, which are classified for each operation depending on color, and the background of the display screen are displayed in the same color, the operator can easily recognize or confirm the current operation that is being performed.

In the function display sections H1 to H6, necessary objects are displayed accordingly. In a non-display state, images, numerical values, conditions or the like different from displays corresponding to the functions of the function keys F1 to F6 can be displayed. In addition, when each of the function keys F1 to F6 is being operated, display such as a mode display may be changed over for each click of the function key F1, for example, during the operation of the function key F1. For example, a list of modes corresponding to the function key F1 may be displayed (pop-up display) whereby the selecting operability can be improved. The list in the pop-up display may be shown with characters, diagrams, icons or the like.

While the "layout" tab TB1, the "in processing" tab TB2 or the "after processing" tab TB3 are being selected, the display screen is displayed to be sectioned into an icon display area E1, a message display area E2, a numerical value display area E3 and a state display area E4. While the "menu" tab TB4 is being selected, the display screen is displayed as one menu display area as a whole. By the way, while the "layout" tab TB1 is being selected, the "in processing" tab TB2 and the tab TB3 are not displayed, and the tab TB2 and the tab Tb3 may be displayed at the time when the layout setting is completed.

Since the layout setting by use of the above described liquid crystal display device 8 is similar to that in Japanese Patent Application Nos. 2000-287040 or 2000-290864, a detailed description will be omitted.

<Grinding Processing Section 10>

Figure 3A:
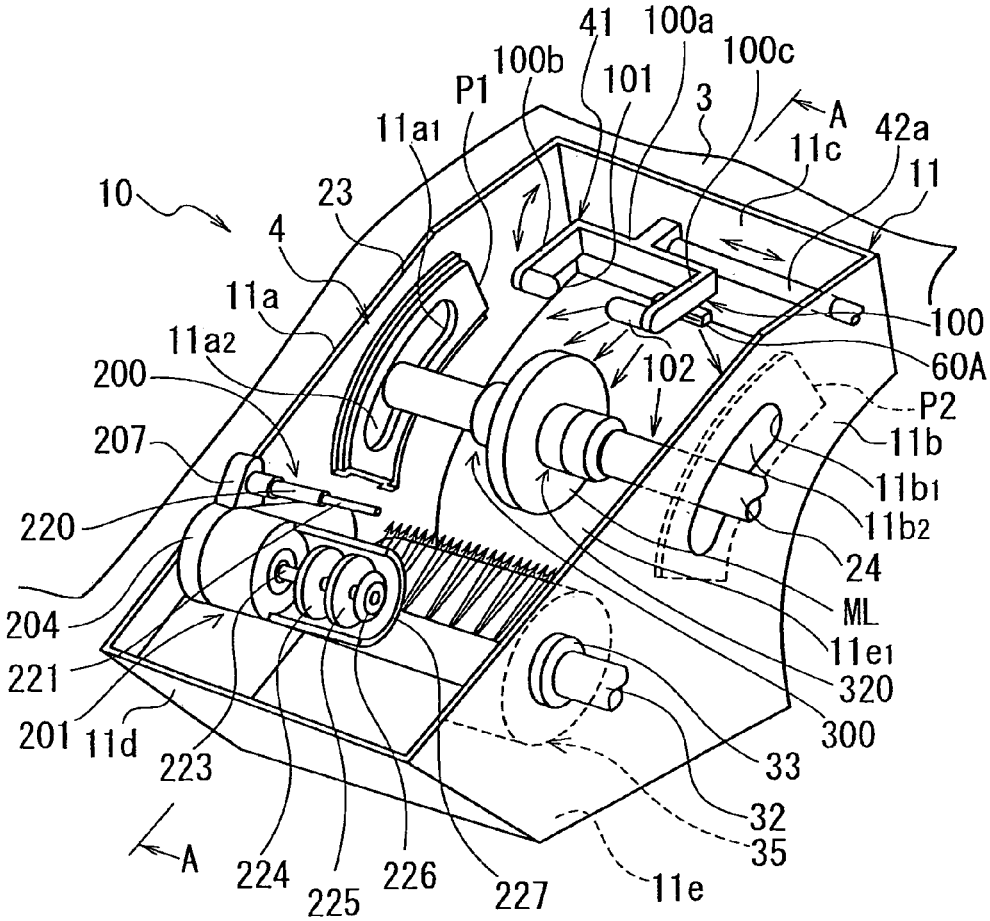
FIG. 3A is an explanatory view of a processing chamber of the lens grinding processing apparatus shown in FIG. 1
Figure 4:
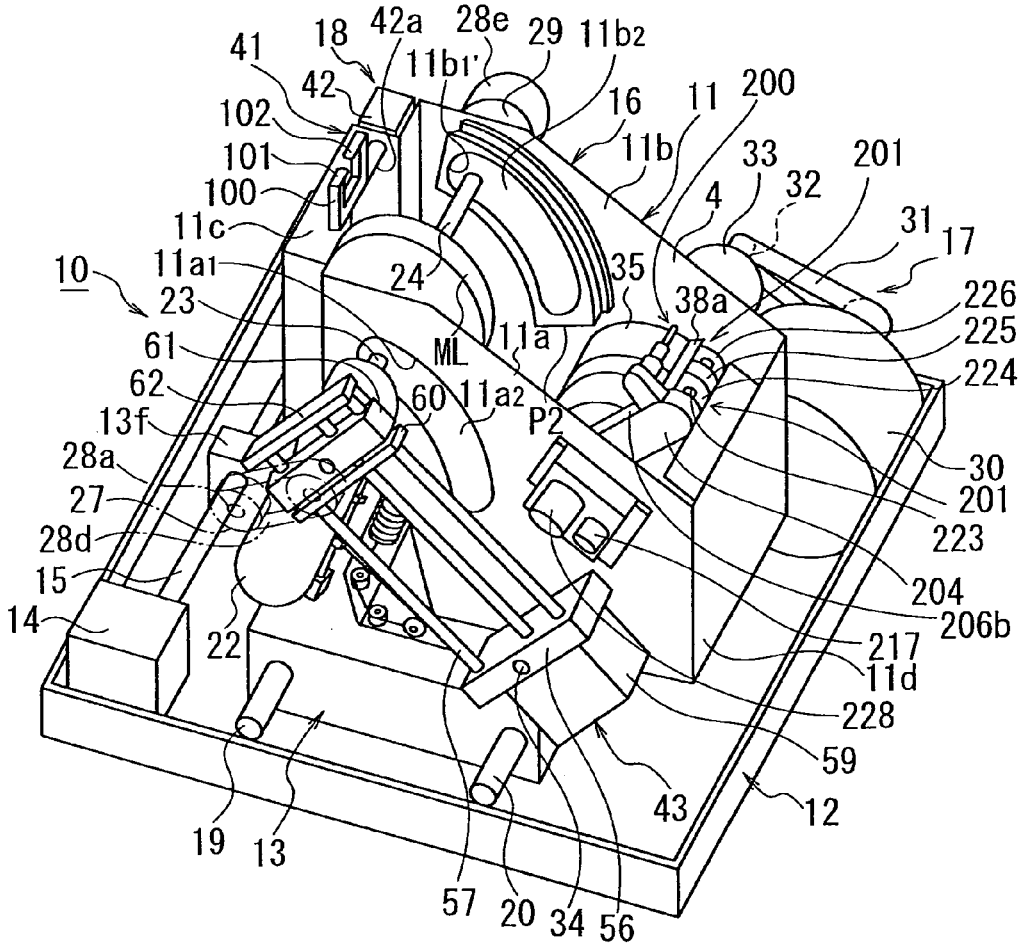
FIG. 4 is a perspective view showing a condition that the processing chamber shown in FIG. 3A is arranged on a base.

As shown in FIGS. 3A and 4, a grinding processing section 10 which has the processing chamber 4 as mentioned above is provided in the apparatus main body 3. The processing chamber 4 is formed within a peripheral wall 11 which is fixed in the grinding processing section 10.

The peripheral wall 11 has left and right side walls 11*a* and 11*b*, a rear wall 11*c*, a front wall 11*d* and a bottom wall 11*e* as shown in FIGS. 3A and 4. In addition, on the side walls 11*a* and 11*b*, arc-shaped guide slits 11*a*1 and 11*b*1 are formed respectively (see FIG. 3A). In addition, as shown in FIG. 3A, the bottom wall 11*e* has an arc-shaped bottom wall (slanted bottom wall) 11*e*1 extending downward in an arc shape from the rear wall 11*c* to a near side, and a lower bottom wall (not shown) extending from a front lower end of the arc-shaped bottom wall 11*e*1 to the front wall 11*d*. The lower bottom wall is provided with a drain pipe (not shown) in the vicinity of the arc-shaped bottom wall 11*e*1 and the drain pipe extends to a waste water tank (not shown) at a lower part.

Figure 5:
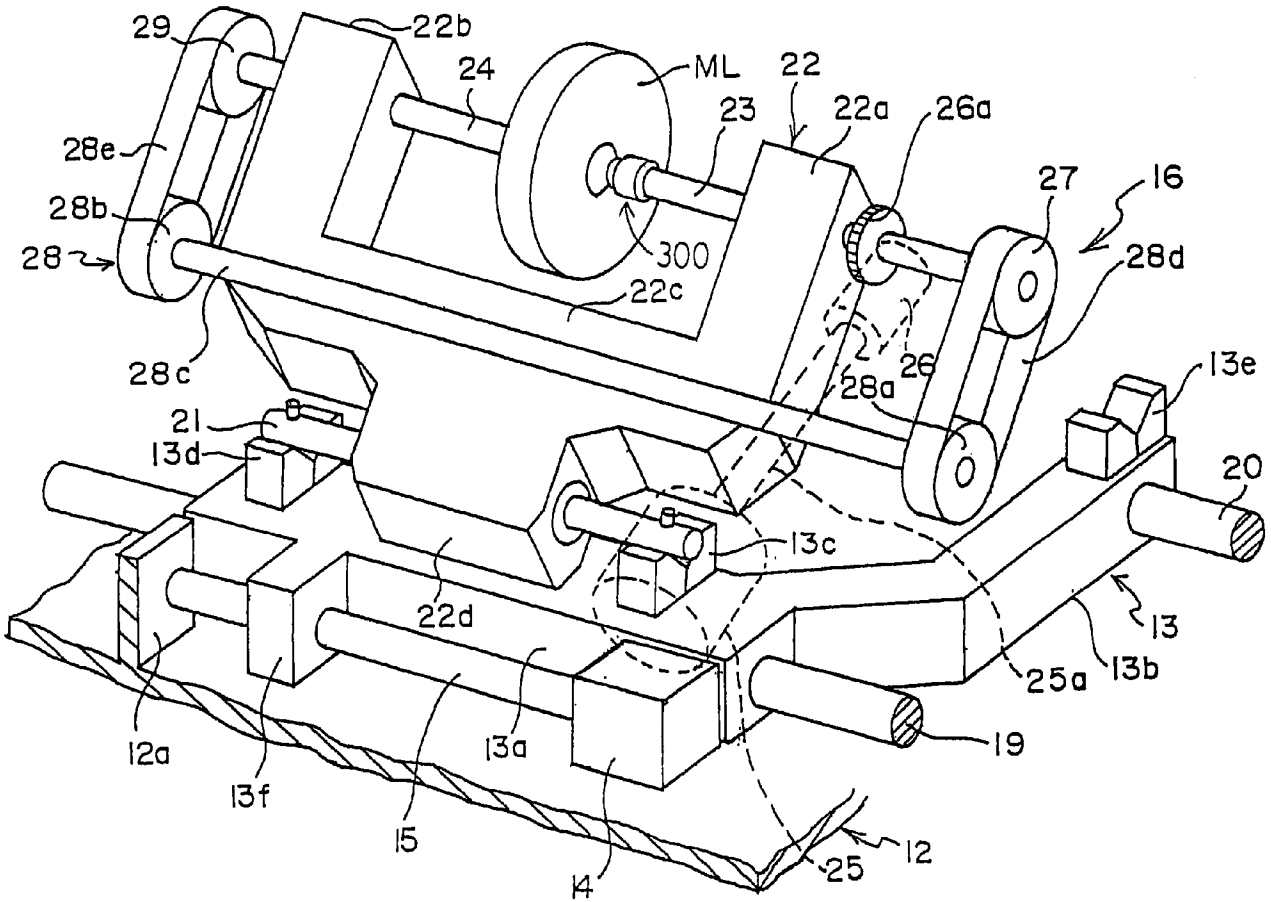
FIG. 5 is a perspective view to explain a carriage which sustains the lens rotating shaft shown in FIG. 4 and the base.

As shown in FIGS. 4 and 5, the grinding processing section 10 has a tray 12 fixed to the apparatus main body 3 and a base 13 disposed on the tray 12. Also, the grinding processing section 10 has a base drive motor 14 fixed to the tray 12, a support section 12*a* which is raised from the tray 12, and a screw shaft (feed screw) 15 which is interlocked with an output shaft (not shown) of the base drive motor 14 and which has a tip rotatably retained by the support section 12*a*. In addition, a pulse motor is used for the base drive motor 14.

The grinding processing section 10 further comprises a rotation drive system 16 for the eyeglass lens ML, grinding means 17 for the eyeglass lens ML and a lens thickness measuring system (lens thickness measuring means) 18 for the eyeglass lens ML.

(Base 13)

The base 13 is, as shown in FIG. 5, formed by a rear support section 18*a* extending along a rear edge of the tray 12 in transverse direction and a side support section 13*b* extending from a left end of the rear support section 13*a* to the front side so as to be formed in substantially V-shape. Shaft support sections 13*c* and 13*d*, which are in V-shaped blocks, are respectively fixed on right and left end parts of the rear support section 13*a*, and a shaft support section 13*e*, which is in a V-shaped block, is fixed on the side support section 13*b*.

Also, in the apparatus main body 3, a pair of parallel guide bars 19 and 20 extending in transverse direction are disposed in parallel on the front and rear sides.

The left and right ends of the parallel guide bars 19 and 20 are attached to the left and right parts in the apparatus main body 3. Furthermore, the side support section 13*b* of the base 13 is pivotally supported by the parallel guide bars 19 and 20 so as to advance and retract right and left in an axis direction of the guide bars 19 and 20.

Moreover, a guide section 13*f* is integrally formed on the base 13. A screw shaft (feed screw) 15 is screwed in the guide section 13*f*. The base drive motor 14 is operated to drive the screw shaft 15 rotatively, whereby the guide section 13*f* is advanced and retracted in the axis direction of the screw shaft 15, and then the base 13 is moved along with the guide section 13*f* integrally. At this time, the base 13 is guided by the pair of the parallel guide bars 19 and 20 to displace along the axes thereof.

(Carriage)

Also, both ends of a carriage swing shaft 21 extending in a transverse direction are disposed on V-grooves on the shaft support sections 13*c* and 13*d*. Referential numeral 22 denotes a carriage attached to the carriage swing shaft 21. The carriage 22 is composed of arm sections 22*a* and 22*b* for attachment of shafts, a connecting section 22*c* and a support projecting section 22*d* to be formed in a bifurcate shape. The arm sections 22*a* and 22*b* are positioned on the left and right sides with an interval therebetween and extended forward and rearward. The connecting section 22*c* is extended in a transverse direction and connects the rear ends of the arm sections 22*a* and 22*b*. The support projecting section 22*d* is provided in a center of the connecting section 22*c* in a transverse direction to project rearward. The arm sections 22*a* and 22*b* and the connecting section 22*c* form a horseshoe. The peripheral wall 11 forming the processing chamber 4 is disposed between the arm sections 22*a* and 22*b*.

The carriage swing shaft 21 penetrates the support projecting section 22*d* and is held by the support projecting section 22*d*, while the carriage swing shaft 21 freely rotates with respect to the shaft support sections 13*c* and 13*d*. Accordingly, a front end part of the carriage 22 can swing around the carriage swing shaft 21 up and down. By the way, the carriage swing shaft 21 may be fixed to the shaft support sections 13*c* and 13*d*, and the support projecting section 22*d* may be held by the carriage swing shaft 21 so as to swing with respect to the carriage swing shaft 21 and so as not to move in the axis direction thereof.

(Lens Rotating Shafts 23 and 24)

The carriage 22 is provided with a pair of the lens rotating shafts (lens shafts) 23 and 24 which extend in a transverse direction and clamp the eyeglass lens (unprocessed circular eyeglass lens, that is, circular lens to be processed) ML on the same axis.

The lens rotating shaft 23 penetrates the tip of the arm section 22*a* in a transverse direction, and is held thereon so as to rotate around the axis and so as not to move in the axis direction. The lens rotating shaft 24 is held by the tip of the arm section 22*b* in a transverse direction so as to rotate around the axis and adjust the movement in the axis direction. The lens rotating shaft 24 is advanced and retracted in an axis direction actuated by a feed screw mechanism SM described hereinunder as shown in FIG. 12.

Figure 12:
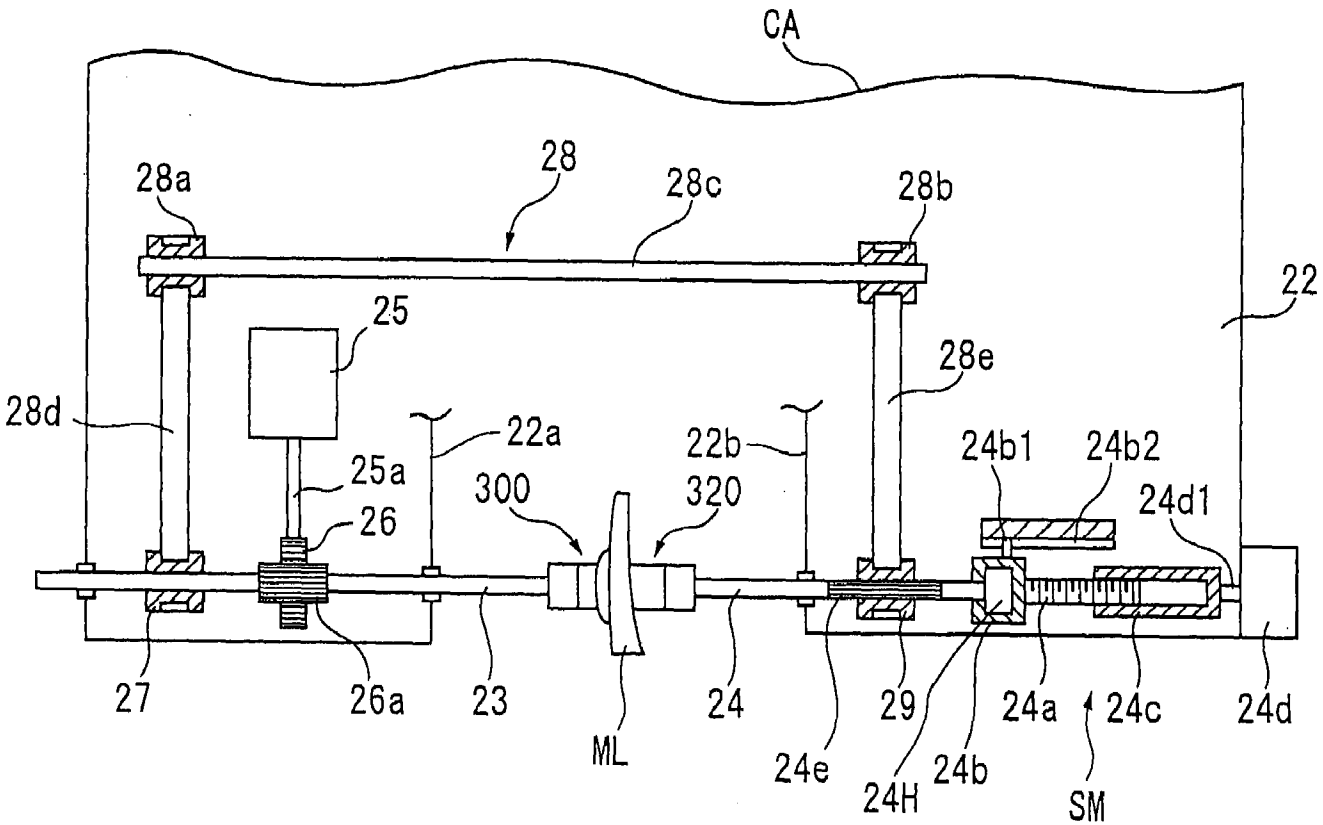
FIG. 12 is an explanatory view of other structure of the carriage shown in FIG. 5.

At an end part and an opposite side to the lens rotating shaft 23 of the lens rotating shaft 24, a circular member 24H of the feed screw mechanism SM is integrally formed as shown in FIG. 12. The circular member 24H is retained at a head part 24*b* of a feed screw 24*a* rotatably around an axis and incapable of moving in an axis direction. Accordingly, the lens rotating shaft 24 is retained rotatably relative to the feed screw 24*a* and incapable of moving in the axis direction.

The head part 24*b* is restricted to rotate around the axis of the lens rotating shaft 24 and the feed screw 24*a* by a key 24*b*1 and a key groove 24*b*2. In addition, the feed screw 24*a* is screwed In a female screw tube 24*c*. The female screw tube 24*c* is fixed to an output shaft 24*d*1 of a pulse motor (drive motor) 24*d*. When the female screw tube 24*c* is normally rotated by normally rotating the pulse motor 24*d*, the feed screw 24*a* is moved to a left part in FIG. 12, and when the female screw tube 24*c* is reversed by reversely rotating the pulse motor 24*d*, the feed screw 24*a* is moved to a right part in FIG. 12. In addition, a spline section 24*e* is formed at the lens rotating shaft 24. The pulse motor 24*d* and the feed screw 24*a* or the like are retained by a cover CA which covers the carriage 22.

As described above, the lens rotating shaft 24 is adjustably moved in the axis direction by the feed screw mechanism SM structured as shown by reference numerals 24*a* to 24H.

(Rotation Drive System 16 for Lens Rotating Shafts 23 and 24)

The rotation drive system 16 for the lens rotating shafts 23 and 24 has, as shown in FIG. 5 and FIG. 12, a lens rotating shaft drive motor 25 fixed to the carriage 22 by fixing means which is not shown, a power transmission shaft (drive shaft) 25*a* which is rotatably retained by the carriage 22 and is interlocked with an output shaft of the lens rotating shaft drive motor 25, a drive gear 26 which is provided at a tip of the power transmission shaft 25*a* and a driven gear 26*a* geared with the drive gear 26 and attached to one lens rotating shaft 23. In this case, a worm gear is used for the drive gear 26, and a worm wheel is used for the driven gear 26*a*.

The rotation drive system 16 further comprises a pulley 27 fixed to an outer end part (opposite end part to the lens rotating shaft 24) of one lens rotating shaft 23; a power transmission mechanism 28 provided at the carriage 22 and a pulley 29 rotatably retained on an outer end part (opposite end part to the lens rotating shaft 23) of the other lens rotating shaft 24.

The pulley 29 is, as shown in FIG. 12, spline-fitted to the spline section 24*e* of the lens rotating shaft 24 and is provided incapable of moving in extending direction of the axis of the lens rotating shaft 24 by movement restricting means which is not shown. Accordingly, the pulley 29 is provided capable of moving relative in the axis direction to the lens rotating shaft 24 and is set so as a position in the axis direction is not changed when the lens rotating shaft 24 is adjusted to move in the axis direction.

The power transmission mechanism 28 has transmission pulleys 28*a* and 28*b*, and a transmission shaft (power transmission shaft) 28*c* which has the transmission pulleys 28*a* and 28*b* fixed on both ends thereof. The transmission shaft 28*c* is disposed parallel to the lens rotating shafts 23 and 24 and rotatably retained by the carriage 22 with a bearing which is not shown. Also, the power transmission mechanism 28 further comprises a driving side belt 28*d* bridged between the pulley 27 and the transmission pulley 28*a*, and a driven side belt 28*e* bridged between the pulley 29 and the transmission pulley 28*b*.

When the lens drive motor 25 is operated to rotate the power transmission shaft 25*a*, the rotation of the power transmission shaft 25*a* is transmitted through the drive gear 26 and the driven gear 26*a* to the lens rotating shaft 23, so that the lens rotating shaft 23 and the pulley 27 are rotatively driven together. On the other hand, the rotation of the pulley 27 is transmitted through the drive side belt 28*d*, the transmission pulley 28*a*, the transmission shaft 28*c*, the transmission pulley 28*b* and the driven side belt 28*e* to the pulley 29, and then the pulley 29 and the lens rotating shaft 24 are rotatively driven integrally. At this time, the lens rotating shaft 24 and the lens rotating shaft 23 are integrally rotated in synchronization to each other.

(Lens Absorption Device 300 and Lens Retainer 320)

Figure 13A:
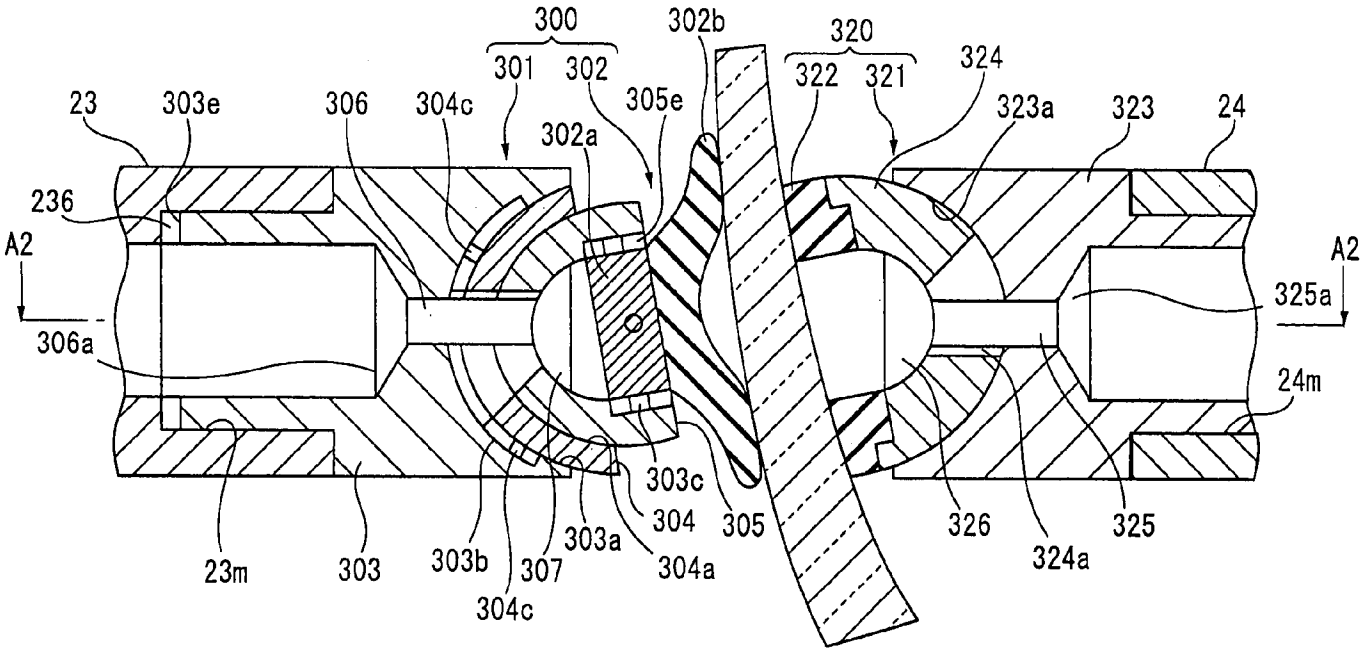
FIG. 13A is a cross-sectional view of a part which retains an eyeglass lens to the lens rotating shaft.
Figure 14:
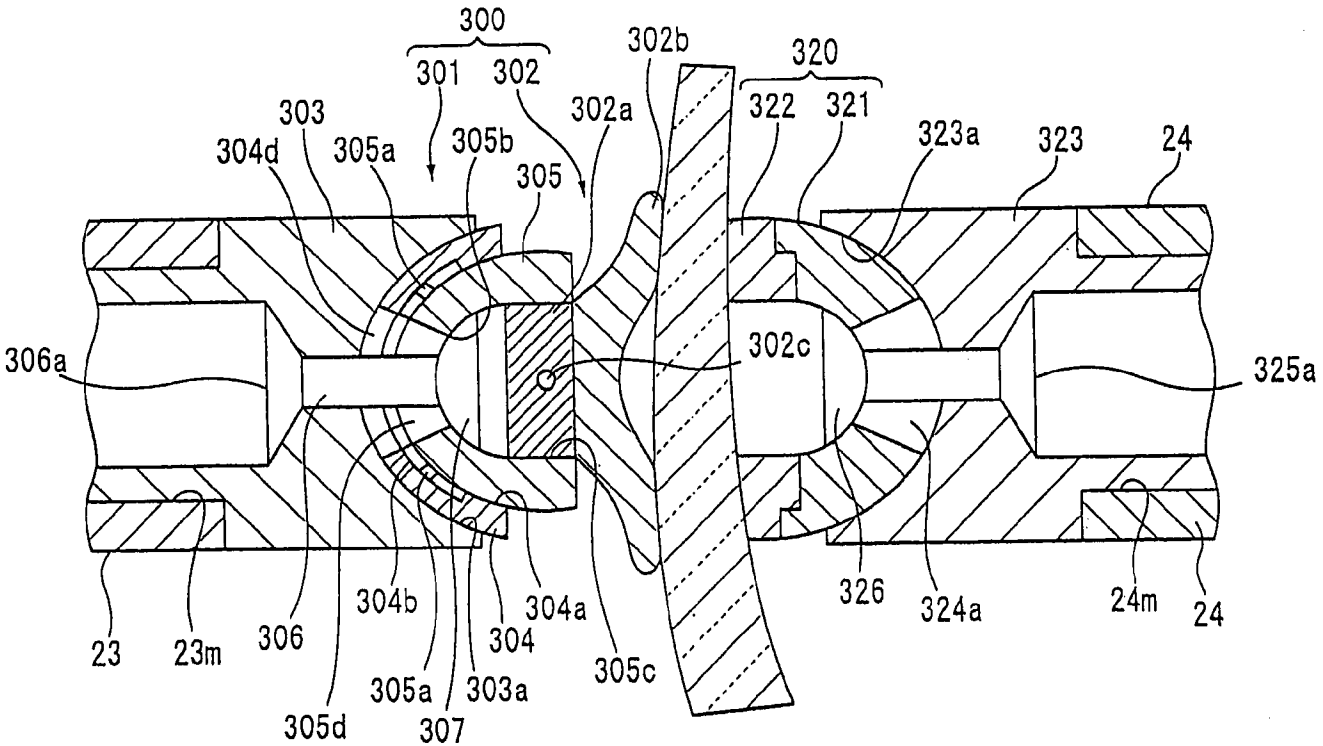
FIG. 14 is a cross-sectional view taken along A2—A2 line in FIG. 13A.
Figure 15:
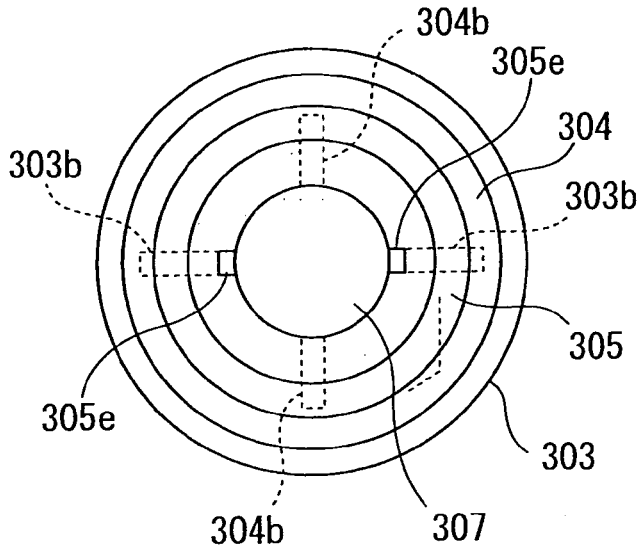
FIG. 15 is a general explanatory view of an adjustable joint of a lens absorption device 300 in FIG. 14 seen from right side.

In addition, at an opposed end part of the lens rotating shafts 23 and 24, fixing holes 23*m* and 24*m* are respectively formed, and a lens absorption device 300 and a lens retainer 320 are each fixed to the fixing holes 23*m* and 24*m* as shown in FIGS. 13A and FIG. 14.

Lens Absorption Device 300

The lens absorption device (lens holding section) 300 has, as shown in FIGS. 13A and FIG. 14, an adjustable joint (universal joint) 301 and a lens absorption board 302. The adjustable joint (spheroid joint, that is, spheroid connection) 301 has, a fixing shaft section 303 which one end is fitted to the fixing hole 23*m* of end part of the lens rotating shaft 23, a first hemispheric member 304 which is slippery and rotatably engaged with a hemispheric hole 303*a* provided at the other end of the fixing shaft section 303, and a second hemispheric member 305 which is slippery and rotatably engaged with a hemispheric hole 304*a* of the first hemispheric member 304.

In addition, a key groove 303*b* which extends radially is formed at the hemispheric hole 303*a*, and a key groove 304*b* which extends radially and in perpendicular to the key groove 303*b* is formed at the hemispheric hole 304*a*. Moreover, a key 304*c* which is provided in protruding condition to an outer surface of the hemispheric member 304 is engaged to the key groove 303*b*, and a key 305*a* which is provided in protruding condition to an outer surface of the hemispheric member 305 is engaged to the key groove 304*b*. Meanwhile, the hemispheric member 305 has a hole section 305*c* which is continuously provided to a hemispheric hole 305*b* and a hemispheric hole 305*b*.

By such a structure, rotation of the first hemispheric member 304 in extending direction of the key groove 303*b* is permitted, and the rotation other than the extending direction of the key groove 303*b* is restricted. Similarly, rotation of the second hemispheric member 305 in extending direction of the key groove 304*b* is permitted, and the rotation other than the extending direction of the key groove 304*b* is restricted.

At center of the first hemispheric member 304 and the second hemispheric member 305, penetrated holes 304*d* and 305*d* are respectively formed. Also, inside of the fixing shaft section 303, a fixing pin 306 which is penetrated center of the hemispheric hole 303*a* and the penetrated holes 304*d* and 305*d* and protruded into center of the hemispheric member 305 is provided. Reference numeral 306*a* denotes a head section of the fixing pin 306. To the fixing pin 306, a hemispheric pulled out restricting member 307 which an outer surface is slippery and rotatably engaged with the hemispheric hole 305*b* is fixed by a screw which is not shown. By this structure, the hemispheric members 304 and 305 are retained without gap between the hemispheric hole 303*a* and the hemispheric outer surface of the pulled out restricting member 307 and are retained rotatably in arbitrary direction through the head section 306*a* and the pulled out restricting member 307, and are set so as not to be removed from the fixing shaft section 303. Accordingly, between the hemispheric hole 303*a* and the hemispheric member 304, and between the hemispheric member 304 and the hemispheric member 305 are mutually engaged with certain degree of friction, and the hemispheric members 304 and 305 are rotated in the above mentioned extending directions of the key grooves 303*b* and the 304*b* when force exceeding a predetermined level is acted.

Figure 13B:
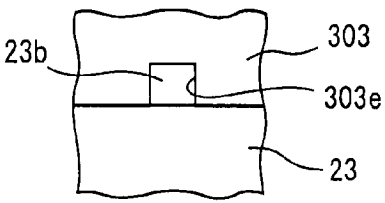
FIG. 13B is an explanatory view of a fixing shaft section in FIG. 13A and a structure of restricting a rotation of the lens rotating shaft seen from inside of the lens rotating shaft.

By the way, as shown in FIGS. 13A and 13B, a groove 303*e* is formed at an end surface of the fixing shaft section 303, and in the fixing hole 23*m* which is inside of the lens rotating shaft 23, a convex section 23*b* engaged with the groove 303*e* is formed. The groove 303*e* and the convex section 23*b* are positioning the fixing shaft section 303 and the lens rotating shaft 23 in circumferential direction.

Furthermore, the lens absorption board 302 has a shaft portion 302*a* which is made of metal fitted to the hole section 305*c* of the hemispheric member 305, and an absorption cup 302*b* which is made of rubber connected to the shaft portion 302*a*. A rotation restricting pin 302*c* is protrudedly provided at a circumferential surface of the shaft portion 302*a*, and a rotation restricting groove 305*e* is formed at the hole section 305*e*. In addition, the rotation restricting pin 302*c* is engaged to the rotation restriction groove 305*e* so that a relative rotation of the shaft portion 302*a* and the hemispheric member 305 are restricted. Meanwhile, one end of the rotation restricting groove 305*e* is opened to an end surface of the hemispheric member 305.

Lens Retainer 320

The lens retainer 320 (lens holding section) 320 has, as shown in FIG. 13A and FIG. 14, an adjustable joint 321 (universal joint) and a lens retain member 322. The adjustable joint (spheroid joint, that is, spheroid connection) 321 has, a fixing shaft section 323 which one end is fitted to the fixing hole 24*m* of an end part of the lens rotating shaft 24, and a hemispheric member 324 which is slippery and rotatably engaged with a hemispheric hole 323*a* provided at the other end of the fixing shaft section 323. At center of the hemispheric member 324, a penetrated hole 324*a* is formed. Also, inside of the lens fixing shaft 24, a fixing pin 325 which is penetrated center of the hemispheric hole 323*a* and protruded into center of the hemispheric member 324 is provided. Reference numeral 325*a* denotes a head section of the fixing pin 325.

To the fixing pin 325, a hemispheric pulled out restricting member 326 which an outer surface is slippery and rotatably engaged with the hemispheric hole 324*a* is fixed by a screw which is not shown. By this structure, the hemispheric member 324 is retained without gap between the hemispheric hole 323*a* and the pulled out restricting member 326 and is retained rotatably in arbitrary direction through the head section 325*a* and the pulled out restricting member 326, and is set so as not to be removed from the fixing shaft section 323.

Accordingly, the hemispheric hole 323*a* and the hemispheric member 324 are mutually engaged with certain degree of friction, and the hemispheric member 324 is provided capable of rotating when force exceeding a predetermined amount is acted. By the way, it is recommended that the hemispheric member 304 and the hemispheric member 324 are provided as one part of an identical spherical member as shown in FIGS. 24 to 26. In addition, although the hemispheric member 305 is protruded from the hemispheric member 304 by the above mentioned way, it can be disposed inside of the hemispheric member 304 so that it is not protruded from the hemispheric member 304. Although the hemispheric member 305 is not shown in FIGS. 24 to 26, they are showing examples of the hemispheric member 305 being disposed inside of the hemispheric member 304 so as not to be protruded from the hemispheric member 304.

(Arrangement of Lens Rotating Shafts 23 and 24 in Processing Chamber 4)

The guide slits 11*a*1 and 11*b*1 of the above described peripheral wall 11 are formed in arc shapes around the carriage swing shaft 21. The opposed end sections to each other of the lens rotating shafts 23 and 24, which are held by the carriage 22, are inserted into the guide slits 11*a*1 and 11*b*1. Accordingly, the opposed end sections of the lens rotating shafts 23 and 24 are projected into the processing chamber 4 surrounded by the peripheral wall 11.

Figure 3B:
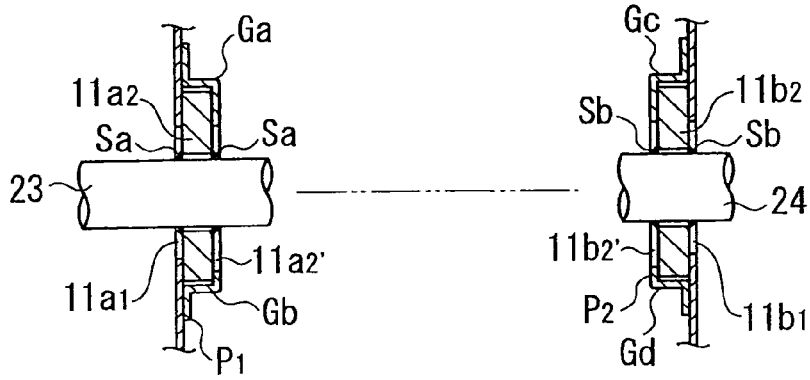
FIG. 3B is a cross-sectional view showing a relation between a lens rotating shaft and a side wall of the processing chamber.

As shown in FIG. 3A, an arc-shaped guide plate P1 having a hat-shaped section is attached on the inner wall surface of the side wall 11*a*, and as shown in FIG. 4, an arc-shaped guide plate P2 having a hat-shaped section is attached on the inner wall surface of the side wall 11*b* (see FIG. 3B). In the guide plates P1 and P2, guide slits 11*a*2' and 11*b*2' extending in an arc shape are formed so as to correspond to the guide slits 11*a*1 and 11*b*1 respectively.

In addition, a cover plate 11*a*2 for closing the guide slits 11*a*1 and 11*a*2' is disposed between the side wall 11*a* and the guide plate P1 so as to move forward and rearward and up and down, and a cover plate 11*b*2 for closing the guide slits 11*b*1 and 11*b*2' is disposed between the side wall 11*b* and the guide plate P2 so as to move forward and rearward and up and down. Also, the lens rotating shafts 23 and 24 slidably penetrate the cover plates 11*a*2 and 11*b*2 respectively. Accordingly, the cover plates 11*a*2 and 11*b*2 are attached to the lens rotating shafts 23 and 24 so as to move relatively in the axis direction respectively.

Moreover, in the guide plate P1, arc shaped guide rails Ga and Gb are provided, which are positioned above and below the guide slits 11*a*1 and 11*a*2' along the upper and lower edges of the guide slits 11*a*1 and 11*a*2', and the guide plate P2 is provided with arc-shaped guide rails Gc and Gd respectively positioning above and below the guide slits 11*b*1 and 11*b*2' to follow the upper and lower edges of the guide slits 11*b*1 and 11*b*2'.

The cover plate 11*a*2 can be guided in the guide rails Ga and Gb at the upper and lower edges thereof to move up and down while drawing an arc, and the cover plate 11*b*2 can be guided in the guide rails Gc and Gd at the upper and lower edges thereof to move up and down while drawing an arc.

Additionally, the lens rotating shaft 23 of the carriage 22 slidably penetrates the arc-shaped cover plate 11*a*2 so as to facilitate assemblies of the lens rotating shaft 23, the side wall 11*a*, the guide plate P1 and the cover plate 11*a*2. The lens rotating shaft 24 of the carriage 22 slidably penetrates the arc-shaped cover plate 11*b*2 so as to facilitate assemblies of the lens rotating shaft 24, the side wall 11*b*, the guide plate P2 and the cover plate 11*b*2.

Also, a space between the cover plate 11*a*2 and the lens rotating shaft 23 is sealed by seal members Sa and Sa, and the cover plate 11*a*2 is held by the lens rotating shaft 23 through the seal members Sa and Sa. Moreover, a space between the cover plate 11*b*2 and the lens rotating shaft 24 is sealed by seal members Sb and Sb, and the cover plate 11*b*2 is held by the lens rotating shaft 24 through the seal members Sb and Sb so as to relatively move in the axis direction. Accordingly, when the lens rotating shafts 23 and 24 rotate along the guide slits 11*a*1 and 11*a*2', and 11*b*1 and 11*b*2' while drawing an are, the cover plates 11*a*2 and 11*b*2 can also move up and down together with the lens rotating shafts 23 and 24 integrally. By the way, the seal members Sa and Sa may be held by the cover plate 11*a*2, or the circumferential parts thereof may be disposed between the cover plate 11*a*2 and the side wall 11*a*, and between the cover plate 11*a*2 and the guide plate P1 so that the seal members Sa and Sa cannot move in the axis direction of the lens rotating shaft 23 when the lens rotating shaft 23 moves in the axis direction. Similarly, the seal members Sb and Sb may be held by the cover plate 11*b*2, or the circumferential parts thereof may be disposed between the cover plate 11*b*2 and the side wall 11*b*, and between the cover plate 11*b*2 and the guide plate P2 so that the seal members Sb and Sb cannot move in the axis direction of the lens rotating shaft 24 when the lens rotating shaft 24 moves in the axis direction.

The side wall 11*a* and the guide plate P1 are close to the arc-shaped cover plate 11*a*2 so as to contact thereto tightly, and the side wall 11*b* and the guide plate P2 are close to the arc-shaped cover plate 11*b*2 so as to contact thereto tightly.

Furthermore, each of the guide plates P1 and P2 in the processing chamber 4 is provided to extend to the vicinities of the rear wall lie and the lower bottom wall (not shown) and is designed to have the upper end cut on the side of a measuring element 41 and the lower end cut in the upper vicinity of a grinding stone 35, whereby the upper and lower ends of the guide plates P1 and P2 are opened within the processing chamber 4. Accordingly, grinding fluid is flown along the inner surfaces of the side walls 11*a* and 11*b*, so that the grinding fluid does not stay between the side wall 11*a* and the guide plate P1, and between the side wall 11*b* and the guide plate P2.

In addition, when the carriage 22 is swung up and down around the carriage swing shaft 21 and the lens rotating shafts 23 and 24 are moved up and down along the guide slits 11*a*1 and 11*b*1, the cover plates 11*a*2 and 11*b*2 are moved up and down together with the lens rotating shafts 23 and 24. Accordingly, the guide slits 11*a*1 and 11*b*1 are always closed by the cover plates 11*a*2 and 11*b*2, as a result, the grinding fluid or the like within the peripheral wall 11 does not leak to the outside of the peripheral wall 11. By the way, the eyeglass lens ML is close to or apart from the grinding stone 35 with the upward and downward movement of the lens rotating shafts 23 and 24.

At the time of loading of a natural lens or the like of the eyeglass lens ML to the lens rotating shafts 23 and 24, and unloading thereof after the grinding process, the carriage 22 is positioned in the center of the swinging in the vertical direction such that the lens rotating shafts 23 and 24 are positioned in the middle of the guide slits 11*a*1 and 11*b*1 respectively. Also, at the time of measuring the lens thickness and the grinding process, the carriage 22 is controlled and swung upward and downward to be slant in accordance with a grinding processed amount of the eyeglass lens ML.

(Grinding Means 17)

The grinding means has main lens peripheral edge grinding means and auxiliary lens peripheral edge processing means.

Main Lens Peripheral Edge Grinding Means

The main lens peripheral edge grinding means has, as shown in FIG. 4, a grinding stone drive motor 30 fixed to the tray 12; a transmission shaft 32 to which drive of the grinding stone drive motor 30 is transmitted through a belt 31; a grinding stone shaft section 33 to which rotation of the transmission shaft 32 is transmitted, and the grinding stone 35 fixed to the grinding stone shaft section 33. The grinding stone 35 includes a rough grinding stone, a grinding stone for a V-groove and a finishing grinding stone or the like, of which reference numerals are omitted. The rough grinding stone, the grinding stone for the V-groove and the finishing grinding stone are arranged side by side in the axis direction.

Auxiliary Lens Peripheral Processing Means

In addition, the auxiliary lens peripheral processing means has, as shown in FIG. 3A and FIG. 4, a drilling processing device 200 and an auxiliary processing device 201. The drilling processing device (drilling means) 200 and the auxiliary processing device 201 have, as shown in FIG. 7, a processing device sustention mechanism 202 which is shared and processing device driving means 203 which is partially shared.

<Processing Device Sustention Mechanism 202>

Figure 7:
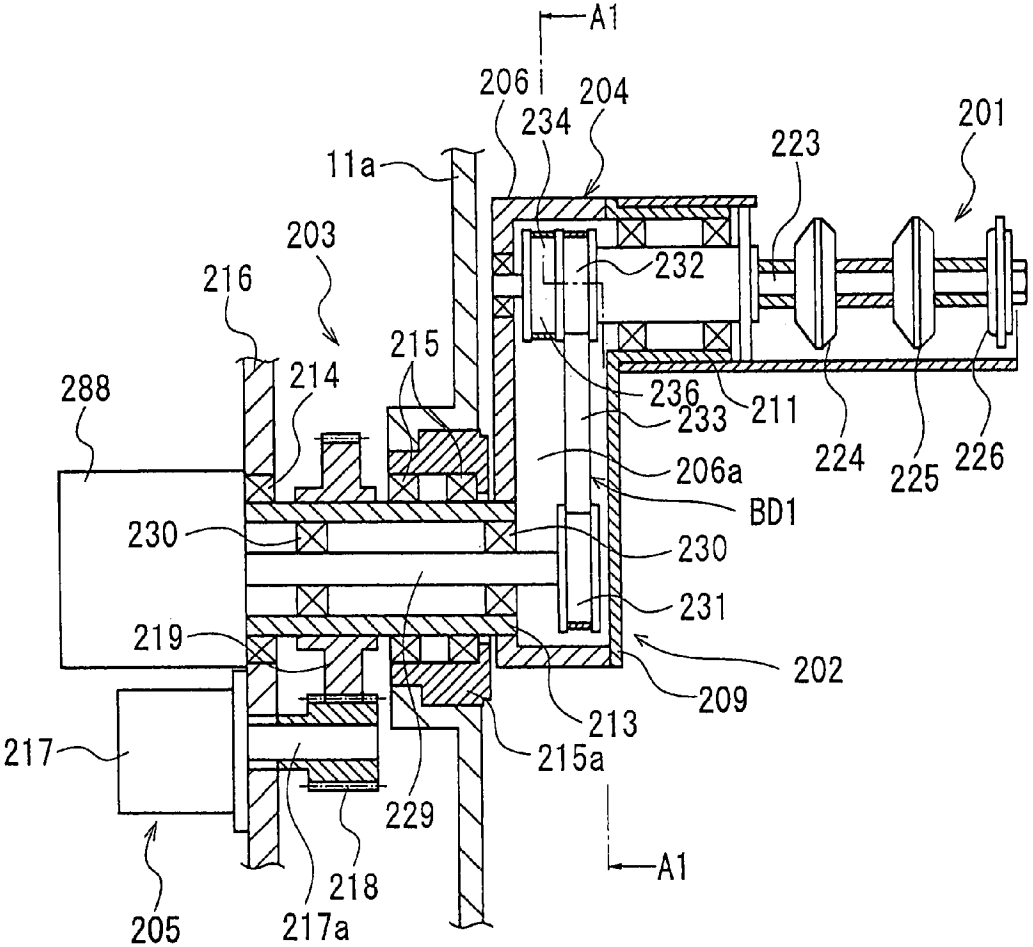
FIG. 7 is a cross-sectional view showing auxiliary lens peripheral edge processing means shown in FIGS. 3A and 4 taken along a rotation shaft of a chamfering stone.

The processing device sustention mechanism 202 has, as shown in FIG. 7, a swing arm 204 (see FIG. 8A and FIG. 4) fixed swingably to the side wall 11*a*, and swing driving means (rotation driving means) 205 for swinging (upward and downward rotation) the swing arm 204.

(Swing Arm 204)

Figure 9:
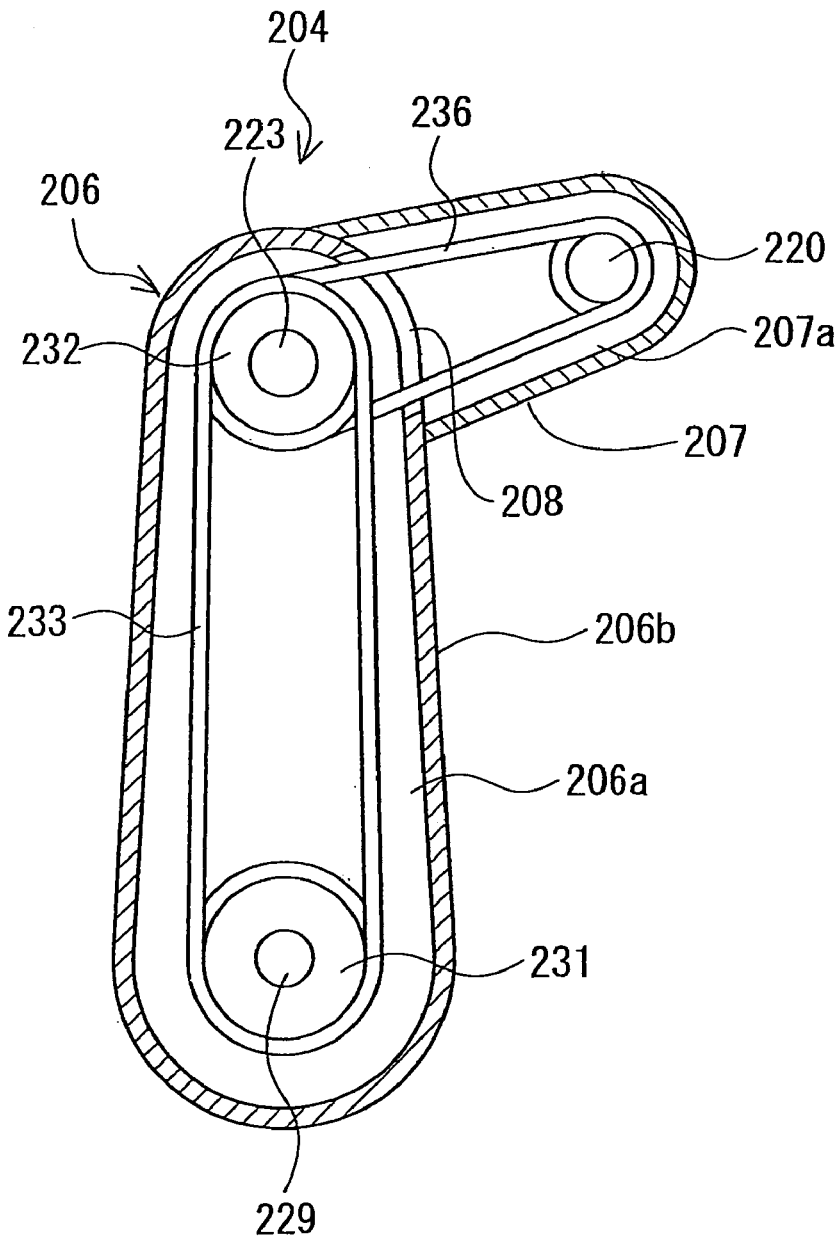
FIG. 9 is a cross-sectional view taken along A1—A1 line in FIG. 7.
Figure 11:
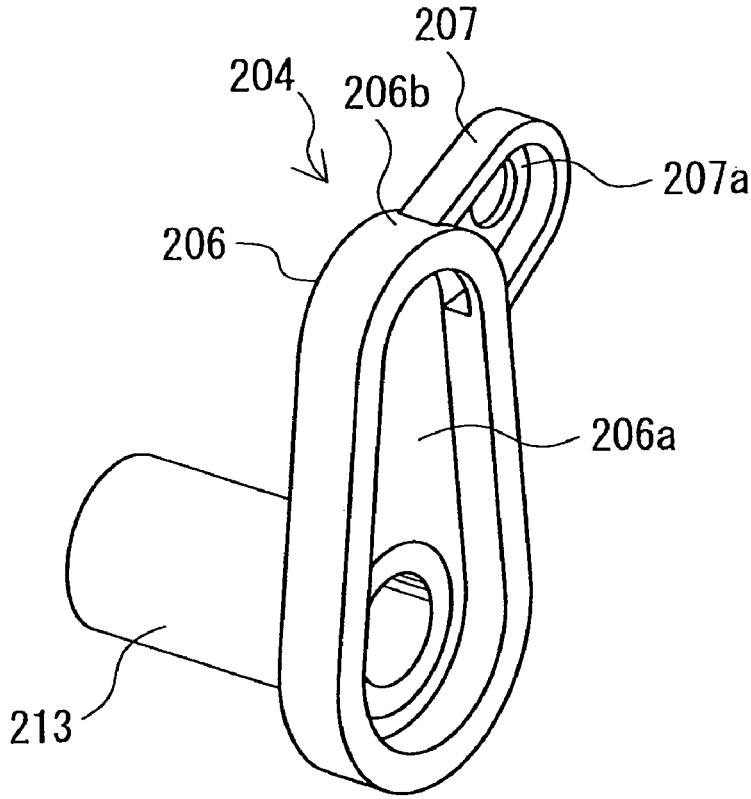
FIG. 11 is an explanatory perspective view showing a condition that a lid body of a swing arm in FIG. 7 and a processing device are removed.

The swing arm 204 is arranged in one side part of the processing chamber 4 of the lens grinding processing apparatus. Moreover, the swing arm 204 has an arm main body 206 as shown in FIGS. 7 and 11. The arm main body 206 has a space 206*a* which is opened to one surface. Also, at one end part (upper end part as a free end part) of the swing arm 204, that is, at one end part (free end part) of the arm main body 206, a hollow arm section 207 for fixing a drill protruded from an outer surface of a side wall 206*b* is provided as shown in FIG. 9, and inside of the arm section 207, a space 207*a* which is opened in the same direction with the space 206*a* is formed. The spaces 206*a* and 207*a* are mutually communicated through a communicating passage 208.

Also, as shown in FIG. 7, the swing arm 204 has a lid body 209 which is fixed attachably and detachably to an opening of the arm main body 206 and closes the space 206*a*, and a lid body 210 which is fixed attachably and detachably to an opening of an arm portion 208 and closes the space 207*a*. Furthermore, at one end part of the lid bodies 209 and 210, bearing tube sections 211 and 212 are integrally provided.

At base (lower end part as other end part) of the arm main body 206, one end of a rotation sustention tube (tube body) 213 is fixed. The rotation sustention tube (tube body) 213 is sustained by a sustention wall 216 which is inside of the apparatus main body 3 and the side wall 11*a* through bearings 214 and 215. Reference numeral 215*a* denotes a bearing sustention tube body which is fixed to the side wall 11*a* and which is rotatably sustaining the bearing 215 to the side wall 11*a*.

(Swing Driving Means 205)

As shown in FIG. 7, the swing driving means 205 has a drive motor 217 such as the pulse motor fixed to the sustention wall 216, a gear (pinion) 218 fixed to an output shaft 217*a* of the drive motor 217, and a gear 219 which gears with the gear 218 and is fixed to the rotation sustention tube 213. Accordingly, rotation of the drive motor 217 is transmitted to the rotation sustention tube 213 through the output shaft 217*a*, the gear 218 and the gear 219, as a result, the rotation sustention tube 213 and the swing arm 204 are integrally rotated. In addition, an one end part of the swing arm 204 is rotated upward by normally rotating the drive motor 217, and the one end part of the swing arm 204 is rotated downward by reversely rotating the drive motor 217.

<Processing Devices of the Drilling Processing Device 200 and the Auxiliary Processing Device 201>

(Processing Device of the Drilling Processing Device 200)

Figure 8:
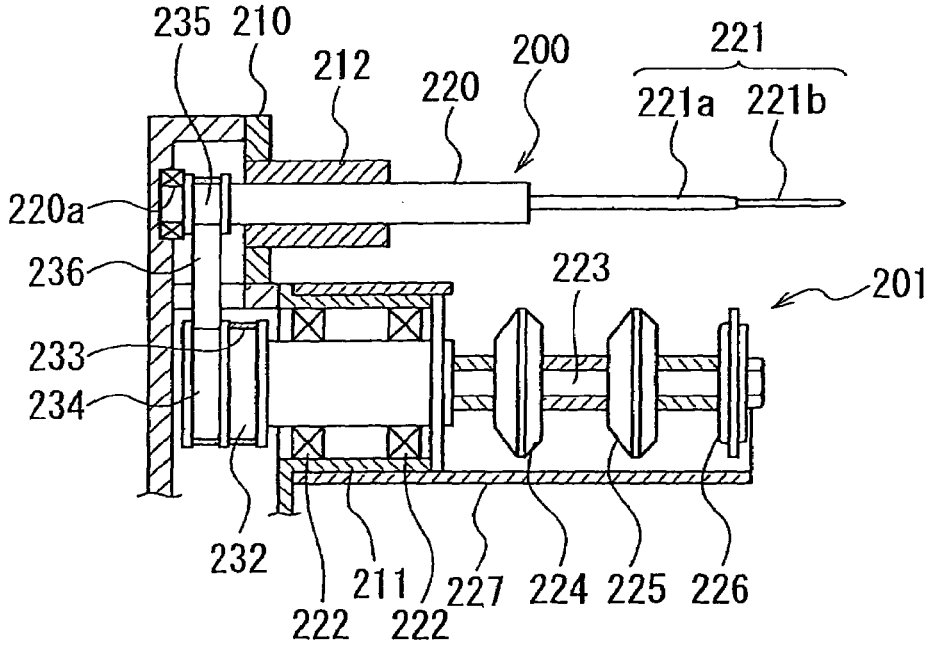
FIG. 8 is a horizontal cross-sectional view showing the auxiliary lens peripheral edge processing means shown in FIGS. 3A and 4 including the rotating shaft of the chamfering stone and an axis of a drill which is for drilling a hole.

As shown in FIG. 8, the drilling processing device 200 has a spindle 220 which one end part is rotatably retained by the arm portion 208 through a thrust bearing 220*a* and which a middle part is rotatably retained by the bearing tube section 212, and a drill 221 as a drilling tool (processing device) fixed attachably and detachably to the spindle 220. For the fixing of the drill 221 to the spindle 220, a taper fixing or a zipper or the like may be used. Also, for the drill 221, a drill portion 221*a* having different diameters and a special drill having reference numeral 221*b* are used. By the way, when the drilling in which its shape is not round is carried out, the drilling tool (processing device) such as an end mill or a reamer is fixed to the spindle 220 as a substitute for the drill 221.

(Processing Device of the Auxiliary Processing Device 201)

As shown in FIGS. 7 and 8, the auxiliary processing device 201 has a rotation shaft (tool fix shaft) 228 rotatably retained to the bearing tube section 211 through a bearing 222, chamfering stones (grinding processing means) 224 and 225 as the processing tool fixed to the rotation shaft 223, and a grooving cutter 226 as the processing tool fixed to the rotation shaft 223. Meanwhile, reference numeral 227 denotes a cover for the processing tool in tub shape which a base end part is attachably and detachably fixed to an outer circumferential surface of the bearing tube section 211.

<Processing Device Driving Means 203>

The processing device driving means 203 has a drive motor 228 such as the pulse motor fixed to the sustention wall 216. An output shaft (rotating shaft) 229 of the drive motor 228 is rotatably retained in the rotation sustention tube 213 through a bearing 230 and a tip part thereof is disposed inside of the space 206*a* of the swing arm 204.

Also, the processing device driving means 203 has a pulley 231 fixed at the tip part of the output shaft 229, a pulley 232 provided at the rotation shaft 223, and a belt 233 bridged between the pulley 231 and the pulley 232. A power transmission mechanism which is from the drilling processing device 200 to the belt 233 and the pulley 232 constitutes processing device driving means BD1 (see FIG. 7) shared by the processing devices of the drilling processing device 200 and the auxiliary processing device 201 that are, more specifically, the drill 221, the chamfering stones 224 and 225 and the grooving cutter 226.

By this structure, rotation of the drive motor 228 is transmitted to the rotation shaft 223 through the output shaft 229, the pulley 231, the belt 233 and the pulley 232. Accordingly, the rotation shaft 223 is driven and rotated, as a result, the chamfering stones 224 and 225 and the grooving cutter 226 which are fixed to the rotation shaft 223 are rotated.

In addition, the processing device driving means 203 has a pulley 234 provided at the rotation shaft 223, a pulley 235 provided at one end part of the spindle 220, and a belt 236 bridged between the pulley 234 and the pulley 235. By this structure, rotation transmitted to the rotation shaft 223 is transmitted to the spindle 220 through the pulley 234, the belt 236 and the pulley 235. Accordingly, the spindle 220 is driven and rotated, as a result, the drill 221 fixed to the spindle 220 is rotated.

<Shaft-to-shaft Distance Adjusting Means 43>

Figure 6:
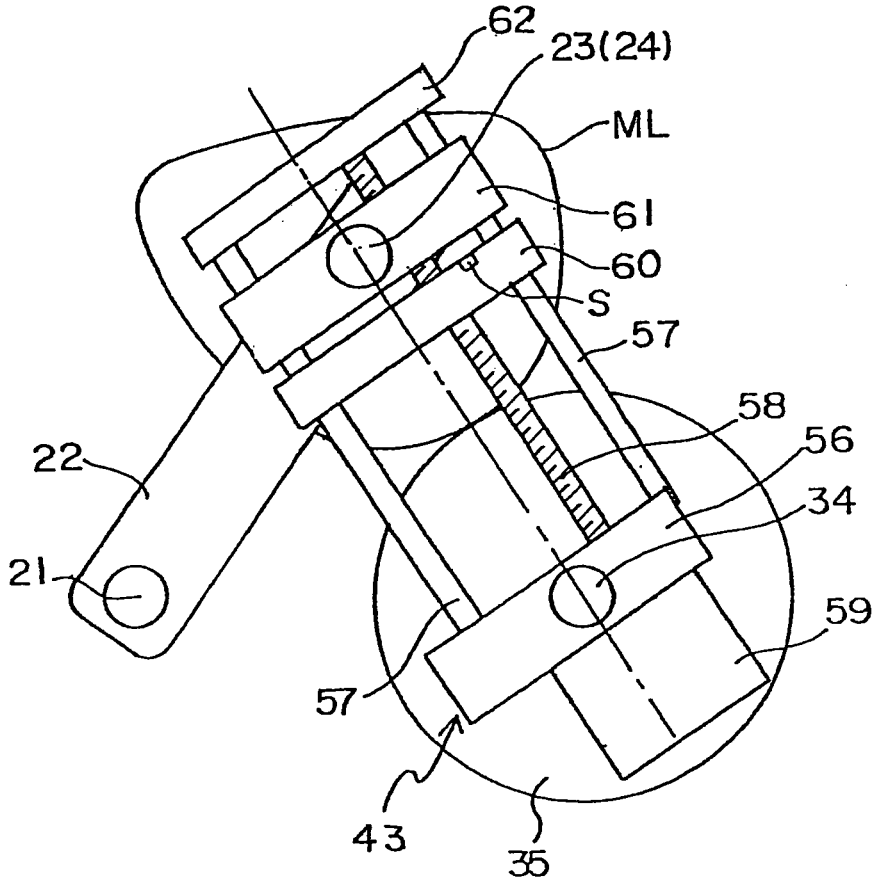
FIG. 6 is an explanatory view of means which controls elevation and lowering of the carriage shown in FIG. 4.

As shown in FIG. 6, the distance between the lens rotating shafts 23 and 24 and the grinding stone shaft section 33 is adjusted by shaft-to-shaft distance adjusting means (shaft-to-shaft distance adjusting mechanism) 43.

The shaft-to-shaft distance adjusting means 43 includes a rotating shaft 34 having an axis positioned on the same axis of the grinding stone shaft section 33 as shown in FIG. 6. The rotating shaft 34 is rotatably supported on the V-groove of the projected support section 13*e* in FIG. 5.

Also, the shaft-to-shaft distance adjusting means 43 includes a base 56 held by the rotating shaft 34; a pair of parallel guide rails 57 and 57 attached to the base board 56 and obliquely extended upward from the upper surface thereof; a screw shaft (feed screw) 58 rotatably provided on the base board 56 to be parallel to the guide rails 57 and 57; a pulse motor 59 provided on the lower surface of the base board 56 for rotating the screw shaft 58; and a stage 60 screwed by the screw shaft 58 and held by the guide rails 57 and 57 to move up and down.

The shaft-to-shaft distance adjusting means 43 further includes a lens rotating shaft holder 61 disposed above the stage 60 and held by the guide rails 57 and 57 so as to move up and down, and a reinforcement member 62 for holding the upper ends of the guide rails 57 and 57 and rotatably holding the upper end of the screw shaft 68. The lens rotating shaft holder 61 is always rotatably energized downward by its own weight and by a pressure adjusting mechanism which is not shown to be pressed to the stage 60. Moreover, a sensor S for detecting an abutment of the lens rotating shaft holder 61 is attached to the stage 60.

When the screw shaft 58 is normally or reversely rotated by a normal or reverse rotation of the pulse motor 59, the stage 60 is elevated or lowered along the guide rails 57 and 57 by the screw shaft 58, and then the lens rotating shaft holder 61 is elevated or lowered integrally with the stage 60. Accordingly, the carriage 22 is swung around the carriage swing shaft 21.

<Lens Thickness Measuring System 18>

The lens thickness measuring system (lens thickness measuring device) 18 includes, as shown in FIG. 3A and FIG. 4, the measuring element 41 disposed in a rear edge upper part of the processing chamber 4; a measurement shaft 42*a* provided parallel to the lens rotating shafts 23 and 24, one end thereof being provided integrally with the measuring element 41; and a measuring unit (detecting unit for detecting moving amount of measuring element) 42 disposed close to the rear edge upper part of the side wall 11*b*, and outside of the processing chamber 4. This measurement shaft 42*a* penetrates the side wall 11*b* to be protruded inside and outside of the processing chamber 4.

(Measuring Element 41)

Figure 16:
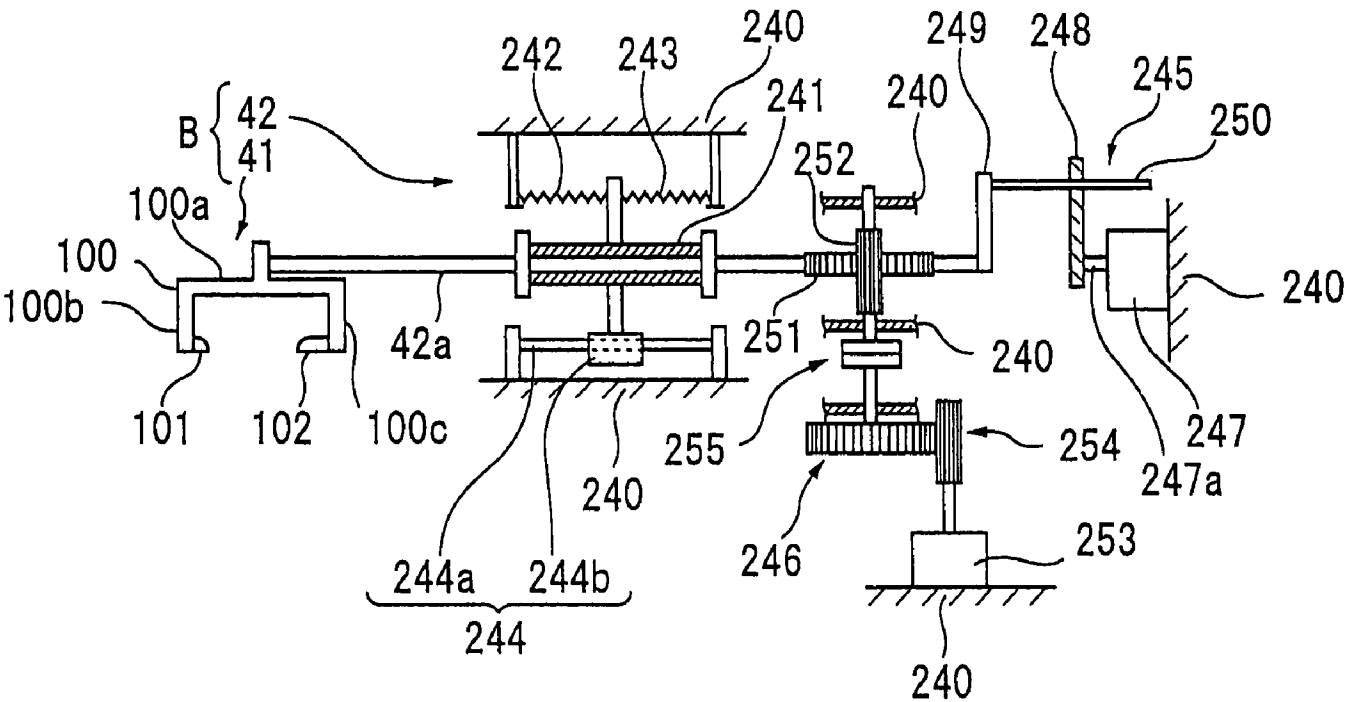
FIG. 16 is a general explanatory view of a measuring section which interlocks with the measuring element in FIGS. 3A and 4.

The measuring element 41 includes, as shown in FIG. 3A and FIG. 16, a feeler holding member 100, and a pair of feelers 101 and 102. The feeler holding member 100 includes a successively provided portion 100*a* extended left and right, and parallel opposing pieces 100*b* and 100*c* provided to be protruded in the same direction in both left and right ends of the successively provided portion 100*a*. The feelers 101 and 102 are formed in cylindrical, and attached to the tips of the opposing pieces 100*b* and 100*c* to face each other.

Also, the feeler holding member 100 is fixed to the measurement shaft 42*a* which penetrates the side wall 11*b* and extended in left and right as shown in FIG. 4. The measurement shaft 42*a* is retained capable of moving left and right by the measuring unit 42 which is disposed outside of the side wall 11*b*. As shown in FIG. 16, the measuring element 41 and the measuring unit 42 constitute lens thickness shape measuring means B.

(Measuring Unit 42)

The measuring unit 42 has a frame shown by a plurality of reference numerals 240 as shown in FIG. 16. In the drawing, although the frame has been shown by the plurality of reference numerals as a simplicity reason for explanation, in fact, it is one frame constituted by a plurality of members.

The measuring unit 42 has a sustention tube 241 which is rotatably retained to the measurement shaft 42*a* and is retained incapable of moving relatively in the axis direction of the measurement shaft 42*a*, and springs 242 and 243 which are to retain the sustention tube 241 capable of advancing and retracting in the axis direction to the frame 240 at a predetermined position.

Furthermore, the measuring unit 42 has a magnescale 244 for measuring a movement of the measurement shaft 42*a* in the axis direction, measuring element rotating means 245 for rotating the measuring element 41 between an using position and an unused position, and measurement shaft advancing-retracting means 246 for compulsorily driving the measuring element 41 in the axis direction of the measurement shaft 42*a*.

The magnescale 244 has a magnetic scale 244*a* retained by the frame 240, and a reading head 244*b* which is provided integrally with the sustention tube 241 and reads a magnetic field distribution of the magnetic scale 244*a*. Accordingly, an amount of movement of the measuring element 41 in the axis direction of the measurement shaft 42*a* can be read.

The measuring element rotating means 245 has a drive motor 247 retained by the frame 240; an arm 248 fixed at an output shaft 247*a* of the drive motor 247; an arm 249 fixed at an end part of the measurement shaft 42*a*; and a connection shaft 250 which is retained integrally with the arm 249 in parallel to the measurement shaft 42*a* and slidably penetrates the arm 248. Accordingly, rotation of the drive motor 247 is transmitted to the measurement shaft 42*a* through the arms 248 and 249 and the connection shaft 250, as a result, the measurement shaft 42*a* is adapted to be rotated in about the axis line. In this case, a range of rotation of the measurement shaft 42*a* rotated by the drive motor 247 is set to be carried out in a range between a stored position of the measuring element 41 which is an upraised position thereof and the using position of the measuring element 41 which the measuring element 41 is horizontally prostrated.

The measurement shaft advancing-retracting means 246 has a rack 251 provided at the measurement shaft 42*a*; a gear (pinion) 252 which is rotatably retained by the frame 240 and gears with the rack 251; a drive motor 253 such as the pulse motor retained by the frame 240; a gear rotation mechanism 254 which interlocks with the drive motor 253; and an electromagnetic clutch 255 for carrying out a connection and a disconnection between the gear rotation mechanism 254 and the gear 252. According to this structure, if the drive motor 253 is normally or reversely rotated when the electromagnetic clutch 255 is turned ON, a normal rotation or a reverse rotation of the drive motor 253 is transmitted to the measurement shaft 42*a* through the gear rotation mechanism, the electromagnetic clutch 255, the gear 252 and the rack 251, as a result, the measurement shaft 42*a* is adapted to be advanced and retracted in the axis direction. Meanwhile, each teeth of the rack 251 extends circularly in circumferential direction. Accordingly, a gearing position between the rack 251 and the gear 252 in the axis direction does not change even if the measurement shaft 42*a* is rotated.

(Control Circuit)

Figure 17:
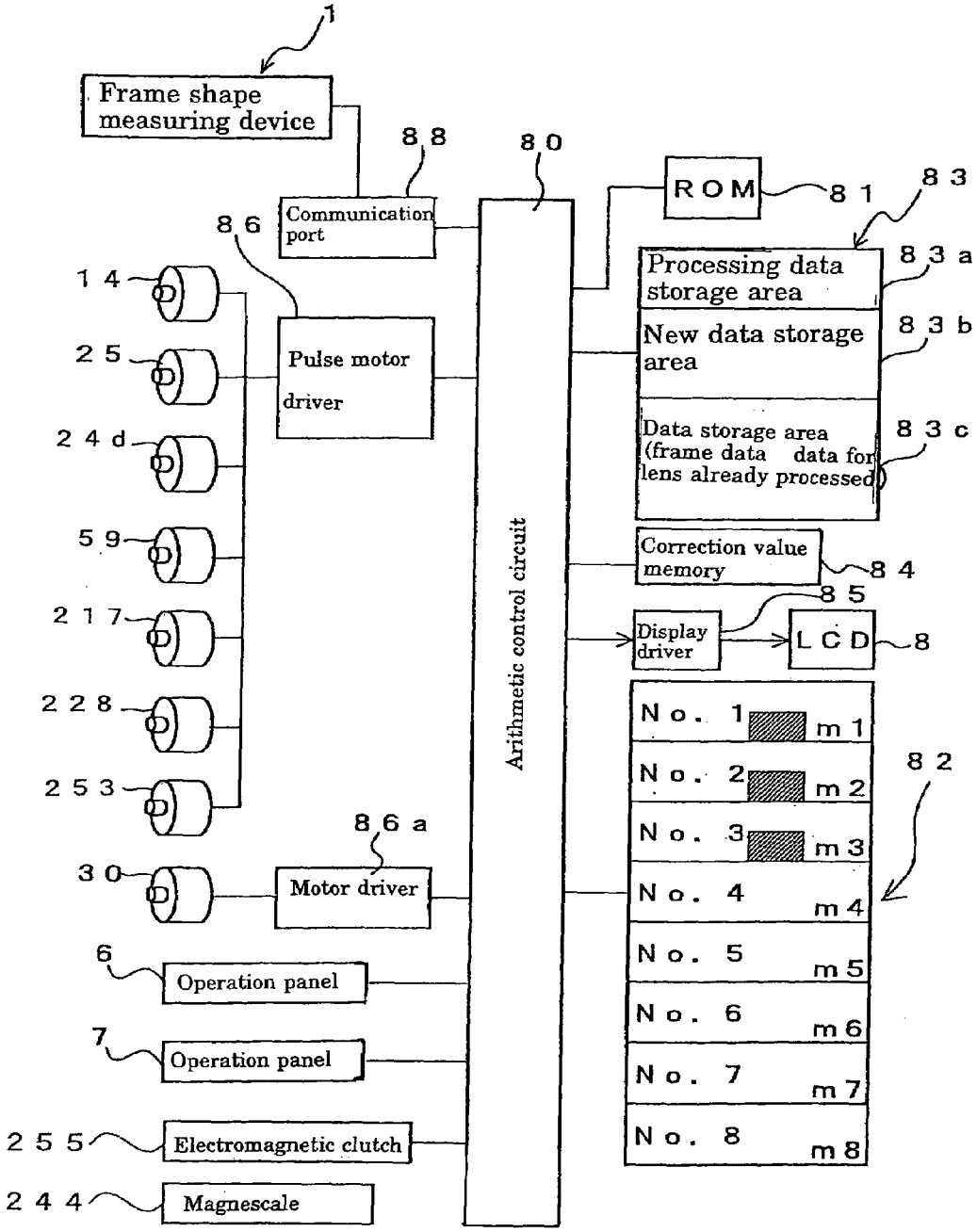
FIG. 17 is a view of a control circuit of the lens grinding processing apparatus shown in FIGS. 1–16.

The above described operation panels 6 and 7 (that is, the switches of the operation panels 6 and 7) are connected to an arithmetic control circuit (arithmetic control means) 80 including a CPU as shown in FIG. 17. Also, the arithmetic control circuit 80 is connected to a ROM 81 as storage means, a data memory 82 as storage means, a RAM 83 and a correction value memory 84.

Moreover, the arithmetic control circuit 80 is connected to the liquid crystal display device 8 through a display driver 85 and to a pulse motor driver (pulse motor driving circuit) 86. The pulse motor driver 86 is controlled in motion thereof by the arithmetic control circuit 80 to control the motion of the various kinds of the drive motors in the grinding processing section 10 or the like, that is, the base drive motor 14, the lens rotating shaft drive motor 25, the pulse motors 24*d* and the 59, the drive motor 217, the drive motor 228 and the drive motor 253 or the like.

The arithmetic control circuit 80 is further connected to the grinding stone drive motor 30 through a motor driver (motor drive circuit) 86*a*, and to the electromagnetic clutch 255.

Furthermore, the arithmetic control circuit 80 is connected to the frame shape measuring device 1 in FIG. 1 through a communication port 88 to receive the lens shape data such as the frame shape data, lens shape data and the data on position of the hole for fixing the point frame from the frame shape measuring device (lens shape measuring device) 1.

In addition, the arithmetic control circuit 80 being set so that a measurement signal (detection signal of amount of movement of measuring element) from the magnescale 244 is inputted.

The arithmetic control circuit 80 determines each of the coordinate positions of the front refractive surface (the left surface of the eyeglass lens in FIG. 9) of the eyeglass lens ML and the rear refractive surface (the right surface of the eyeglass lens in FIG. 9) thereof at the lens shape data ($\theta i$, $\rho i$), based on a drive pulse for the base drive motor 14, drive pulses for the lens rotating shaft drive motor 25, pulse motor 59 or the like which are controlled in motion thereof based on the lens shape data ($\theta i$, $\rho i$), from the frame shape measuring device 1, and the amount of movement detection signal from the measuring unit 42. Subsequently, the arithmetic control circuit 80 determines a lens thickness Wi at the lens shape data ($\theta i$, $\rho i$) by calculation from the determined coordinate positions of the front and rear refractive surfaces of the eyeglass lens ML.

When the arithmetic control circuit 80 reads out data from the frame shape measuring device 1 or reads out data stored in storage areas m1 to m8 of the data memory 82 after starting control of processing, the arithmetic control circuit 80 performs the control of processing and the control of the data reading or the layout setting in a time-sharing mode.

More specifically, when a period between time t1 and t2 is T1, a period between time t2 and t3 is T2, a period between time t3 and t4 is T3, . . . , a period between time tn−1 and tn is Tn, then the control of processing is performed during the periods T1, T3, . . . , and Tn, and the control of the data reading and the layout setting are performed during the periods T2, T4, . . . , Tn−1. Accordingly, during the grinding processing of the lens which is to be processed, the reading and storing of the next plurality of lens shape data and the data on position of the hole for fixing the point frame, the data reading, the layout setting (adjustment) or the like can be performed, therefore, considerably improving a work efficiency of data processing.

Also, various kinds of programs for controlling the operations of the lens grinding processing apparatus 2 are stored in the above described ROM 81. The data memory 82 is provided with the plurality of data storage areas. Moreover, the RAM 83 is provided with: a processing data storage area 83*a* for storing the processing data for the lens currently in processing; a new data storage area 83*b* for storing new data; and a data storage area 83*c* for storing the frame data, data for the lens already processed or the like.

By the way, for the data memory 82, a readable and writable FEEPROM (flash EEPROM) can be employed, or a RAM using a backup power supply can be employed, in which the content thereof cannot be erased even when the main power supply is turned off.

Moreover, the arithmetic control circuit 80 carries out controls of the above mentioned hole diameter variability means and hole shape variability means based on the data on position of the hole for fixing the point frame stored in the data memory 82. More specifically, the arithmetic control circuit 80 automatically controls the positioning of the drilling tool to the rimless lens, rotating speed of the drilling tool, relative movement between the drilling tool and the rimless lens and moving speed thereof and condition of the movement thereof Meanwhile, when drilling the hole into the rimless lens by the hole diameter variability means, the drilling tool, more specifically, the special drill is rotated with a predetermined rotating speed. On the other hand, when drilling the hole into the rimless lens by the bole shape variability means, the drilling tool, that is, the reamer or the end mill is not rotated, and the arithmetic control circuit 80 controls the relative movement of the drilling tool and the rimless lens such as controlling in such a manner as to move the rimless lens two-dimensionally or three-dimensionally. Accordingly, the hole having the different diameters or the different shapes can be automatically formed to the rimless lens.

The operations of the hole diameter variability means and the hole shape variability means are carried out by an operation button (not shown) provided on the operation panels 6 and 7.

[Operation]

Next, operations of the lens grinding processing apparatus having the arithmetic control circuit 80 and the above mentioned hole diameter variability means or the hole shape variability means in such structures described above will be described.

(1) Retention of Eyeglass Lens ML Between Lens Rotating Shafts 23 and 24

In such structure as described above, the adjustable joint 301 and the lens retainer 320 are fixed at the opposed end sections of the lens rotating shafts 23 and 24 in advance. When retaining the eyeglass lens ML between the adjustable joint 301 and the lens retainer 320, the pulse motor 24*d* is controlled in motion by the arithmetic control circuit 80 and the lens rotating shaft 24 is driven in a direction separating from the lens rotating shaft 23 by operating the operation panels 6 and 7 so as to widen the distance between the adjustable joint 301 and the lens retainer 320 as shown in FIG. 24. By the way, FIGS. 24 to 29 abbreviatedly show the structure in the FIGS. 13A and 14 by omitting partial of the structure in FIGS. 13A and 14, therefore, the lens absorption device 300 and the lens retainer 320 in FIGS. 24 to 29 actually have the structure shown in FIGS. 13A and 14. Accordingly, the detailed descriptions of the lens absorption device 300 and the lens retainer 320 will be made with reference to the structure in FIGS. 13A and 14, and at this time, the description of these figures are omitted.

Meanwhile, the lens absorption board 302 which the circular and unprocessed eyeglass lens ML is sucked to the absorption cup 302*b* is provided in advance. In addition, the shaft portion 302*a* of the lens absorption board 302 is fitted to the hole section 305*c* which is provided at the hemispheric member 305 of the adjustable joint 301. At this time, the rotation restricting pin 302*c* of the shaft portion 302*a* is engaged with the rotation restricting groove 305*e* of the hemispheric member 305 so that the relative rotation by the shaft portion 302*a* and the hemispheric member 305 are restricted.

By the way, the lens absorption board 302 can be constituted by a conventional structure which a rotation restricting groove (positioning groove) 302*d* is provided at an end surface of the shaft portion 302*a* as shown in FIG. 24. In this case, by providing a rotation restricting convex portion which engages with the rotation restricting groove 302*d* at the hole section 305*c*, the relative rotation between the shaft portion 302*a* and the hemispheric member 305 about the axis can be restricted. FIG. 24 is a general explanatory view which the lens absorption board (lens fixing board) is fixed to the adjustable joint (spheroid connection, spheroid joint) 301 in such the way as described above.

Also, the lens absorption board 302 may be a type that retains the eyeglass les by using an adhesive or an agglutinant without utilizing the absorption cup 302*b* such as a rubber. Furthermore, a diameter of the lens absorption board 302 may be set substantially same as diameters of the both end surfaces of the hemispheric members 304 and 324 as shown in FIG. 25.

Subsequently, the pulse motor 24*d* is controlled in motion by the arithmetic control circuit 80 by operating the operation panels 6 and 7 so that the lens rotating shaft 24 is driven in the approaching direction to the side of the lens rotating shaft 23. At this time, by narrowing the distance between the adjustable joint 301 and the lens retainer 320 and attaching the lens retainer 320 to the rear side refractive surface of the eyeglass lens ML which is retained by the lens absorption board 302 of the adjustable joint 301 with a predetermined pressure, the eyeglass lens ML is clamped and held between the adjustable joint 301 and the lens retainer 320 like shown in FIG. 25. A clamping force in this case can be detected by detecting a driving current of the pulse motor 24*d* or the like. In addition, the clamping force may be detected by a pressure sensor or the like. This clamping force is, for example, set substantially 60 kg as a main clamping.

By clamping in such the way as described above, the hemispheric hole 303*a* and the hemispheric member 304, and the hemispheric member 304 and the hemispheric member 305 are mutually engaged with a certain degree or more of the friction, so that the rotation of the hemispheric members 304 and 305 in the extending directions of the key grooves 303*b* and 304*b* can be avoided even when the force (force in direction of the rotation during the grinding processing or a grinding force by the chamfering stone during the grinding processing) exceeding the predetermined level is acted. Similarly, the hemispheric hole 323*a* and the hemispheric member 324 are mutually engaged with a certain degree or more of the friction, so that the rotation of the hemispheric member 324 can be avoided even when the force exceeding the predetermined level is acted.

Accordingly, the eyeglass lens ML is retained between the lens rotating shafts 23 and 24 in such condition as described above.

(2) Reading of Lens Shape Data

When the measuring element 41 is not used, the arithmetic control circuit 80 positions the measuring element 41 at the stored position which the measuring element 41 is in the upraised state by controlling the drive motor 247 in motion.

In a starting stand-by state, when the main power supply is turned on, the arithmetic control circuit 80 judges as to whether or not data reading from the frame shape measuring device 1 is to be carried out.

More specifically, the arithmetic control circuit 80 judges as to whether or not the "data request" switch 7*c* on the operation panel 6 is pressed. When the "data request" switch 7*c* is pressed for requesting data, data of the lens shape information (θi, ρi) and the data on position of the hole for fixing the point frame are read from the frame shape measuring device 1 into the data reading area 83*b* of the RAM 83. The read data is stored (recorded) in any one of the storage areas m1 to m8 of the data memory 82, and then the layout screen is displayed on the liquid crystal display device 8.

(3) Calculation on Processing Data

Next, the arithmetic control circuit 80 allows the measurement shaft 42*a* to be in a state that it can be moved freely in the axis direction by turning the electromagnetic clutch 255 OFF prior to the measurement. Also, the arithmetic control circuit 80 controls the base drive motor 14 in motion to drive and control the carriage 22 so that the carriage 22 is advanced and retracted in the axis direction thereof by the screw shaft 15, and the eyeglass lens ML is moved integrally with the lens rotating shafts 23 and 24 in its axis direction so that the eyeglass lens ML is corresponded to the center of the feelers 101 and 102 of the measuring element 41.

Subsequently, the arithmetic control circuit 80 moves the lens rotating shafts 23 and 24 of the carriage 22 to the upper part along the guide slits 11*a*1 and 11*b*2 by raising the front end part of the carriage 22 by controlling the pulse motor 59 in motion so as to move the eyeglass lens (lens to be processed) ML which is held between the lens rotating shafts 23 and 24 to the upper part in such a manner that the eyeglass lens ML draws the arc. Then, the arithmetic control circuit 80 moves the measurement shaft 42*a* by controlling the drive motor 247 in motion so that the measuring element 41 is rotated from the stored position which the measuring element 41 is in upraised state to the using position which the measuring element 41 is horizontally prostrated, as a result, the feelers 101 and 102 of the measuring element 41 are faced toward both sides of the eyeglass lens ML.

In this condition, by controlling the base drive motor 14 in motion, the arithmetic control circuit 80 drives and controls the carriage 22 in its axis direction by the screw shaft 15 to move the eyeglass lens ML integrally with the lens rotating shafts 23 and 24 in the axis direction thereof and to the direction of the side of the feeler 101 of the measuring element 41, and the front side refractive surface of the eyeglass lens ML is contacted with the feeler 101. The arithmetic control circuit 80 further moves the carriage 22 more than the attached position of the eyeglass lens ML and the feeler 101, and stops the carriage 22.

As shown in FIG. 26, after attached (contacted) the feeler 101 to the front side refractive surface of the eyeglass lens (lens to be processed) ML in such the way as described above, the arithmetic control circuit 80 contacts and moves the feeler 101 and the front side refractive surface of the eyeglass lens ML relatively based on the lens shape data (θi, ρi) by controlling the lens rotating shaft drive motor 25 and the pulse motor 59 in motion based on lens shape information (θi, ρi) as the lens shape data.

At this time, the feeler 101 is moved left and right according to a curvature of the front side refractive surface of the eyeglass lens ML, and an amount of movement in the left and right is measured by the measuring unit 42 through the measurement shaft 42*a*. More specifically, the amount of movement of the feeler 101 in the left and right is measured by the magnescale 244 of the measuring unit 42.

The measurement signal from the magnescale 244 of the measuring unit 42 is inputted into the arithmetic control circuit 80, and the arithmetic control circuit 80 obtains the coordinate positions at the front side refractive surface of the eyeglass lens ML in the lens shape data (θi, ρi) based on the measurement signal received from the magnescale 244.

Similarly, by attaching (contacting) the feeler 102 to the rear side refractive surface of the eyeglass lens (lens to be processed) ML like shown in FIG. 27 by controlling the measuring unit 42 in motion and by controlling the lens rotating shaft drive motor 25 and the pulse motor 59 in motion based on the lens shape data (θi, ρi), the arithmetic control circuit 80 contacts and moves the feeler 102 and the rear side refractive surface of the eyeglass lens ML relatively based on the lens shape data (θi, ρi). At this time, the feeler 102 is moved left and right according to a curvature of the rear side refractive surface of the eyeglass lens ML, and the amount of movement in the left and right is measured by the measuring unit 42 through the measurement shaft 42*a*. The measurement signal from the magnescale 244 of the measuring unit 42 is inputted into the arithmetic control circuit 80, and the arithmetic control circuit 80 obtains the coordinate positions at the rear side refractive surface of the eyeglass lens ML in the lens shape data (θi, ρi) based on the measurement signal received from the magnescale 244.

Since a method disclosed in Japanese Patent Application No. 2001-30279 can be employed as a more specific method for obtaining the coordinate positions of the front side refractive surface or the coordinate positions of the rear side refractive surface as described above, its detailed description is therefore omitted.

Then, the lens thickness Wi is obtained by calculation from the coordinate positions of the front side refractive surface and the coordinate positions of the rear side refractive surface in the obtained lens shape data (θi, ρi).

Later, the arithmetic control circuit 80 obtains the processing data (θi', ρi') of the eyeglass lens ML corresponding to the lens shape data (θi, ρi) from data such as a pupil distance PD based on a formula of the eyeglass lens and a frame geometrical center-to-center distance FPD, a raised amount or the like, and is stored in the processing data storage area 83*a*. After such measurement is completed, the arithmetic control circuit 80 upraises the measuring element 41 to the stored position thereof by controlling the drive motor 247 in motion.

(4) Grinding Processing

Subsequently, the arithmetic control circuit 80 controls the motion of the grinding stone drive motor 30 with the motor driver 86*a* to control rotary-driving of the grinding stone 35 in a clockwise direction in FIG. 6. The grinding stone 35 includes the rough grinding stone (flat grinding stone), the grinding stone for a V-groove, the finish grinding stone or the like, as described above.

On the other hand, the arithmetic control circuit 80 controls the drive of the lens rotating shaft drive motor 25 through the pulse motor driver 86 based on the processing data (θi', ρi') stored in the processing data storage area 83*a* in order to control the rotation of the lens rotating shafts 23 and 24 and the eyeglass lens ML in a half-clockwise direction in FIG. 6.

At this time, the arithmetic control circuit 80 first controls the motion of the pulse motor driver 86 at the position where i=0 based on the processing data (θi', ρi') stored in the processing data storage area 83*a* in order to control the drive of the pulse motor 59. Accordingly, the screw shaft 58 is rotated reversely, and the stage 60 is lowered by predetermined amount. With the lowering of the stage 60, the lens rotating shaft holder 61 is integrally lowered with the stage 60 by the own weight of the carriage 22.

After the unprocessed circular eyeglass lens ML abuts a grinding surface 35*a* of the grinding stone 35 by the own weight of the carriage 22 as shown in FIG. 18A, only the stage 60 is lowered. When the stage 60 is separated downward from the lens rotating shaft holder 61 by such lowering, the separation is detected by the sensor S, and the detecting signals from the sensor S are inputted into the arithmetic control circuit 80. On receiving the detecting signals from the sensor S, the arithmetic control circuit 80 further controls the drive of the pulse motor 59 to slightly lower the stage 60 by the predetermined amount.

Accordingly, the grinding stone 35 attaches to the eyeglass lens ML as shown in FIG. 28, and the eyeglass lens ML is ground with the grinding stone 35 by the predetermined amount at the processing data (θi', ρi') where i=0. When the lens rotating shaft holder 61 is lowered with the grinding to abut the stage 60, the sensor S detects the abutment to output the detecting signals, and then the detecting signals are inputted into the arithmetic control circuit 80.

On receiving the detecting signals, the arithmetic control circuit 80 allows the eyeglass lens ML to be ground by the grinding stone 36 in a manner that the case where i=1 of the processing data (θi', ρi') is similar to that where i=0 thereof. The arithmetic control circuit 80 carries out such control until i=n (360°), so that the circumferential edge of the eyeglass lens ML is ground by the rough grinding stone which is not shown of the grinding stone 35 to be a radius vector ρi' for each angle θ' of the processing data (θi', ρi'). Accordingly, a part shown by oblique lines c as shown in FIG. 18B is ground and removed so that the lens shaped eyeglass lens ML is formed in such that shown in FIG. 18C.

By the way, the lens shape information (θi, ρi), drilling processing positions Pa (θa, ρa), and Pb (θb, ρb) which are described later, can be obtained by the arithmetic control circuit 80. Therefore, the process of processing operation can be curtailed by carrying out the drilling process to the lens (unprocessed circular eyeglass lens ML) for the point frame at first as shown in FIG. 18A' and then obtaining the eyeglass lens ML shown in FIG. 18C' by grinding and processing the part of the circumference of the lens for the point frame shown by the oblique lines c like shown in FIG. 18B' after forming fixing holes 400 and 401.

When drilling such fixing holes 400 and 401 like shown in FIG. 18D into the eyeglass lens ML by the drilling processing apparatus after processing the circumference of the eyeglass lens ML as shown in FIG. 18C, since a distance from the drilling processing positions to the lens circumference part is short, a cracking or a chipping tends to occur easily at the circumference part of the eyeglass lens ML as the lens thickness becomes thinner if drilling the fixing holes 400 and 401 by the drilling processing device into the eyeglass lens in such condition.

However, when the fixing holes 400 and 401 are drilled into the unprocessed circular eyeglass lens ML by the drilling processing device as shown in FIG. 18A' before the unprocessed circular eyeglass lens ML is ground and processed, since the distance from the drilling processing position to the lens circumference part is long, the cracking or the chipping becomes difficult to occur if drilling the fixing holes 400 and 401 into the unprocessed circular eyeglass lens ML by the drilling processing apparatus in such condition, as a result, the drilling process in high accuracy can be realized, and therefore, reliability in the processing operation can be enhanced.

(Chamfering Process)

After the lens shaped eyeglass lens ML is formed, a lens edge of the circumference of the eyeglass lens ML is chamfered and processed by the chamfering stones 224 and 225. The chamfering process is carried out as follows.

By normally rotating the drive motor 217, the arithmetic control circuit 80 raises the tip of the swing arm 204 by a predetermined amount by moving the one end part of the swing arm 204 to the upper part so as to raise the chamfering stones 224 and 225 fixed to the rotation shaft 223 to a predetermined position.

On the other hand, the arithmetic control circuit 80 corresponds the lens edge of the eyeglass lens ML retained between the lens rotating shafts 23 and 24 to a peripheral surface of the chamfering stone 224 by driving and controlling the base drive motor 14. Also, the arithmetic control circuit 80 corresponds the eyeglass lens ML to the chamfering stone 224 at a part where having an angle θ based on the processing data (θi', ρi') by synchronously rotating the lens rotating shafts 23 and 24 by driving and controlling the lens rotating shaft drive motor 25.

In this state, the arithmetic control circuit 80 lowers the lens rotating shafts 23 and 24 and the eyeglass lens ML by controlling the pulse motor 59 in motion. When the part of the eyeglass lens ML having the angle θ is abutted to the peripheral surface of the chamfering stone 224, the sensor S detects the abutment thereof, and the detecting signals are inputted into the arithmetic control circuit 80. Moreover, the arithmetic control circuit 80 stops the driving of the pulse motor 59 when received the detecting signals. A position where the part of the eyeglass lens ML having the angle θ is abutted to the peripheral surface of the chamfering stone 224 becomes a reference position for carrying out the chamfering process of the eyeglass lens ML.

After separating the eyeglass lens ML from the chamfering stone 224 by raising the lens rotating shafts 23 and 24 and the eyeglass lens ML by the predetermined amount by driving and controlling the pulse motor 59 controlled by the arithmetic control circuit 80, the arithmetic control circuit 80 drives and controls the drive motor 228 so as to rotate and drive this drive motor 228. The rotation of the drive motor 228 is transmitted to the rotation shaft 223 through the output shaft 229, the pulley 231, the belt 233 and the pulley 232. Accordingly, the rotation shaft 223 is rotated, and the chamfering stones 224 and 225 and the grooving cutter 226 which are fixed to the rotation shaft 223 are rotated.

In this state, the chamfering process (rough chamfering grinding) is carried out to the lens edge of the eyeglass lens ML by abutting the chamfering atone 224 to the lens edge of the eyeglass lens ML by driving and controlling the base drive motor 14, the lens rotating shaft drive motor 25 and the pulse motor 59 based on the reference position and the processing data (θi', ρi').

Similarly, the chamfering is carried out to the eyeglass lens ML with the chamfering stone 225 subsequently which is used for the finishing.

(5) Drilling Process

If the eyeglass lens ML ground and chamfered as described above is for the point frame, it is required to drill the fixing hole (hole for fixing point frame) 400 for fixing the bridge to the nose pad side of the eyeglass lens ML and the fixing hole (hole for fixing point frame) 401 for fixing the fixing attachment which is to fix the temple to the temple side. Meanwhile, the nose pad has been fixed to the bridge.

Therefore, a fact that it is the process for the point frame is inputted into the arithmetic control circuit 80 by the control panels 6 and 7 before carrying out the processing. Accordingly, when the process of grinding the circumference of the eyeglass lens ML to the lens shape based on the processing data (θi', ρi') is finished, the arithmetic control circuit 80 prepares for carrying out the drilling process. Hereunder, description of a preparing operation for the drilling process will be made with reference to FIG. 22.

(Calculation on Drilling Processing Position)

When the process of grinding the circumference of the eyeglass lens ML is finished, the arithmetic control circuit 80 obtains a curvature change φi of the front side refractive surface of the eyeglass lens ML from a change in the lens thickness Wi in the lens shape data (θi, ρi) obtained by the measurement.

On the other hand, the arithmetic control circuit 80 obtains the drilling processing positions Pa (θa, ρa), and Pb (θb, ρb) for drilling the fixing holes 400 and 401 from the lens shape data (θi, ρi) and the curvature change φi of the front side refractive surface of the eyeglass lens ML. Here, since methods for calculating the drilling processing positions Pa (θa, ρa), and Pb (θb, ρb) are the same, the description on the method for calculating the drilling processing position Pa (θa, ρa) will be made hereinafter, and the description on the method for calculating the drilling processing position Pb (θb, ρb) is omitted.

A case that the processing position of the fixing hole 400 corresponds to the drilling processing position Pa (θa, ρa) in FIG. 21 will be described. When the position of the lens edge which corresponds to the drilling processing position Pa (θa, ρa) is obtained from the lens shape data (θi, ρi) by presuming that the lens edge is Pj (θj, ρj), a point Pa from a radius vector ρj of the lens edge Pj (θj, ρj) to direction of a center O of the eyeglass lens ML by a Δx becomes the drilling processing position Pa (θa=θj, ρa) in FIG. 22.

By the way, the curvature change φi can be obtained by measuring a vicinity of the drilling processing position Pa (θa=θj, ρa) with the measuring element 41 in advance. In practice, the curvature change φi is obtained by obtaining the drilling processing position Pa (θa=θj, ρa) based on the lens shape data (θi, ρi) and relatively moving the measuring element 41 toward a direction of the radius vector to the eyeglass lens ML by setting the drilling processing position Pa (θa=θj, ρa) as a center. This movement can be carried out by elevating and lowering the tip of the carriage 22 by the pulse motor 59. Therefore, the curvature change φi is obtained by memorizing a moving position ΔZ of the measuring element 41 toward an axis Z direction of the lens rotating shafts 23 and 24 at the time when the measuring element 41 is moved in the direction of the radius vector via the drilling processing position Pa (θa=θj, ρa), thereby the curvature change φi is obtained.

In addition, when drilling the fixing hole 400 into the eyeglass lens ML by the drill 221, an angle of gradient β is obtained from the drilling processing position Pa (θa, ρa) and a curvature of the front side refractive surface to slant the eyeglass lens ML by the measuring element 41 in such a manner that the axis of the drill 221 becomes in perpendicular to a tangent in the position of the drilling processing position Pa (θa, ρa) of the eyeglass lens ML. Here, when presuming that the axis of the lens rotating shafts 23 and 24 is Z, and a direction in perpendicular to the axis Z is a Y axis, then the β is the angle of gradient to the Y axis.

At this time, a movement data regarding how much and in which direction should the eyeglass lens ML be moved in the drilling processing position Pa (θa, ρa) so that the axis of the drill 221 becomes in perpendicular to the tangent in the position of the drilling processing position Pa (θa, ρa) of the eyeglass lens ML is obtained. Meanwhile, the axis of the drill 221 is presumed to be arranged parallel to the axis Z of the lens rotating shafts 23 and 24.

In this state, when presuming that the tangent of the front side refractive surface in the drilling processing position Pa (θa, ρa) is Q1, a normal line of the front side refractive surface in the drilling processing position Pa (θa, ρa) is Q2, and an angle between the normal line Q2 and the axis Z is γ, then a condition that the normal line Q2 becomes parallel to the axis Z is a drilling processing position Pa' (θa, ρa') when the eyeglass lens ML is slanted to the Y axis by the angle β (=γ−α). The angle between the normal line Q2 in the drilling processing position Pa (θa, ρa) and the axis Z can be obtained by the lens shape data (θi, ρi) and the curvature change φi of the front side refractive surface of the eyeglass lens ML.

At this time, if a center of the thickness of the eyeglass lens ML on the axis Z of the lens rotating shafts 23 and 24 is presumed as O, the eyeglass lens ML can be slanted by setting the center O as a center. Accordingly, the center O is presumed as a "0" position, a position from the center O to the drilling processing position Pa (θa, ρa) in the Z direction is presumed as a Z1, a distance from the center O to the drilling processing position Pa (θa, ρa) is presumed as ra, and an angle between the θa and the ra in the drilling processing position Pa (θa, ρa) is presumed as an α.

Also, when the eyeglass lens ML is slanted by the angle β, a change in the drilling processing position Pa' (θa, ρa') is presumed as a Δρa, and a position from the center O to the drilling processing position Pa' (θa, ρa') toward the Z direction is presumed as a Z2, so as to obtain the movement data ρa' and an amount of movement Δz in the Z direction.

This Δz can be obtained as a following formula:

$$\Delta z=|Z1|+|Z2|=Z1+\sin\beta=Z1+\sin\gamma$$

Also, the ra and the Z1 have a relation of $$Z1=ra\cdot\sin\alpha$$

Therefore, the ra becomes $$ra=Z1/\sin\alpha$$

In addition, the ρa' can be obtained as $$\rho a'=\rho a-\Delta\rho a=ra\cdot\cos\beta=ra\cdot\cos(\gamma-\alpha)$$
$$=(Z1/\sin\alpha)\cdot\cos(\gamma-\alpha)$$

(Detection of Amount of Movement ΔZa by Pressing of Rear Side Refractive Surface by Feeler 102)

When slanting the eyeglass lens ML based on the movement data ρa' and the amount of movement Δz in the Z direction, the feeler 102 of the measuring element 41 is required to be moved to the front side by abutting the feeler 102 to the rear side refractive surface of the eyeglass lens ML.

Here, in a condition which the eyeglass lens ML is not slanted, a position Z3 in the Z axis direction of a part of the drilling processing position Pa (θa, ρa) in the rear side refractive surface of the eyeglass lens ML can be obtained by the position of the rear side refractive surface in the lens edge Pj (θj, ρj) of the eyeglass lens ML and the curvature change of the rear side refractive surface. In addition, a lens thickness Wa at this position can also be obtained from a lens thickness Wj and the curvature change ϕi of the rear side refractive surface and the curvature change ϕi of the front side refractive surface. By the way, the position Z3 in the Z axis direction of the drilling processing position Pa (θa, ρa) and the lens thickness Wa may be obtained by the measurement by the measuring element 41 after carrying out the measurement based on the lens shape data (θi, ρi) of the eyeglass lens ML.

Furthermore, by presuming that a lens thickness which is in a parallel direction to the axis Z of the eyeglass lens ML when slanting the eyeglass lens ML by the angle β is a lens thickness Wa', the lens thickness Wa' can be obtained as:

$$Wa' = Wa \cdot \cos\gamma$$

In addition, a position Z4 in the axis Z direction of the rear side refractive surface of the eyeglass lens ML in the position of the lens thickness Wa' is obtained as:

$$Z4 = Z2 - Wa \cdot \cos\gamma$$

Therefore, the eyeglass lens ML can be slanted by the angle β by carrying out a displacement by a pressing to the rear side refractive surface of the eyeglass lens ML toward the front side refractive surface in the part of the drilling processing position Pa (θa, ρa) by an amount of movement ΔZa.

The amount of movement ΔZa can be obtained as:

$$\Delta Za = |Z3| + |Z2 - Wa'|$$
$$= Z3 + |Z2 - Wa \cdot \cos\gamma|$$

The angle of gradient or the movement data is similarly obtained as well as to the drilling processing position Pb (θb, ρb).

(Provisional Clamping of the Eyeglass Lens ML)

Next, the arithmetic control circuit 80 sets the eyeglass lens ML in a provisional clamped condition between the adjustable joint 301 and the lens retainer 320 by controlling the pulse motor 24*d* in motion to drive the lens rotating shaft 24 in the direction separating slightly from the lens rotating shaft 23 so that the distance between the adjustable joint 301 and the lens retainer 320 is widened, accordingly a pressing force of the lens retainer 320 to the rear side refractive surface of the eyeglass lens ML retained by the lens absorption board 302 of the adjustable joint 301 is loosened to 10 kg for example (by the way, this numerical value is one of the example, and the value may be set larger or oppositely, smaller, and the value can also be changed depending on the thickness of the eyeglass lens) like shown in FIG. 29, thereby the eyeglass lens ML is in the provisional clamped condition between the adjustable joint 301 and the lens retainer 320. At this time, when the eyeglass lens ML is pressed by a light force toward the extending directions of the lens rotating shafts 23 and 24, the adjustable joints 301 and 321 are rotated, and the eyeglass lens ML becomes such a condition being slanted in the pressed direction.

(Slanting and Adjusting for Drilling of Eyeglass Lens ML)

Next, the arithmetic control circuit 80 controls the base drive motor 14 in motion to drive and control the carriage 22 so that the carriage 22 is advanced and retracted in the axis direction thereof by the screw shaft 15, and the eyeglass lens ML is moved integrally with the lens rotating shafts 23 and 24 in its axis direction so that the eyeglass lens ML is corresponded to the center of the feelers 101 and 102 of the measuring element 41.

Then, the arithmetic control circuit 80 moves the lens rotating shafts 23 and 24 of the carriage 22 to the upper part along the guide slits 11*a*1 and 11*b*2 by raising the front end part of the carriage 22 by controlling the pulse motor 59 in motion so as to move the eyeglass lens (lens to be processed) ML which is held between the lens rotating shafts 23 and 24 to the upper part in such a manner that the eyeglass lens ML draws the arc.

Subsequently, the arithmetic control circuit 80 moves the measurement shaft 42*a* by controlling the drive motor 247 in motion so that the measuring element 41 is rotated from the stored position which the measuring element 41 is in upraised state to the using position which the measuring element 41 is horizontally prostrated, as a result, the feelers 101 and 102 of the measuring element 41 are faced toward the both sides of the eyeglass lens ML. Also, the arithmetic control circuit 80 turns the electromagnetic clutch 255 ON so as to set the measurement shaft 42*a* in a condition capable of advancing and retracting in the axis direction by the drive motor 253 which is a pulse motor along with facing the feelers 101 and 102 of the measuring element 41 toward the both sides of the eyeglass lens ML as stated above.

Furthermore, by controlling the lens rotating shaft drive motor 25 in motion, the arithmetic control circuit 80 transmits the rotation of the power transmission shaft 25*a* to the lens rotating shaft 23 through the drive gear 26 and the driven gear 26*a* so that the lens rotating shaft 23 and the pulley 27 are integrally rotated and driven. The rotation of the pulley 27 is transmitted to the pulley 29 through the driving side belt 28*d*, the transmission pulley 28*a*, the transmission shaft 28*c*, transmission pulley 28*b* and the driven side belt 28*e* so that the pulley 29 and the lens rotating shaft 24 are integrally rotated. At the time of this control, the arithmetic control circuit 80 sets a rotation angle θa of the lens rotating shafts 23 and 24 (that is, the eyeglass lens ML) and the tip of the feeler 102 to be correspond.

Moreover, the arithmetic control circuit 80 sets the tip of the feeler 102 to be correspond to a radius vector ρa in the drilling processing position Pa (θa, ρa) of the eyeglass lens ML retained between the lens rotating shafts 23 and 24 by controlling the pulse motor 59 in motion to elevate and lower the tip of the carriage 22 with the lens rotating shafts 23 and 24.

In this state, the arithmetic control circuit 80 controls the drive motor 253 in motion to transmit the rotation of the drive motor 253 to the measurement shaft 42*a* through the gear rotation mechanism 254, the electromagnetic clutch 255, the gear 252 and the rack 251, so that the measurement shaft 42*a* is controlled and driven in such a manner that the measurement shaft 42*a* is advanced and retracted. Accordingly, the feeler 102 of the measurement element 41 is moved to the side of the rear side refractive surface of the eyeglass lens ML, and the tip of the feeler 102 is contacted to the rear side refractive surface of the eyeglass lens ML like a full line in FIG. 20 at the position corresponding to the drilling processing position Pa (θa, ρa).

After attached (contacted) the feeler 102 to the rear side refractive surface of the eyeglass lens (lens to be processed)

in such a way as mentioned above, the arithmetic control circuit 80 further controls the drive motor 253 in motion to carry out the displacement of the part corresponding to the drilling processing position Pa (θa, ρa) in the rear side refractive surface of the eyeglass lens ML by pressing with the feeler 102 toward the position indicated with the full line in FIG. 20 by the amount of movement ΔZa. As a result, the part of the drilling processing position Pa (θa, ρa) in the front side refractive surface of the eyeglass lens ML is slanted by the angle β, and the drilling processing position Pa (θa, ρa) is moved to the drilling processing position Pa' (θa, ρa').

Accordingly, the normal line Q2 in the drilling processing position Pa' (θa, ρa') of the front side refractive surface of the eyeglass lens ML becomes parallel to the axis Z and the drill 221, that is to say, the tangent Q1 in the drilling processing position Pa' (θa, ρa') and the axis of the drill 221 become in a condition that they can be in perpendicular.

(Main Clamping)

Next, after driving the measurement shaft 42*a* in the axis direction in such a manner as to separate the tip of the feeler 102 from the rear side refractive surface by a predetermined amount by controlling the drive motor 253 in motion, the arithmetic control circuit 80 rotates the measurement shaft 42*a* by controlling the drive motor 247 so as to rotate the measuring element 41 to the upraised stored position from the using position, and as a result, the feelers 101 and 102 of the measuring element 41 are removed from the both sides of the eyeglass lens ML.

In this state, the arithmetic control circuit 80 drives the lens rotating shaft 24 to the approaching direction of the lens rotating shaft 23 to slightly narrow the distance between the adjustable joint 301 and the lens retainer 320 by controlling the pulse motor 24*d* in motion, so that the pressing force of the lens retainer 320 to the rear side refractive surface of the eyeglass lens ML retained by the lens absorption board 302 of the adjustable joint 301 is strengthened, therefore the eyeglass lens ML is in the main clamped condition between the adjustable joint 301 and the lens retainer 320. The clamping force at this time is presumed as 60 kg for example.

By clamping in such the way as described above, the hemispheric hole 303*a* and the hemispheric member 304, and the hemispheric member 304 and the hemispheric member 305 are mutually engaged with the certain degree or more of the friction, so that the rotation of the hemispheric members 304 and 305 in the extending directions of the key grooves 303*b* and 304*b* can be avoided even when the force (force in direction of the rotation during the grinding processing or the grinding power by the chamfering stone during the grinding processing) exceeding the predetermined level is acted. Similarly, the hemispheric hole 323*a* and the hemispheric member 324 are mutually engaged with the certain degree or more of the friction, so that the rotation of the hemispheric member 324 can be avoided even when the force exceeding the predetermined level is acted.

(Drilling Process)

In the clamped condition as stated above, the arithmetic control circuit 80 rotates the lens rotating shafts 23 and 24 (more specifically, the eyeglass lens ML) in such a manner that the drilling processing position Pa' (θa, ρa') of the eyeglass lens ML is positioned at the side of the drill 221 like shown in FIG. 19 by controlling the lens rotating shaft drive motor 25 in motion. At this time, the lens rotating shafts 23*a* and 24 (that is, the eyeglass lens ML) are rotated so that the drilling processing position Pa' (θa, ρa') of the eyeglass lens ML is corresponded to the tip of the drill 221 when the drill 221 is moved to the side of the eyeglass lens ML by the predetermined amount based on the radius vector ρa.

In addition, by normally rotating the drive motor 217, the arithmetic control circuit 80 rotates the one end part of the swing arm 204 to the upper part to raise the tip of the drill 221 by a predetermined amount, and corresponds the tip of the drill 221 to the drilling processing position Pa' (θa, ρa') of the eyeglass lens ML. At this position, the arithmetic control circuit 80 rotates and drives the drill 221 by actuating the drive motor 228.

Subsequently, by actuating the base drive motor 14, the arithmetic control circuit 80 drives the carriage 22 and the lens rotating shafts 23 and 24 to the axis Z direction of the lens rotating shafts 23 and 24 with the eyeglass lens ML, and moves the tip of the drill 221 toward the drilling processing position Pa' (θa, ρa') of the front side refractive surface of the eyeglass lens ML. With this movement, the drill 221 is adapted to be abutted to the drilling processing position Pa' (θa, ρa') of the eyeglass lens ML, and the drilling process is performed.

When the drilling process is finished, the arithmetic control circuit 80 separates the drill 221 from the eyeglass lens ML by returning the carriage 22 and the eyeglass lens ML to an original state by reversing the base drive motor 14. Subsequently, by reversing the drive motor 217, the arithmetic control circuit 80 returns the swing arm 204 to its original state by rotating the one end part thereof to the lower part.

Later, the arithmetic control circuit 80 carries out the similar drilling control to the drilling processing position Pb (θb, ρb) of the eyeglass lens ML.

By the way, although the hole for fixing the point frame is set to be drilled from the front side refractive surface of the eyeglass lens ML in the embodiment described above, it is not necessarily limited to drill the hole from the front side refractive surface. For example, the hole for fixing the point frame may be drilled from the rear side refractive surface of the eyeglass lens ML.

Also, although the axis of the drill 221 and the tangent of the drilling position of the refractive surface of the eyeglass lens are set to be substantially in perpendicular, an angle between the axis of the drill 221 and the tangent of the drilling position of the refractive surface of the eyeglass lens ML may be set arbitrary. For example, the angle between the axis of the drill 221 and the tangent of the drilling position of the refractive surface of the eyeglass lens ML may be set in such a manner that the drilling can be carried out so that the hole for fixing the point frame becomes parallel to the lens edge.

[Embodiment 2 of the Present Invention]

[Constitution]

Although the eyeglass lens ML is slanted and adjusted by driving the measurement shaft 42*a* in such a manner as to be advanced and retracted in the axis direction with the measurement shaft advancing-retracting means 246 in the embodiment described above, the present invention is not necessarily limited by the above structure. For example, the structure may be set like an embodiment 2 of the present invention shown in FIGS. 30 to 38. Meanwhile, although the basic structure in the embodiment 2 of the present invention is same as the structure in the embodiment 1 and therefore its illustration is omitted, the description of the embodiment 2 of the present invention will be made by using the structure in the embodiment 1 of the present invention. By the way, FIGS. 30 to 38 abbreviatedly show the structure in the FIGS.

13A and 14 by omitting partial of the structure in FIGS. 13A and 14, therefore, the lens absorption device 300 and the lens retainer 320 in FIGS. 30 to 38 actually have the structure shown in FIGS. 13A and 14. Accordingly, the detailed descriptions of the lens absorption device 300 and the lens retainer 320 will be made with reference to the structure in FIGS. 13A and 14, and at this time, the description of these figures are omitted.

In FIG. 30, the measuring element 41 is in the condition being prostrated to the using position. At the successively provided portion 100*a* of the measuring element 41 at the using position, an engaging concave portion 100*d* faces to the rear wall 11*c* which forms the processing chamber 4 in FIGS. 3A and 4 is formed. Also, at the rear wall 11*c* in FIGS. 3A and 4, an engaging member (movement restricting member, locking member) 100*e* is retained which is capable of advancing and retracting to the engaging concave portion 100*d* of the measuring element 41 and is retained incapable of moving in the extending direction of the axis of the measurement shaft 42*a*.

Furthermore, the engaging member 100*e* is set to engage with the engaging concave portion 100*d* of the measuring element 41 by a solenoid 100*f* as driving means. Meanwhile, means other than the solenoid can be used for the driving means. For example, by advancing and retracing a rack by a pinion driven by a motor, the engaging member 100*e* can be set to be moved in such a manner as to be advanced and retracted.

[Operation]

(Arrangement of the Eyeglass Lens to the Measuring Element 41)

In the structure described above, the arithmetic control circuit 80 controls the base drive motor 14 in motion to drive and control the carriage 22 so that the carriage 22 is advanced and retracted in the axis direction thereof by the screw shaft 15, and the eyeglass lens ML is moved integrally with the lens rotating shafts 23 and 24 in its axis direction so that the eyeglass lens ML is corresponded to the center of the feelers 101 and 102 of the measuring element 41.

Subsequently, the arithmetic control circuit 80 moves the lens rotating shafts 23 and 24 of the carriage 22 to the upper part along the guide slits 11*a*1 and 11*b*2 by raising the front end part of the carriage 22 by controlling the pulse motor 59 in motion, so as to move the eyeglass lens (lens to be processed) ML which is held between the lens rotating shafts 23 and 24 to the upper part in such a manner that the eyeglass lens ML draws the arc.

(Locking of the Measuring Element 41)

Then, the arithmetic control circuit 80 moves the measurement shaft 42*a* by controlling the drive motor 247 in motion so that the measuring element 41 is rotated from the stored position which the measuring element 41 is in upraised state to the using position which the measuring element 41 is horizontally prostrated, as a result, the feelers 101 and 102 of the measuring element 41 are faced toward the both sides of the eyeglass lens ML.

In this state, the arithmetic control circuit 80 advances the engaging member 100*e* toward the engaging concave portion 100*d* by controlling the solenoid 100*f* in motion. Accordingly, the engaging member 100*e* is engaged with the engaging concave portion 100*d* like shown in FIG. 30A, and the measuring element 41 is adapted to be in the condition incapable of moving in the extending direction of the measurement shaft 42*a*.

(Provisional Clamping of the Eyeglass Lens ML)

Next, the arithmetic control circuit 80 sets the eyeglass lens ML in the provisional clamped condition between the adjustable joint 301 and the lens retainer 320 by controlling the pulse motor 24*d* in motion to drive the lens rotating shaft 24 in the direction separating slightly from the lens rotating shaft 23 so that the distance between the adjustable joint 301 and the lens retainer 320 is widened, accordingly the pressing force of the lens retainer 320 to the rear side refractive surface of the eyeglass lens ML retained by the lens absorption board 302 of the adjustable joint 301 is loosened to 10 kg for example (by the way, this numerical value is one of the example, and the value may be set larger or oppositely, smaller, and the value can also be changed depending on the thickness of the eyeglass lens) like shown in FIG. 29, thereby the eyeglass lens ML is in the provisional clamped condition between the adjustable joint 301 and the lens retainer 320.

At this time, when the eyeglass lens ML is pressed by the light force toward the extending directions of the lens rotating shafts 23 and 24, the adjustable joints 301 and 321 are rotated, and the eyeglass lens ML becomes such condition being slanted in the pressed direction.

(Slanting and Adjusting)

Furthermore, by controlling the lens rotating shaft drive motor 25 in motion, the arithmetic control circuit 80 transmits the rotation of the power transmission shaft 25*a* to the lens rotating shaft 23 through the drive gear 26 and the driven gear 26*a* so that the lens rotating shaft 23 and the pulley 27 are integrally rotated and driven. The rotation of the pulley 27 is transmitted to the pulley 29 through the driving side belt 28*d*, the transmission pulley 28*a*, the transmission shaft 28*c*, transmission pulley 28*b* and the driven side belt 28*e* so that the pulley 29 and the lens rotating shaft 24 are integrally rotated. At the time of this control, the arithmetic control circuit 80 sets the rotation angle θa of the lens rotating shafts 23 and 24 (that is, the eyeglass lens ML) and the tip of the feeler 102 to be correspond.

Moreover, the arithmetic control circuit 80 sets the tip of the feeler 102 to be correspond to the radius vector ρa in the drilling processing position Pa (θa, ρa) of the eyeglass lens ML retained between the lens rotating shafts 23 and 24 by controlling the pulse motor 59 in motion to elevate and lower the tip of the carriage 22 with the lens rotating shafts 23 and 24. This drilling processing position Pa (θa, ρa) is, for example, the ear side.

Figure 30B:
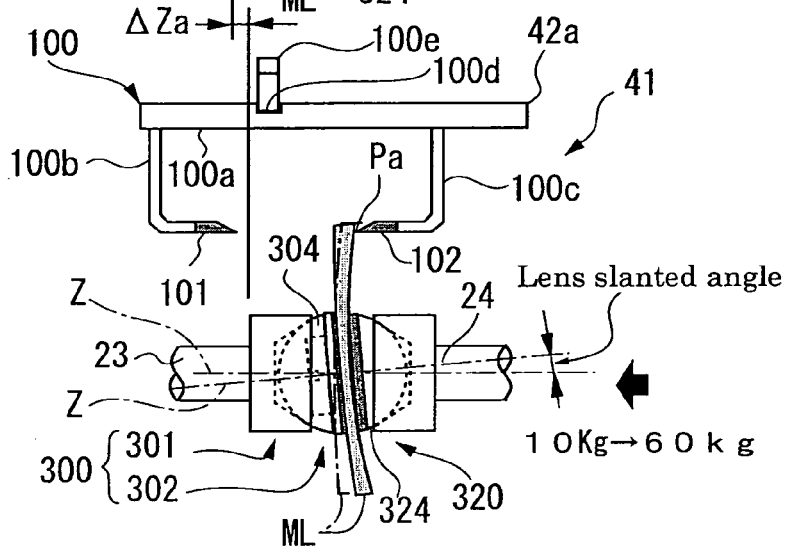

In this state, the arithmetic control circuit 80 drives the carriage 22 and the lens rotating shafts 23 and 24 in the axis Z direction (direction indicated by an arrow Za1 in FIG. 30A) with the eyeglass lens ML by actuating the base drive motor 14, and carries out the displacement to the part corresponding to the drilling processing position Pa (θa, ρa) in the rear side refractive surface of the eyeglass lens ML by pressing with the feeler 102 like shown in FIG. 30B by the amount of movement ΔZa. Accordingly, the part of the drilling processing position Pa (θa, ρa) in the front side refractive surface of the eyeglass lens ML is slanted by the angle β, and the drilling processing position Pa (θa, ρa) is moved to the drilling processing position Pa' (θa, ρa').

As a result, the normal line Q2 in the drilling processing position Pa' (θa, ρa') of the front side refractive surface of the eyeglass lens ML becomes parallel to the axis Z and the drill 221, that is to say, the tangent Q1 in the drilling processing position Pa' (θa, ρa') and the axis of the drill 221 become in the condition that they can be in perpendicular.

(Main Clamping)

Next, the arithmetic control circuit 80 drives the lens rotating shaft 24 to the approaching direction of the lens rotating shaft 23 to slightly narrow the distance between the adjustable joint 301 and the lens retainer 320 by controlling the pulse motor 24*d* in motion so that the pressing force of the lens retainer 320 to the rear side refractive surface of the eyeglass lens ML retained by the lens absorption board 302 of the adjustable joint 301 is strengthened, therefore the eyeglass lens ML is in the main clamped condition between the adjustable joint 301 and the lens retainer 320. The clamping force at this time is presumed as 60 kg for example.

By clamping in such the way as described above, the hemispheric hole 303*a* and the hemispheric member 304, and the hemispheric member 304 and the hemispheric member 305 are mutually engaged with the certain degree or more of the friction, so that the rotation of the hemispheric members 304 and 305 in the extending directions of the key grooves 303*b* and 304*b* can be avoided even when the force (force in direction of the rotation during the grinding processing or the grinding force by the chamfering stone during the grinding processing) exceeding the predetermined level is acted. Similarly, the hemispheric hole 323*a* and the hemispheric member 324 are mutually engaged with the certain degree or more of the friction, so that the rotation of the hemispheric member 324 can be avoided even when the force exceeding the predetermined level is acted.

(Measuring)

In the above mentioned state, by controlling the solenoid 100*f* in motion, the arithmetic control circuit 80 pulls out and removes the engaging member 100*e* from the engaging concave portion 100*d*, and lifts the restriction of the movement of the measuring element 41 in the axis direction of the measurement shaft 42*a*.

Next, the arithmetic control circuit 80 moves the lens rotating shafts 23 and 24 of the carriage 22 to the upper part along the guide slits 11*a*1 and 11*b*2 by raising the front end part of the carriage 22 by controlling the pulse motor 59 in motion, so as to move the eyeglass lens (lens to be processed) ML which is held between the lens rotating shafts 23 and 24 to the upper part in such a manner that the eyeglass lens ML draws the arc. Accordingly, the feeler 102 of the measuring element 41 is moved to the side of the center of the eyeglass lens ML along the rear side refractive surface of the eyeglass lens ML in such a manner that is indicated with an arrow Y1 like in FIG. 31. At this time, in the rotation angle θa, changes in a transition-radius vector ρn (n=0, 1, 2, 3, . . . j) of moving positions by the feeler 102 toward the center of the eyeglass lens ML can be obtained by an amount of elevation and lowering of the lens rotating shafts 23 and 24 driven by the pulse motor 59.

Also, when the feeler 102 of the measuring element 41 is moved to the side of the center of the eyeglass lens ML along the rear side refractive surface of the eyeglass lens ML, the measuring element 41 is moved in such a manner as to be advanced and retracted like shown by an arrow Za2 in the axis direction of the measurement shaft 42*a* by the rear side refractive surface of the eyeglass lens ML. The moving positions of the measuring element 41 in the axis direction of the measurement shaft 42*a* is detected by the magnescale 244 as an axis direction-transition position Zn (n=0, 1, 2, 3 . . . j).

In addition, the arithmetic control circuit 80 stores the transition-radius vector ρa and the axis direction-transition position Zn in the data memory 82 as gradient information (ρn, Zn), and judges whether or not an amount of slanting and adjusting of the eyeglass lens ML is same as an amount of gradient obtained in advance from the gradient information (ρn, Zn).

When the arithmetic control circuit 80 judges from the gradient information (ρn, Zn) that the amount of slanting and adjusting of the eyeglass lens ML is same as the amount of gradient obtained in advance, the arithmetic control circuit 80 drives the measurement shaft 42*a* in the axis direction in such a manner that the tip of the feeler 102 is separated from the rear side refractive surface by a predetermined amount by controlling the drive motor 253 in motion. Then, the arithmetic control circuit 80 rotates the measurement shaft 42*a* by controlling the drive motor 247 in motion, and rotates the measuring element 41 from the using position to the upraised stored position so that the feelers 101 and 102 of the measuring element 41 are removed from the both sides of the eyeglass lens ML, thereby the condition becomes such that shown in FIG. 32A.

When the arithmetic control circuit 80 judges from the gradient information (ρn, Zn) that the amount of slanting and adjusting of the eyeglass lens ML is not same as the amount of gradient obtained in advance, the arithmetic control circuit 80 carries out the above mentioned slanting and adjusting again until the amount of slanting and adjusting of the eyeglass lens ML becomes the amount of gradient obtained in advance from the gradient information (ρn, Zn). Then, as mentioned above, the arithmetic control circuit 80 removes the feelers 101 and 102 of the measuring element 41 from the both sides of the eyeglass lens ML, and the condition becomes such that shown in FIG. 32A.

(Drilling Process)

In the above mentioned state, the arithmetic control circuit 80 rotates the lens rotating shafts 23 and 24 (more specifically, the eyeglass lens ML) in such a manner that the drilling processing position Pa' (θa, ρa') of the eyeglass lens ML is positioned at the side of the drill 221 like shown in FIG. 19 by controlling the lens rotating shaft drive motor 25 in motion. At this time, the lens rotating shafts 23 and 24 (that is, the eyeglass lens ML) are rotated so that the drilling processing position Pa' (θa, ρa') of the eyeglass lens ML is corresponded to the tip of the drill 221 when the drill 221 is moved to the side of the eyeglass lens ML by the predetermined amount based on the radius vector ρa.

In addition, by normally rotating the drive motor 217, the arithmetic control circuit 80 rotates the one end part of the swing arm 204 to the upper part to raise the tip of the drill 221 by the predetermined amount, and corresponds the tip of the drill 221 to the drilling processing position Pa' (θa, ρa') of the eyeglass lens ML. At this position, the arithmetic control circuit 80 rotates and drives the drill 221 by actuating the drive motor 228.

Subsequently, by actuating the base drive motor 14, the arithmetic control circuit 80 drives the carriage 22 and the lens rotating shafts 23 and 24 to the axis Z direction (left direction) of the lens rotating shafts 23 and 24 with the eyeglass lens ML as shown by an arrow Za3 in FIG. 33, and moves the tip of the drill 221 toward the drilling processing position Pa' (θa, ρa') of the front side refractive surface of the eyeglass lens ML. With this movement, the drill 221 is adapted to be abutted to the drilling processing position Pa' (θa, ρa') of the eyeglass lens ML like in FIG. 34, and the drilling process is performed.

When the drilling process is finished, the arithmetic control circuit 80 separates the drill 221 from the eyeglass lens ML by returning the carriage 22 and the eyeglass lens ML to an original state by displacing the carriage 22 and the eyeglass lens ML in the Z direction (right direction) shown by an arrow Za4 in FIG. 35A by reversing the base drive motor 14. Subsequently, by reversing the drive motor 217, the arithmetic control circuit 80 returns the swing arm 204 to its original state by rotating the one end part thereof to the lower part. Accordingly, the fixing hole 400 is formed at the ear side of the eyeglass lens ML like in FIGS. 35A and 35B.

Later, the arithmetic control circuit 80 carries out the similar drilling control to the drilling processing position Pb (θb, ρb) at the nose side in the eyeglass lens ML such as to the nose side.

More specifically, as shown in FIG. 36A, the clamping force to the eyeglass lens ML by the lens rotating shafts 23 and 24 is set substantially 10 kg as the provisional clamping as similar to the above described, and the eyeglass lens ML is driven in the arrow Za1 direction integrally with the lens rotating shafts 23 and 24, and the rear side refractive surface of the eyeglass lens ML is pressed with the feeler 102 by the ΔZ, so that the eyeglass lens ML is slanted like in FIG. 36B.

Subsequently, after the clamping force to the eyeglass lens ML by the lens rotating shafts 23 and 24 is set substantially 60 kg as the main clamping as similar to the above described, the curvature shape of the rear side refractive surface of the eyeglass lens ML is measured by the feeler 102 of the measuring element 41 so as to obtain the slant of the eyeglass lens ML, and when the amount of slanting and adjusting becomes the amount of gradient obtained in advance, the feelers 101 and 102 of the measuring element 41 are removed from the both sides of the eyeglass lens ML as described above.

Subsequently, the eyeglass lens ML is moved to the arrow Za3 direction like in FIG. 37 as similar to the above described so that the drilling is carried out into the drilling processing position Pb (θb, ρb) at the nose side in the eyeglass lens ML by the drill 221, and then, by separating the drill 221 from the eyeglass lens ML as shown by the arrow Za4 in FIG. 38 in such a manner as described above, the fixing hole 401 is formed like in FIG. 38B.

As described above, the lens grinding processing apparatus in the embodiment of the present invention has the lens rotating shafts 23 and 24 for holding the eyeglass lens ML capable of slanting, the drilling means (drilling processing device 200) for drilling the hole for the point frame (fixing hole for fixing the point frame) into the slanted eyeglass lens ML, and the grinding processing means (chamfering stones 224 and 225) for grinding processing the circumferential part of the lens for the point frame (rimless lens).

According to this structure, the drilling part of the refractive surface of the lens for the point frame can be set so as to be in substantially perpendicular to a main shaft of the tool when the tool such as the drill for the drilling is used for the drilling processing device 200 with a simple structure. Furthermore, by drilling the hole for the point frame in substantially perpendicular to the refractive surface of the lens for the point frame, the attachment for fixing can be fixed in a fine appearance. In this case, the drive motor for the tool such as the drill for the drilling can be shared with the drive motor for the grinding processing means (chamfering stones 224 and 225) for grinding and processing the circumferential part of the lens for the point frame (rimless lens) and with the drilling processing device 200.

Also, the lens grinding processing apparatus in the embodiment of the present invention has the lens rotating shafts 23 and 24 for retaining the eyeglass lens, a lens shape measuring device B for measuring the shape of the eyeglass lens ML retained by the lens rotating shafts 23 and 24, the arithmetic control means (arithmetic control circuit 80) for grinding and processing the eyeglass lens ML based on a result of measurement by the lens shape measuring device B, and the drilling means (drilling processing device 200) for drilling the hole for the point frame into the eyeglass lens ML. In addition, the lens grinding processing apparatus is used both as the lens grinding processing apparatus and the lens shape measuring device B as lens slanting means for slanting the eyeglass lens ML with the condition that the eyeglass lens ML is held between the lens rotating shafts 23 and 24. Moreover, the arithmetic control means (arithmetic control circuit 80) of the lens grinding processing apparatus controls so as the hole for fixing the point frame is drilled into the slanted eyeglass lens ML by the drilling means (drilling processing device 200) by calculating the angle of gradient β of the refractive surface of the eyeglass lens ML from the result of measurement by the lens shape measuring device B, and slanting the drilling part (drilling processing positions Pa, Pb) of the refractive surface of the eyeglass lens ML to the lens rotating shafts 23 and 24 so as to be in the arbitrary angle (orthogonal in the present embodiment) to a drilling direction of the drilling means (drilling processing device 200) by using the lens shape measuring device B based on the angle of gradient β.

According to this structure, the drilling part of the refractive surface of the lens for the point frame (rimless lens) can be set so as to be in the arbitrary angle (substantially perpendicular in the present embodiment) to the main shaft of the tool when the tool such as the drill for the drilling is used for the drilling processing device 200 with simple structure. Furthermore, since the lens grinding processing apparatus is used both as the lens grinding processing apparatus and the lens shape measuring device B for measuring the lens thickness and the curvature shape of the refractive surface as the lens slanting means for slanting the eyeglass lens ML with the condition that the eyeglass lens ML is held between the lens rotating shafts 23 and 24, it is not necessary to provide lens slanting means additionally, therefore, the structure becomes simple. Moreover, since the angle of gradient β of the eyeglass lens ML is obtained from the result of measurement by the lens shape measuring device, the angle of gradient β can be obtained accurately, as a result, the main shaft of the tool for the drilling can be set in perpendicular to the tangents in the drilling processing positions Pa, Pb when drilling the hole for fixing the point frame into the eyeglass lens ML. Accordingly, by drilling the hole for fixing the frame which is in substantially perpendicular into the refractive surface of the point frame lens (rimless lens), the attachment for fixing can be fixed in fine appearance.

In addition, in the lens grinding processing apparatus according to the embodiment of the present invention, each of the lens rotating shafts 23 and 24 has lens retaining portions (lens absorption device 300, lens retainer 320) provided with the spheroid Joint or the spheroid connection (adjustable joint 301, 321). According to this structure, in the case of slanting the eyeglass lens ML so as to set the main shaft of the tool for the drilling in perpendicular to the tangent in the drilling position of the refractive surface of the eyeglass lens when drilling the hole for fixing the point frame, the eyeglass lens ML retained between the lens rotating shafts 28 and 24 can easily be slanted and adjusted with simple structure.

Because the present invention is structured as described above, it is possible to drill the hole for fixing the frame into the refractive surface of the point frame (rimless lens) in the arbitrary angle (including substantially perpendicular), therefore, the attachment for fixing can be fixed in fine appearance.

Also, the lens grinding processing device in the embodiment of the present invention is provided with the apparatus main body 3, the pair of lens rotating shafts 23 and 24 rotatably provided in the apparatus main body capable of relatively approaching and separating adjustably on a same axis for holding the eyeglass lens ML, and a shaft rotating driving device (lens rotating shaft drive motor 25) for rotating and driving the pair of lens rotating shafts 23 and 24. Also, this lens grinding processing apparatus has the lens retaining members (300, 320) filed to the opposed end sections of the pair of lens rotating shafts 23 and 24 respectively capable of slanting adjustably for slant-ably holding the eyeglass lens ML between the pair of lens rotating shafts 23 and 24, and the drilling device (drilling processing device 200) for drilling the hole for the point frame into the eyeglass lens held between the lens retaining members. Furthermore, the lens grinding processing apparatus has the grinding stone (grinding stone 35 or chamfering stones 224, 225) rotatably provided capable of relatively approaching and separating to the lens rotating shafts 23 and 24, a shaft-to-shaft distance variable device (shaft-to-shaft distance adjusting means 43 as the shaft-to-shaft distance adjusting mechanism) for changing a shaft-to-shaft distance between the lens rotating shafts 23 and 24 and the grinding stone (grinding stone 35 or chamfering stones 224, 225) by relatively approaching and separating the lens rotating shafts 28 and 24 and the grinding stone (grinding stone 35 or chamfering stones 224, 225), and the arithmetic control circuit 80 for adjusting the shaft-to-shaft distance between the lens rotating shafts 23 and 24 and the grinding stone (grinding stone 35 or chamfering stones 224, 225) by controlling the shaft rotating driving device (lens rotating shaft drive motor 25) and the shaft-to-shaft distance variable device (shaft-to-shaft distance adjusting means 43 as the shaft-to-shaft distance adjusting mechanism) in motion based on the lens shape information (θi, ρi).

According to this structure, the hole for fixing the frame which is in substantially perpendicular can be drilled into the refractive surface of the eyeglass lens ML by slanting and adjusting the eyeglass lens in the lens grinding processing apparatus, as a result, the attachment for fixing can be fixed with fine appearance.

Also, in the lens grinding processing apparatus of the embodiment of the present invention, each of the lens retaining members (300, 320) is provided with the spheroid joint or the spheroid connection (301, 321) for slant-ably retaining the eyeglass lens ML. According to this structure, the slanting and adjusting of the eyeglass lens ML held between the lens retaining members (300, 320) can be carried out with simple structure.

Also, in the lens grinding processing apparatus of the embodiment of the present invention, the spheroid joint or the spheroid connection (301, 321) is provided with a movable portion (hemispheric members 304, 305 and 324) which enables the eyeglass lens ML to be slanted and adjusted in a condition when the lens retaining members (300, 320) hold the eyeglass lens ML with the clamping force in a setting range smaller than a predetermined value, and maintains the eyeglass lens ML in the slanted state by being fixed by the friction in a condition when the lens retaining members (300, 320) hold the eyeglass lens ML 6 with the clamping force of over the predetermined value.

According to this structure, it is possible to set the eyeglass lens ML to be in the condition which the slanting and adjusting thereof to the lens rotating shafts 23 and 24 can be carried out, and to set the eyeglass lens ML to be in the condition which the eyeglass lens ML is fixed and does not slant to the lens rotating shafts 23 and 24.

Also, in the lens grinding processing apparatus of the embodiment of the present invention, one (23) of the pair of lens rotating shafts 23 and 24 is provided rotatably and incapable of moving in the axis direction, and the other (24) of the pair of lens rotating shafts 23 and 24 is provided rotatably and capable of moving in the axis direction. In addition, aforementioned the other lens rotating shaft 24 is provided capable of moving and controlled in the axis direction by a shaft advancing and retracting drive device (feed screw mechanism SM). Also, the arithmetic control circuit 80 of the lens grinding processing apparatus controls aforementioned the other lens rotating shaft 24 so as to be advanced and retracted in the axis direction by controlling the shaft advancing and retracting drive device (feed screw mechanism SM) in motion, so that the apparatus is provided capable of adjusting the clamping force by the lens retaining members (300, 320) to the eyeglass lens ML.

According to such structure stated above, by adjusting the clamping force to the eyeglass lens ML by the lens retaining members (300, 320), it is possible to set the eyeglass lens ML to be in the condition which the slanting and adjusting thereof to the lens rotating shafts 23 and 24 can be carried out, and to set the eyeglass lens ML to be in the condition which the eyeglass lens ML is fixed and does not slant to the lens rotating shafts 23 and 24.

Also, in the lens grinding processing apparatus of the embodiment of the present invention, the apparatus main body 3 is provided with a lens shape measuring device (lens thickness measuring system 18) for measuring the lens thickness which is along the lens shape of the eyeglass lens ML based on the lens shape information (θi, ρi). In addition, the arithmetic control circuit 80 of the lens grinding processing apparatus slants the eyeglass lens ML held between the lens retaining members (300, 320) by controlling the lens shape measuring device (lens thickness measuring system 18) in motion. According to this structure, because the slanting and adjusting of the eyeglass lens ML is carried out by utilizing the lens shape measuring device (lens thickness measuring system 18) provided in the lens grinding processing apparatus, it is not necessary to provide means for slanting and adjusting the eyeglass lens ML additionally.

Also, the arithmetic control circuit 80 in the lens grinding processing apparatus of the embodiment of the present invention carries out a control so that the hole for fixing the point frame is drilled into the slanted eyeglass lens ML by the drilling device (drilling processing device 200) by calculating the angle of gradient of the refractive surface of the eyeglass lens ML from the result of measurement by the lens shape measuring device (lens thickness measuring system 18), and slanting the eyeglass lens ML to the lens rotating shafts 23 and 24 by using the lens shape measuring device (lens thickness measuring system 18) so as to set the drilling part of the refractive surface of the eyeglass lens ML to be in a certain angel to the drilling device (drilling processing device 200) based on the angle of gradient.

According to this structure, the lens shape measuring device (lens thickness measuring system 18) can measure the lens thickness of the refractive surface of the eyeglass lens ML in the part along the shape of the lens based on the lens shape information (θi, ρi) and the curvature of the front side refractive surface and the rear side refractive surface of the eyeglass lens ML. In addition, since the arithmetic control circuit 80 is set to slant and adjust the eyeglass lens ML by controlling the lens shape measuring device (lens thickness measuring system 18) based on the result of above measurement, the eyeglass lens ML can be slanted and adjusted accurately so as to set the drilling tool of the drilling device (drilling processing device 200) to be in perpendicular to the drilling part.

Also, after slanting the eyeglass lens ML to the lens rotating shafts 23 and 24 by using the lens shape measuring device (lens thickness measuring system 18) with the condition of holding the eyeglass lens ML between the lens retaining members (300, 320) with the clamping force in the setting range smaller than the predetermined value by controlling the shaft advancing and retracting drive device (feed screw mechanism SM) in motion, the arithmetic control circuit 80 in the lens grinding processing apparatus of the embodiment of the present invention carries out the control so that the hole for fixing the point frame is drilled into the slanted eyeglass lens ML by the drilling device (drilling processing device 200) by holding the eyeglass lens ML between the lens retaining members (300, 320) with the clamping force of over the predetermined value by controlling the shaft advancing and retracting drive device (feed screw mechanism SM) in motion.

According to this structure, because the drilling process can be carried out to the eyeglass lens ML after slanting and controlling the eyeglass lens ML, it is possible to automate the drilling process to the eyeglass lens ML by the lens grinding processing apparatus.

Also, the drilling device (drilling processing device 200) in the lens grinding processing apparatus of the embodiment of the present invention has an arm (swing arm 204) retained by the apparatus main body 3 capable of approaching and separating to the lens rotating shafts 23 and 24, and an arm driving device (swing driving means 205) for driving the arm (swing arm 204) to be approached and separated to the lens rotating shafts 23 and 24. In addition, the drilling device (drilling processing device 200) has the drilling tool (drill 221 or the tools such as the end mill or the reamer) which extends in a same direction or in substantially a same direction to the extending directions of the lens rotating shafts 23 and 24 and is retained by the arm (swing arm 204) capable of rotating and driving, and a tool rotating driving device (processing device driving means 203) for rotating and driving the drilling tool (drill 221 or the tools such as the end mill or the reamer). Furthermore, the drilling device (drilling processing device 200) is provided with a relative moving device for relatively approaching and separating the drilling tool (drill 221 or the tools such as the end mill or the reamer) and the eyeglass lens ML retained between the lens retaining members (300, 320).

According to this structure, the drilling process can be carried out to the eyeglass lens ML with the drilling tool (drill 221 or the tools such as the end mill or the reamer) by facing the drilling tool (drill 221 or the tools such as the end mill or the reamer) to the eyeglass lens ML retained between the lens rotating shafts 23 and 24 with simple structure.

Figure 10:
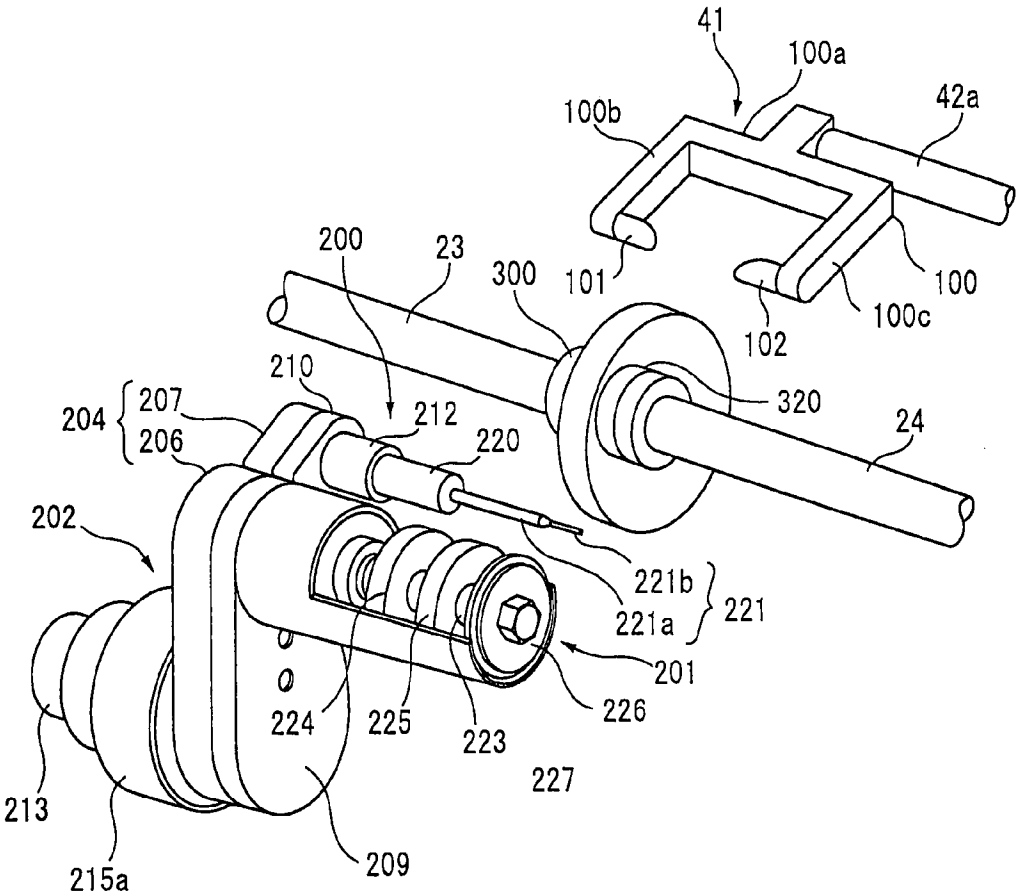
FIG. 10 is a partial-arrangement explanatory view showing a relation between the auxiliary lens peripheral edge processing means shown in FIGS. 3A and 4 and a measuring element.

Also, the relative moving device in the lens grinding processing device of the embodiment of the present invention can be as a tool retaining device which retains the drilling tool (drill or the tools such as the end mill or the reamer) to the arm (swing arm 204) capable of advancing and retracting in an axis direction. For the tool retaining device, such a structure can be employed which the spindle 220 in FIGS. 8 and 10 is rotatably retained by the arm (swing arm 204) capable of moving in an axis direction, and the spindle 220 is provided capable of driving by a hydraulic cylinder or a drive motor which are not shown, and the spindle 220 is provided capable of moving in the axis direction to the pulley 235 and incapable of relatively rotating. In addition, for the tool retaining device, the spindle 220 can be constituted by a hydraulic cylinder which is telescopic.

According to this structure, the drilling process to the eyeglass lens ML can be carried out with the tool retaining device provided to the arm (swing arm 204).

Also, the relative moving device in the lens grinding processing apparatus of the embodiment of the present invention has the carriage 22 which the pair of lens rotating shafts 23 and 24 are fixed and is capable of moving and driving in the extending directions of the lens rotating shafts 23 and 24, and an axis direction driving device (base drive motor 14) which moves and drives the carriage 22 in the extending directions of the lens rotating shafts 23 and 24.

According to this structure, the axis direction driving device (base drive motor 14) of the lens grinding processing apparatus can be used for driving the drilling tool (drill 221 or the tools such as the end mill or the reamer) and the eyeglass lens ML retained between the lens retaining members (300, 320) in such a manner as to relatively approach and separate. Therefore, it is needless to additionally provide a constitution for relatively approaching and separating the drilling tool (drill 221 or the tools such as the end mill or the reamer) and the eyeglass lens ML.

Also, the carriage 22 in the lens grinding processing apparatus of the embodiment of the present invention is provided capable of elevating and lowering by the shaft-to-shaft distance variable device (shaft-to-shaft distance adjusting means 43 as the shaft-to-shaft distance adjusting mechanism).

Also, in the lens grinding processing apparatus of the embodiment of the present invention, the chamfering stones 224, 225 or the grooving cutter 226 are rotatably retained by the arm (swing arm 204), and the chamfering stone 224 or the grooving cutter 226 is provided capable of rotating and driving by the tool rotating driving device (processing device driving means 203).

According to this structure, the chamfering stone 224 or the grooving cutter 226 or the like, and the drilling tool (drill 221 or the tools such as the end mill or the reamer) can be driven by the shared tool rotating driving device (processing device driving means 203). That is, since the tool rotating driving device (processing device driving means 203) of the chamfering stone 224 or the grooving cutter 226 that the lens grinding processing apparatus has can be shared for driving the drilling tool (drill 221 or the tools such as the end mill or the reamer), it is not required to provide driving means for driving the drilling tool (drill 221 or the tools such as the end mill or the reamer) additionally.

What is claimed is:

1. A lens grinding processing apparatus comprising:

an apparatus main body;

a pair of lens rotating shafts provided rotatably and adjustably in said apparatus main body for relatively approaching and separating on a same axis to hold an eyeglass lens;

a shaft rotating driving device for rotating and driving said pair of lens rotating shafts;

lens retaining members fixed to opposed end sections of said pair of lens rotating shafts respectively capable of slanting adjustably for slantably holding said eyeglass lens between said pair of lens rotating shafts;

a drilling device for drilling a hole for a point frame into the eyeglass lens held between said lens retaining members;

a grinding stone, rotatably provided, and capable of relatively approaching to and separating from said lens rotating shafts;

a shaft-to-shaft distance variable device for changing a shaft-to-shaft distance between said lens rotating shafts and said grinding stone by relatively approaching and separating said lens rotating shafts and said grinding stone; and an arithmetic control circuit for adjusting the shaft-to-shaft distance between said lens rotating shafts and said grinding stone by controlling said shaft rotating driving device and the shaft-to-shaft distance variable device in motion based on information (θi, ρi); and a lens shape measuring device for measuring a lens thickness which is along a lens shape of said eyeglass lens based on the lens shape information (θi, ρi), wherein said arithmetic control circuit restricts a movement of said lens shape measuring device to slant the eyeglass lens held between said lens retaining members, and drills the hole for fixing the point frame by said drilling device.

2. The lens grinding processing apparatus according to claim 1, wherein each of said lens retaining members is provided with a spheroid joint or a spheroid connection for slantably retaining said eyeglass lens.

3. The lens grinding processing apparatus according to claim 2, wherein said spheroid joint or the spheroid connection is provided with a movable portion which enables said eyeglass lens to be slanted and adjusted in a condition when said lens retaining members hold said eyeglass lens with a clamping force in a setting range smaller than a predetermined value, and maintains said eyeglass lens in a slanted state by being fixed by a friction in a condition when said lens retaining members hold said eyeglass lens with the clamping force of over the predetermined value.

4. The lens grinding processing apparatus according to claim 3, wherein one of said pair of lens rotating shafts is provided rotatably and incapable of moving in an axis direction, and the other of said pair of lens rotating shafts is provided rotatably and capable of moving in the axis direction, and said the other of the lens rotating shafts is provided capable of moving and controlled in the axis direction by a shaft advancing and retracting drive device, and said arithmetic control circuit controls said the other of the lens rotating shafts so as to be advanced and retracted in the axis direction by controlling said shaft advancing and retracting drive device in motion, so that the apparatus is provided capable of adjusting the clamping force by said lens retaining members to said eyeglass lens.

5. The lens grinding processing apparatus according to claim 1, wherein said arithmetic control circuit slants the eyeglass lens held between said lens retaining members by controlling said lens rotating shafts in motion.

6. The lens grinding processing apparatus according to claim 5, wherein said arithmetic control circuit carries out a control so that the hole for fixing the point frame is drilled into the slanted eyeglass lens by said drilling device by calculating an angle of gradient of a refractive surface of the eyeglass lens from a result of measurement by said lens shape measuring device, and slanting said eyeglass lens relative to said lens rotating shafts by using said lens rotating shafts so as to set a drilling part of the refractive surface of said eyeglass lens to be in a certain angle to said drilling device based on the angle of gradient.

7. The lens grinding processing apparatus according to claim 6, wherein each of said lens retaining members is provided with a spheroid joint or a spheroid connection for slantably retaining said eyeglass lens.

8. The lens grinding processing apparatus according to claim 7, wherein said spheroid joint or the spheroid connection is provided with a movable portion which enables said eyeglass lens to be slanted and adjusted in a condition when said lens retaining members hold said eyeglass lens with a clamping force in a setting range smaller than a predetermined value, and maintains said eyeglass lens in a slanted state by being fixed by a friction in a condition when said lens retaining members hold said eyeglass lens with the clamping force of over the predetermined value.

9. The lens grinding processing apparatus according to claim 8, wherein one of said pair of lens rotating shafts is provided rotatably and incapable of moving in an axis direction, and the other of said pair of lens rotating shafts is provided rotatably and capable of moving in the axis direction, and said the other of the lens rotating shafts is provided capable of moving and controlled in the axis direction by a shaft advancing and retracting drive device, and said arithmetic control circuit controls said the other of the lens rotating shafts so as to be advanced and retracted in the axis direction by controlling said shaft advancing and retracting drive device in motion, so that the apparatus is provided capable of adjusting the clamping force by said lens retaining members to said eyeglass lens.

10. The lens grinding processing apparatus according to claim 9, wherein after slanting said eyeglass lens relative to said lens rotating shafts by using said lens rotating shafts with the condition of holding the eyeglass lens between the lens retaining members with the clamping force in the setting range smaller than said predetermined value by controlling said shaft advancing and retracting drive device in motion, said arithmetic control circuit carries out the control so that the hole for fixing the point frame is drilled into the slanted eyeglass lens by said drilling device by holding said eyeglass lens between said lens retaining members with the clamping force of over the predetermined value by controlling said shaft advancing and retracting drive device in motion.

11. The lens grinding processing apparatus according to claim 1, wherein said drilling device is provided with an arm retained by said apparatus main body capable of approaching and separating to said lens rotating shafts, an arm driving device for driving said arm to be approached and separated to said lens rotating shafts, a drilling tool which extends in a same direction or in substantially a same direction to extending directions of said lens rotating shafts and is retained by said arm capable of rotating and driving, a tool rotating driving device for rotating and driving said drilling tool, and a relative moving device for relatively approaching and separating said drilling tool and the eyeglass lens retained between said lens retaining members.

12. The lens grinding processing apparatus according to claim 11, wherein said relative moving device is a tool retaining device which retains said drilling tool to said arm capable of advancing and retracting in an axis direction.

13. The lens grinding processing apparatus according to claim 11, wherein said relative moving device is provided with a carriage which said pair of lens rotating shafts are fixed and is capable of moving and driving in the extending directions of said lens rotating shafts, and an axis direction driving device which moves and drives the carriage in the extending directions of said lens rotating shafts.

14. The lens grinding processing apparatus according to claim 13, wherein said carriage is provided capable of elevating and lowering by said shaft-to-shaft distance variable device.

15. The lens grinding processing apparatus according to claim 11, wherein a chamfering stone or a grooving cutter is rotatably retained by said arm, and said chamfering stone or the grooving cutter is provided capable of rotating and driving by said tool rotating driving device.

16. A lens grinding processing apparatus comprising:

an apparatus main body;

a pair of lens rotating shafts provided rotatably and adjustably in said apparatus main body for relatively approaching and separating on a same axis to hold an eyeglass lens;

a shaft rotating driving device for rotating and driving said pair of lens rotating shafts;

lens retaining members fixed to opposed end sections of said pair of lens rotating shafts respectively capable of slanting adjustably for slantably holding said eyeglass lens between said pair of lens rotating shafts;

a grinding stone, rotatably provided, and capable of relatively approaching to and separating from said lens rotating shafts;

a shaft-to-shaft distance variable device for changing a shaft-to-shaft distance between said lens rotating shafts and said grinding stone by relatively approaching and separating said lens rotating shafts and said grinding stone; and an arithmetic control circuit for adjusting the shaft-to-shaft distance between said lens rotating shafts and said grinding stone by controlling said shaft rotating driving device and the shaft-to-shaft distance variable device in motion based on lens shape information ($\theta i$, $\rho i$); and a lens shape measuring device for measuring a lens thickness which is along a lens shape of said eyeglass lens based on the lens shape information ($\theta i$, $\rho i$), wherein said arithmetic control circuit restricts a movement of said lens shape measuring device and moves said lens rotating shafts to slant the eyeglass lens held between said lens retaining members by adapting the eyeglass lens to contact with said lens shape measuring device.

17. A lens grinding processing apparatus comprising:

an apparatus main body;

a pair of lens rotating shafts provided rotatably and adjustably in said apparatus main body for relatively approaching and separating on a same axis to hold an eyeglass lens;

a shaft rotating driving device for rotating and driving said pair of lens rotating shafts;

lens retaining members fixed to opposed end sections of said pair of lens rotating shafts respectively capable of slanting adjustably for slantably holding said eyeglass lens between said pair of lens rotating shafts;

a grinding stone, rotatably provided, and capable of relatively approaching to and separating from said lens rotating shafts;

a shaft-to-shaft distance variable device for changing a shaft-to-shaft distance between said lens rotating shafts and said grinding stone by relatively approaching and separating said lens rotating shafts and said grinding stone; and an arithmetic control circuit for adjusting the shaft-to-shaft distance between said lens rotating shafts and said grinding stone by controlling said shaft rotating driving device and the shaft-to-shaft distance variable device in motion based on lens shape information ($\theta i$, $\rho i$); and a lens shape measuring device for measuring a lens thickness which is along a lens shape of said eyeglass lens based on the lens shape information ($\theta i$, $\rho i$), wherein said arithmetic control circuit controls a movement of at least one of said lens shape measuring device and said lens rotating shafts such that the eyeglass lens held between said lens retaining members contacts with said lens shape measuring device and slanted by said lens shape measuring device.

* * * * *